US010731400B2

(12) United States Patent
Bolduc et al.

(10) Patent No.: US 10,731,400 B2
(45) Date of Patent: Aug. 4, 2020

(54) DOOR PANEL AND DOOR PANEL CONNECTION ASSEMBLY FOR A PATIO DOOR

(71) Applicant: PORTES PATIO NOVATECH INC., Beauceville (CA)

(72) Inventors: Louis-David Bolduc, St-Georges (CA); Erick Giroux, Sainte-Marguerite (CA)

(73) Assignee: PORTES PATIO NOVATECH IINC., Beauceville, Quebec (CA)

( * ) Notice: Subject to any disclaimer, the term of this patent is extended or adjusted under 35 U.S.C. 154(b) by 51 days.

(21) Appl. No.: 15/807,387

(22) Filed: Nov. 8, 2017

(65) Prior Publication Data

US 2018/0128034 A1 May 10, 2018

(30) Foreign Application Priority Data

Nov. 8, 2016 (CA) ..... 2947994

(51) Int. Cl.
*E06B 1/04* (2006.01)
*E06B 1/62* (2006.01)
(Continued)

(52) U.S. Cl.
CPC ..... *E06B 1/62* (2013.01); *E06B 1/16* (2013.01); *E06B 1/52* (2013.01); *E06B 1/70* (2013.01);
(Continued)

(58) Field of Classification Search
CPC ..... E06B 1/16; E06B 1/52; E06B 1/62; E06B 1/70; E06B 3/4618; E06B 3/9642;
(Continued)

(56) References Cited

U.S. PATENT DOCUMENTS 1,765,543 A * 6/1930 Schlacks ..... E06B 1/36 49/394
1,799,482 A * 4/1931 Schlacks ..... E06B 1/36 292/DIG. 20
(Continued)

FOREIGN PATENT DOCUMENTS

BR 102014009205 A2 12/2015
CA 1292911 C 12/1991
(Continued)

*Primary Examiner* — Joshua J Michener
*Assistant Examiner* — James J Buckle, Jr.
(74) *Attorney, Agent, or Firm* — Merchant & Gould P.C.

(57) ABSTRACT

A patio door or at least a door panel or a door panel frame for a patio door is provided. The patio door has two panels, wherein one is an "active panel" (i.e. a sliding panel) and another one is a "stationary panel" (i.e. a fixed panel). The door panels include at least four elongated door frame members configurable to define rectangular door panels frame with a longitudinal axis and a transversal axis. There is also provided a tightening connector assembly, a connector body with a weatherstrip receiving channel and a door panel connection assembly. The tightening connector assembly includes a connector body having a first and second frame segments extending along a tightening axis and an insert receiving cavity defined therein, the first and second frame segments being engageable with two of the at least four elongated door frame members. The tightening connector assembly also includes a tightening insert engageable in the insert receiving cavity of the connector body.

22 Claims, 35 Drawing Sheets

(51) Int. Cl.

| | |
|---|---|
| ***E06B 3/46*** | (2006.01) |
| ***E06B 3/964*** | (2006.01) |
| ***E06B 1/70*** | (2006.01) |
| ***E06B 1/16*** | (2006.01) |
| ***E06B 1/52*** | (2006.01) |

(52) U.S. Cl.
CPC ..... *E06B 3/4618* (2013.01); *E06B 3/9642* (2013.01); *E06B 2001/622* (2013.01)

(58) Field of Classification Search
CPC .... E06B 2001/622; E06B 3/222; E06B 3/922; E06B 3/924; E06B 1/12
USPC ..... 52/207
See application file for complete search history.

(56) References Cited

U.S. PATENT DOCUMENTS

| | | | | | |
|---|---|---|---|---|---|
| 2,847,726 | A * | 8/1958 | Frick | E06B 3/4609 | 49/380 |
| 3,111,726 | A | 11/1963 | Grossman | | |
| 3,782,054 | A * | 1/1974 | Goss, Jr. | E06B 3/9682 | 40/782 |
| 4,205,486 | A * | 6/1980 | Guarnacci | E06B 3/205 | 49/501 |
| 4,570,406 | A * | 2/1986 | DiFazio | E04C 2/384 | 160/381 |
| 5,110,234 | A | 5/1992 | Maekinen | | |
| 5,473,853 | A * | 12/1995 | Guillemet | E06B 9/52 | 160/105 |
| 6,067,760 | A * | 5/2000 | Nowell | E06B 3/26347 | 403/231 |
| 6,644,380 | B2 * | 11/2003 | Perich | E06B 3/9647 | 160/381 |
| 6,813,862 | B2 * | 11/2004 | Perich | E05B 65/0876 | 16/105 |
| 7,150,130 | B2 * | 12/2006 | Kobayashi | E06B 3/26301 | 52/210 |
| 7,677,003 | B2 * | 3/2010 | Baughn | E06B 3/9682 | 52/473 |
| 8,322,091 | B2 * | 12/2012 | Smith | B60J 1/007 | 49/501 |
| 8,333,037 | B2 * | 12/2012 | Sullivan | E06B 9/52 | 160/105 |
| 8,490,347 | B2 * | 7/2013 | Valler | E06B 3/16 | 52/204.1 |
| 8,596,017 | B2 * | 12/2013 | Emanuel | E06B 3/22 | 52/204.5 |
| 8,851,787 | B2 * | 10/2014 | Kelley | B29C 65/542 | 403/402 |
| 8,857,129 | B2 * | 10/2014 | Beranek | E06B 3/9682 | 52/204.5 |
| 9,863,183 | B2 * | 1/2018 | Johnson | E06B 7/14 | |
| 2003/0201071 | A1 | 10/2003 | Kobayashi et al. | | |
| 2007/0151179 | A1 * | 7/2007 | Speyer | E06B 7/23 | 52/207 |
| 2007/0175121 | A1 * | 8/2007 | Speyer | E05C 9/063 | 52/207 |
| 2007/0234657 | A1 * | 10/2007 | Speyer | E06B 7/23 | 52/207 |
| 2010/0175328 | A1 | 7/2010 | Hess | | |
| 2010/0175336 | A1 * | 7/2010 | Sullivan | E06B 3/4636 | 52/173.1 |
| 2012/0279166 | A1 * | 11/2012 | Valler | E06B 3/16 | 52/656.2 |
| 2015/0075075 | A1 * | 3/2015 | Erskine | E06B 3/4609 | 49/127 |

FOREIGN PATENT DOCUMENTS

| | | | |
|---|---|---|---|
| CA | 2710278 | C | 9/2012 |
| CN | 2247712 | Y | 2/1997 |
| CN | 2282042 | Y | 5/1998 |
| CN | 2340873 | Y | 9/1999 |
| CN | 2382814 | Y | 6/2000 |
| CN | 2382815 | Y | 6/2000 |
| CN | 2620051 | Y | 6/2004 |
| CN | 2656584 | Y | 11/2004 |
| CN | 2382813 | Y | 6/2006 |
| CN | 2818727 | Y | 9/2006 |
| CN | 2851474 | Y | 12/2006 |
| CN | 2908733 | Y | 6/2007 |
| CN | 200968149 | Y | 10/2007 |
| CN | 200971712 | Y | 11/2007 |
| CN | 200971713 | Y | 11/2007 |
| CN | 200978602 | Y | 11/2007 |
| CN | 201059140 | Y | 5/2008 |
| CN | 101225731 | A | 7/2008 |
| CN | 100408802 | C | 8/2008 |
| CN | 201386472 | Y | 1/2010 |
| CN | 201539190 | U | 8/2010 |
| CN | 101525969 | B | 2/2011 |
| CN | 101654991 | B | 5/2011 |
| CN | 101649713 | B | 6/2011 |
| CN | 202000831 | U | 10/2011 |
| CN | 101555766 | B | 1/2012 |
| CN | 202148832 | U | 2/2012 |
| CN | 202202715 | U | 4/2012 |
| CN | 202249422 | U | 5/2012 |
| CN | 202300001 | U | 7/2012 |
| CN | 202467488 | U | 10/2012 |
| CN | 202559987 | U | 11/2012 |
| CN | 202611457 | U | 12/2012 |
| CN | 202645314 | U | 1/2013 |
| CN | 202832002 | U | 3/2013 |
| CN | 202832055 | U | 3/2013 |
| CN | 202945945 | U | 5/2013 |
| CN | 202990759 | U | 6/2013 |
| CN | 203145714 | U | 8/2013 |
| CN | 203308302 | U | 11/2013 |
| CN | 103422781 | A | 12/2013 |
| CN | 103806808 | A | 5/2014 |
| CN | 203613963 | U | 5/2014 |
| CN | 103899198 | A | 7/2014 |
| CN | 203742368 | U | 7/2014 |
| CN | 203742377 | U | 7/2014 |
| CN | 203742386 | U | 7/2014 |
| CN | 104005649 | A | 8/2014 |
| CN | 203879251 | U | 10/2014 |
| CN | 204040777 | U | 12/2014 |
| CN | 204060342 | U | 12/2014 |
| CN | 104343337 | A | 2/2015 |
| CN | 104481352 | A | 4/2015 |
| CN | 104863460 | A | 8/2015 |
| CN | 204552491 | U | 8/2015 |
| CN | 204738682 | U | 11/2015 |
| CN | 205243305 | U | 5/2016 |
| CN | 205531890 | U | 8/2016 |
| EP | 0 822 310 | A2 | 2/1998 |
| EP | 1 970 514 | A2 | 9/2008 |
| FR | 2 918 692 | A1 | 1/2009 |
| GB | 674995 | A | 7/1952 |
| JP | 2005-232871 | A | 9/2005 |
| JP | 3880537 | B2 | 2/2007 |
| JP | 4376086 | B2 | 12/2009 |
| KR | 10-1303277 | B1 | 9/2013 |
| KR | 20160076107 | A | 6/2016 |
| WO | 2011082594 | A1 | 7/2011 |

* cited by examiner

DOOR PANEL AND DOOR PANEL CONNECTION ASSEMBLY FOR A PATIO DOOR

CROSS-REFERENCE TO RELATED APPLICATIONS

This application claims priority of patent application CA 2,947,994 filed on Nov. 8, 2016, the specification of which is hereby incorporated by reference.

TECHNICAL FIELD

The technical field generally relates to door panel for a patio door, and more particularly to a tightening connector assembly and a door panel connection assembly for a patio door engageable with elongated door frame members to define at least partially a rectangular door panel frame.

BACKGROUND

Patio doors are used to provide access from indoors to outdoors. Known patio doors usually include two door panels, wherein one is fixed and the other mobile so as to slide with respect to the fixed panel. Each door panel includes elongated frame members defining together a rectangular frame in which is mounted a glass panel.

Different connectors and/or assemblies exist for assembling together the elongated frame members of a door panel frame or a patio door frame. Such connectors and/or assemblies are typically mounted near or at a corner of two adjacent and connecting elongated frame members.

However, it remains a challenge to provide door panel or patio doors that are free of thermal bridges in the elongated frame members made of metal such as aluminum or which provides a continuous weatherstrip member along a periphery thereof.

Therefore, there is a need for improved door panel frame or door panel connection assembly for a patio door that solve at least some of the issues mentioned above.

SUMMARY

In accordance with one aspect, there is provided a door panel for a patio door. The door includes a door panel frame, a connector body and at least one tightening connector assembly. The door panel frame includes at least four elongated door frame members and has a longitudinal axis and a transversal axis. The at least one tightening connector assembly includes a connector body, a tightening insert and at least one mechanical faster. The connector body has a first frame segment and a second frame segment extending along a tightening axis and has an insert receiving cavity defined therein with an insert contact surface defining an oblique angle with respect to the tightening axis. The connector body is engageable with two of the elongated door frame members abutting each other and configured in an orthogonal configuration with the first frame segment being engaged with a first one of the two elongated door frame members and the second frame segment being engaged with a second one of the two elongated door frame members. The tightening insert is engageable in the insert receiving cavity of the connector body and has a connector contact surface contacting the insert contact surface when engaged in the insert receiving cavity. The at least one mechanical fastener is insertable into the second one of the two elongated door frame members, the connector body, and the tightening insert. The connector body and the tightening insert pull the second one of the two elongated door frame members towards and against the first one of the two elongated door frame members and along the tightening axis when being secured together.

In some embodiments, each one of the first and second elongated frame members includes two opposite ends, an internal edge, and an external edge, and end edges connecting the internal and external edges. The adjacent ones of the end edges of the first and second elongated frame members are straight end edges and the straight end edge of one of the first and second elongated frame members abuts against the internal edge of the other one of the first and second elongated frame members.

In some embodiments, each one of the first and second elongated frame members includes a connector receiving cavity defined into adjacent ones of the two opposite ends with a respective one of the first frame segment and the second frame segment being insertable therein.

In some embodiments, the connector receiving cavity of one of the first and second elongated frame members is accessible at least through the internal edge and the connector receiving cavity of the other one of the first and second elongated frame members is accessible through the end edge adjacent to the one of the first and second elongated frame members.

In some embodiments, the other one of the first and second elongated frame members includes a profile with two sidewalls defining a central channel including the connector receiving cavity at one of the opposite ends thereof and the central channel is open along the external edge of the other one of the first and second elongated frame members.

In some embodiments, the connector receiving cavity of the one of the first and second elongated frame members is accessible through the end edge.

In some embodiments, the first frame segment of the connector body includes at least one elongated rail and the first one of the two elongated door frame members engageable with the first frame segment includes at least one elongated guide, complementary to the at least one elongated rail and slidably engageable therewith.

In some embodiments, the insert receiving cavity is defined in the second frame segment of the connector body with the insert contact surface extending inwardly of the connector body.

In some embodiments, the insert contact surface has a profile defined by a plurality of oblique segments, each one of the oblique segments forming the oblique angle with respect to the tightening axis, the profile having an average slope defining the oblique angle.

In some embodiments, the connector contact surface is complementary to the insert contact surface.

In some embodiments, the connector body includes a first section of a mechanical fastener channel extending therethrough and being opened in the insert receiving cavity, and the tightening insert includes a second section of the mechanical fastener channel extending therethrough, the second section of the mechanical fastener channel being aligned with the first section when the tightening insert is inserted into the insert receiving cavity of the connector body.

In some embodiments, the second frame segment includes two sidewalls and the insert receiving cavity includes two insert receiving cavities, each one of the two insert receiving cavities being defined in a respective one of the sidewalls and the tightening insert includes two tightening inserts, each one being engageable with a respective one of the insert receiving cavities defined in the two sidewalls.

In some embodiments, the tightening axis extends substantially parallel to the transversal axis of the door panel frame.

In some embodiments, the door panel includes four tightening connector assemblies, each one being provided in a respective corner of the door panel frame.

In some embodiments, each one of the first and second elongated door frame members includes a weatherstrip receiving channel extending longitudinally therein, and the connector body of the at least one tightening connector assembly further includes at least one weatherstrip receiving channel defined therein, the at least one weatherstrip receiving channel of the connector body being aligned with the weatherstrip receiving channel of a respective one of the elongated door frame members when engaged together.

In accordance with another aspect, there is provided a tightening connector assembly for a patio door frame including at least two elongated door frame members and having a longitudinal axis and a transversal axis. The tightening connector assembly includes a connector body and a tightening insert. The connector body has a first frame segment and a second frame segment extending along a tightening axis, has an insert contact surface defining at least partially an insert receiving cavity and a first section of a mechanical fastener channel extending therethrough and being opened in the insert receiving cavity. The insert contact surface defines an oblique angle with respect to the tightening axis, and the connector body is engageable with two of the at least two elongated door frame members abutting each other and configured in an orthogonal configuration with the first frame segment being engageable with a first one of the at least two elongated door frame members and the second frame segment being engageable with a second one of the at least two elongated door frame members. The tightening insert is insertable in the insert receiving cavity of the connector body and has a connector contact surface contacting the insert contact surface when engaged in the insert receiving cavity and a second section of the mechanical fastener channel extending therethrough. The second section of the mechanical fastener channel is aligned with the first section when the tightening insert is inserted into the insert receiving cavity of the connector body.

In some embodiments, each one of the first and second elongated frame members includes two opposite ends, an internal edge, and an external edge, and end edges connecting the internal and external edges, and adjacent ones of the end edges are straight edges and the straight end edge of one of the first and second elongated frame members abuts against the internal edge of the other one of the first and second elongated frame members.

In some embodiments, each one of the first and second elongated frame members includes a connector receiving cavity positioned near adjacent ones of the two opposite ends and configured for receiving a respective one of the first frame segment and the second frame segment therein.

In some embodiments, the connector receiving cavity of one of the first and second elongated frame members is accessible at least through the internal edge and the connector receiving cavity of the other one of the first and second elongated frame members is accessible through the end edge adjacent to the one of the first and second elongated frame members.

In some embodiments, the other one of the first and second elongated frame members includes a profile with two sidewalls defining a central channel including the connector receiving cavity at one of the opposite ends thereof and the central channel is open along the external edge of the other one of the first and second elongated frame members.

In some embodiments, the connector receiving cavity of the one of the first and second elongated frame members is accessible through the end edge.

In some embodiments, the first frame segment of the connector body includes at least one elongated rail and the first one of the two elongated door frame members engageable with the first frame segment includes at least one elongated guide, complementary to the at least one elongated rail and engageable therewith.

In some embodiments, the insert receiving cavity is defined in the second frame segment of the connector body with the insert contact surface extending inwardly of the connector body.

In some embodiments, the insert contact surface has a profile defined by a plurality of oblique segments, each one of the oblique segments forming the oblique angle with respect to the tightening axis, the profile having an average slope defining the oblique angle.

In some embodiments, the connector contact surface is complementary to the insert contact surface.

In some embodiments, the second frame segment includes two sidewalls and the insert receiving cavity includes two insert receiving cavities, each one of the two insert receiving cavities being defined in a respective one of the sidewalls and the tightening insert includes two tightening inserts, each one being engageable with a respective one of the sidewalls.

In some embodiments, the tightening axis extends substantially parallel to the transversal axis of the door panel frame.

In some embodiments, each one of the first and second elongated door frame members includes a weatherstrip receiving channel extending longitudinally therein; and the connector body of the at least one tightening connector assembly includes at least one weatherstrip receiving channel defined therein, the at least one weatherstrip receiving channel of the connector body being aligned with the weatherstrip receiving channel of a respective one of the elongated door frame members when engaged together.

In accordance with another aspect, there is provided a door panel frame for a patio door and having a longitudinal axis and a transversal axis. The door panel frame includes elongated door frame members and at least one connector body. At least one of the elongated door frame members has a weatherstrip receiving channel extending longitudinally therein. The at least one connector body has a first frame segment and a second frame segment, the connector body being engageable with two of the elongated door frame members abutting each other and configured in an orthogonal configuration with the first frame segment being engaged with a first one of the two elongated door frame members and the second frame segment being engaged with a second one of the two elongated door frame members. The connector body has at least one weatherstrip receiving channel defined therein aligned with the weatherstrip receiving channel of a respective one of the elongated door frame members when engaged together.

In some embodiments, the at least one connector body includes a profile having an inside sidewall and an outside sidewall and the at least one weatherstrip receiving channel of the at least one connector body includes two elongated slots extending along a respective one of the inside and outside sidewalls.

In some embodiments, the at least one of the elongated frame members includes a profile with an inside sidewall and an outside sidewall and each one of the inside and outside sidewalls includes one of the weatherstrip receiving channel extending therealong and the two elongated slots of the connector body are aligned with the respective one of the weatherstrip receiving channels provided in the inside and the outside sidewalls of the at least one of the elongated frame members.

In some embodiments, the two elongated slots are defined on inner wall surfaces of the inside and outside sidewalls and faces each other if the connector body is mounted to a lower edge of the door panel frame and the two elongated slots are defined on outer wall surfaces of the inside and outside sidewalls if the connector body is mounted to an upper edge of the door panel frame.

In some embodiments, each one of the elongated door frame members includes a corresponding one of the weatherstrip receiving channel extending therealong and the door panel frame further includes four of the connector body, each one including at least one of the weatherstrip receiving channel, each one of the connector bodies being mounted in a respective corner of the door panel frame to connect two abutting ones of the elongated door frame members, the weatherstrip receiving channels of the elongated door frame members and the connector bodies defining a weatherstrip path extending substantially continuously along a perimeter of the door panel frame.

In some embodiments, each one of the first and second elongated frame members includes two opposite ends, an internal edge, and an external edge, and end edges connecting the internal and external edges, and adjacent ones of the end edges are straight edges and the straight end edge of one of the first and second elongated frame members abuts against the internal edge of the other one of the first and second elongated frame members.

In accordance with another aspect, there is provided a patio door. The patio door includes a patio door frame, a fixed door panel, and at least one door panel connection assembly. The patio door frame defines a door panel receiving cavity. Thea fixed door panel is insertable into the door panel receiving cavity and having a door panel frame including at least four elongated door frame members and at least one connector body connecting together two of the elongated door frame members abutting each other and configured in an orthogonal configuration. The at least one connector body includes at least two elongated body connectors, at least one on each side thereof, the at least two elongated body connectors being accessible when the at least one connector body engages together the two elongated door frame members. The at least one door panel connection assembly includes a patio door frame connector securable to the patio door frame, protruding in the door panel receiving cavity and having at least two elongated frame connectors, at least one on each side thereof and being slidably engageable with the at least two elongated body connectors of the connector body to be engageable therewith when the fixed door panel is inserted into the door panel receiving cavity.

In some embodiments, the door panel frame has a longitudinal axis and a transversal axis and the at least two elongated body connectors include rails protruding along the transversal axis and the at least two elongated frame connectors include complementary elongated grooves. The rails are slidably engageable into a respective one of the elongated grooves.

In some embodiments, the at least one connector body includes a profile having an inside sidewall and an outside sidewall and the at least two elongated body connectors extending along a respective one of the inside and outside sidewalls on inner wall surfaces thereof.

In accordance with another aspect, there is provided a door panel connection assembly for a patio door to engage a fixed door with a patio door frame inside a door panel receiving cavity defined by a plurality of elongated door frame members of the patio door frame. The door panel connection assembly includes at least one connector body, a patio door frame connector and a patio door frame connector. The at least one connector body is engageable with and securable to two of the plurality of elongated door frame members abutting each other and configured in an orthogonal configuration, the connector body including at least two elongated body connectors, at least one on each side thereof, the elongated body connectors being accessible when the at least one connector body engages together the two elongated door frame members. The patio door frame connector securable to the patio door frame, protruding in the door panel receiving cavity when secured thereto and having at least two elongated frame connectors, at least one on each side thereof and being engageable with a respective one of the at least two elongated body connectors of the connector body to be slidably engageable therewith when the fixed door panel is inserted into the door panel receiving cavity.

In some embodiments, the at least two elongated body connectors include rails protruding therealong and the at least two elongated frame connectors include complementary elongated grooves. The rails are slidably engageable into a respective one of the elongated grooves.

In some embodiments, the connector body includes a profile having an inside sidewall and an outside sidewall and the at least two elongated body connectors extending along a respective one of the inside and outside sidewalls on inner wall surfaces thereof.

Other features and advantages of the invention will be better understood upon reading of embodiments thereof with reference to the appended drawings.

BRIEF DESCRIPTION OF THE DRAWINGS

FIGS. 6A-C illustrate an embodiment of a tightening connector assembly wherein FIG. 6A shows a bottom perspective view of a connector body having a first frame segment and a second frame segment, and FIGS. 6B-C are respectively a perspective view and a side elevation view of a tightening insert engageable with the connector body shown in FIG. 6A.

FIGS. 22A-B show a longitudinal cross-sectional view of a patio door taken along a longitudinal axis thereof, wherein FIG. 22A is a sliding door panel and FIG. 22B is a fixed door panel, according to an embodiment.

DETAILED DESCRIPTION

Figure 1:
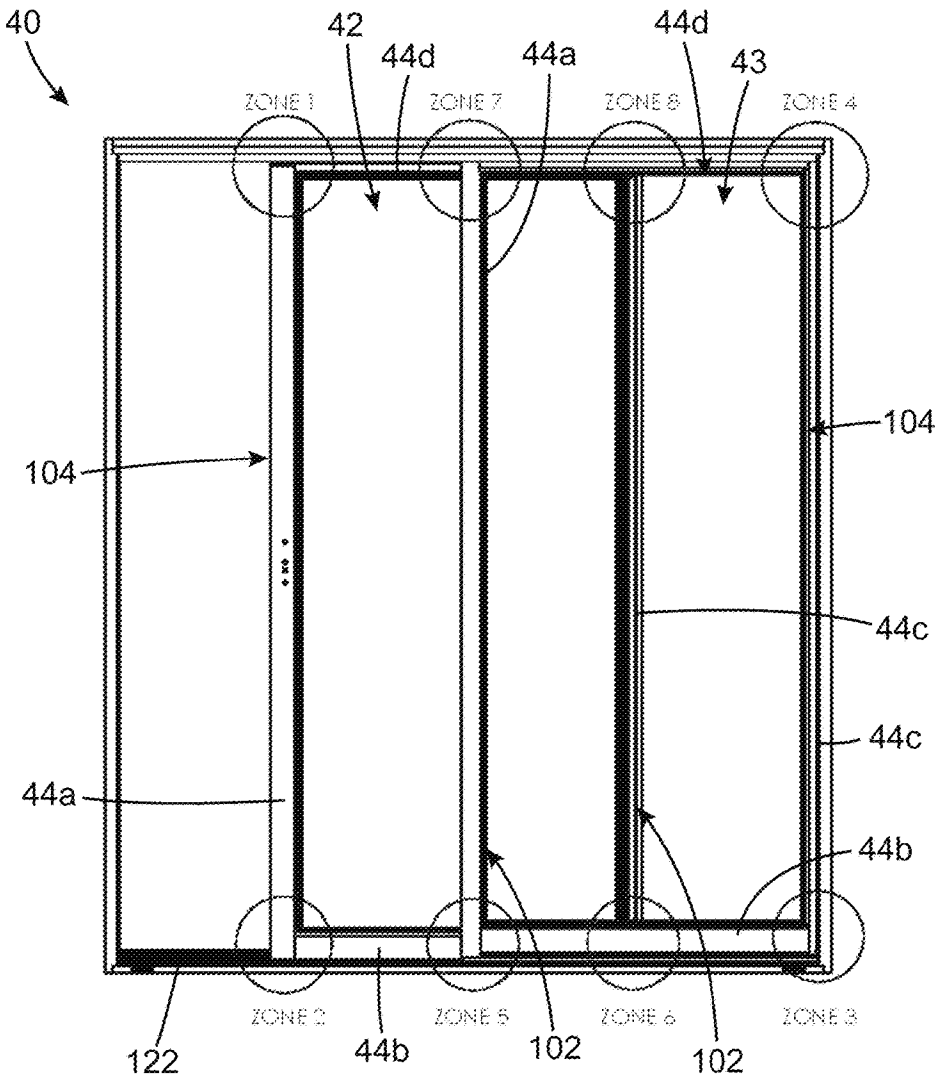
FIG. 1 is a front elevation view of a patio door including two door panels, one of the two door panels being a sliding panel and another one of the two door panels being a fixed panel, according to an embodiment.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

Although the embodiments of the patio door, door panel, tightening connector assembly, door panel connection assembly and corresponding sections and/or parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the patio door and/or door panel, as it will be briefly explained herein and as can be easily inferred herefrom by a person skilled in the art.

Moreover, it will be appreciated that positional descriptions such as "longitudinal", "transversal", "left", "right", "upper", "lower", "external", "internal", "outer", "inner", "oblique", "parallel", "perpendicular" and the like should be taken in the context of the figures only and should not be considered limiting. Moreover, the figures are meant to be illustrative of certain characteristics of the custom helmet and are not necessarily to scale.

Door Panel and Tightening Connector Assembly for a Patio Door

Generally described, a patio door or at least a door panel for a patio door is provided. The patio door or the door panel may be of different kinds, as it will be described in detail below, but is generally understood as being or being part of a sliding glass door that opens or provides access to a balcony, a deck, a patio or the like from a room of a building. A patio door usually includes two door panels wherein one is fixed (i.e. is in a fixed position) and the other mobile so as to slide with respect to the fixed panel. It is understood that a patio door could include more than two door panels or could alternatively include one or more door panels that are movable or slidable along an axis extending along a door frame or a wall. In some embodiments that will be described in more detail, the patio door has two panels, wherein one is an "active panel" (i.e. a sliding panel) and another one is a "stationary panel" (i.e. a fixed panel). As any patio door or door panel for a patio door, the patio door or the door panel which will be described are typically provided in buildings to provide air circulation and light to a room of a building, as well as allowing the access to the room of the building. The patio door and the door panel described herein may include shape, features and configuration similar to the patio door known in the art. Moreover, the patio door, door panel, tightening connector assembly and connector assembly described in the current description can include a thermal break, and so can improve or at least maintain, in some circumstances, the energy efficiency of the patio door.

As will be described in more detail below, there is also provided a tightening connector assembly, a tightening connector with a weatherstrip receiving channel and a door panel connection assembly.

Referring to FIG. 1, a patio door 40 is shown. The patio door 40 includes two door panels 42, 43 (also referred to as "panels"). As illustrated, the panels 42, 43 have a similar structure, but the panel 42 is an active panel, so is slidable (i.e. movable) with respect to the panel 43, which is a fixed panel. As such, the two panels 42, 43 extend into two parallel planes.

In the following, the features and characteristics of the door panels 42, 43, will be described with reference to the door panel 42. It will however be understood that what will be herein described in reference to the door panel 42 also applies to the door panel 43 and vice-versa.

Each one of the door panel 42, 43 has four edges (two transversal edges and two longitudinal edges), each one being defined by a respective elongated frame members 44*a*,44*b*,44*c*,44*d*. In the closed configuration of the patio door 40, the sliding and fixed door panel 42, 43 meet and engage each other along the inner longitudinal edges 102 which define an interlock. Each one of the sliding and fixed door panels 42, 43 also include outer longitudinal edges 104, extending substantially parallel to the inner longitudinal edges 102, but spaced-apart therefrom. In the closed configuration of the patio door 40, the outer longitudinal edges 104 abut against a patio door frame 122 while the inner longitudinal edges 102 are located inwardly, substantially superposed and optionnally engaged together.

The door panel 42 (also referred to as the "panel") includes four elongated door frame members 44*a*,44*b*,44*c*, 44*d*. The four elongated door frame members 44*a-d* are configurable to define a rectangular door panel frame 46. More particularly, each one of the four elongated door frame members 44*a-d* can be connected to two other ones of the four elongated door frame members 44*a-d*. For example, as illustrated, the elongated frame member 44*a* is connected to the frame members 44*b* and 44*d*. As it will be later described, a pair of frame members (example the elongated frame members 44*a* and 44*b*) can be connected to one another in each corner with a tightening connector assembly to define the door panel frame 46.

Each one of the four frame elongated members 44*a-d* can be formed of one piece, or could alternatively be divided into a plurality of sections assembled together to form each one of the four frame elongated members 44*a-d*.

The elongated frame members 44*a-d* can be made of different materials, such as, and without being limitative, wood, polymers (such as and without being limitative vinyl, fiberglass, rigid polyvinyl chloride (PVC)), metals including metal alloys (such as and without being limitative aluminum and aluminium alloys), combinations thereof, or any other material that can be configured to form a rectangular door frame panel 46. In some embodiments, the elongated frame members 44*a-d* are made in extruded rigid plastic material such as polyvinyl chloride (PVC). In other embodiments, the elongated frame members are mostly made of metal and metal alloy. As will be described in more detail below, the tightening connector assemblies and the door panel connection assembly can be suitable with elongated frame members mostly made of metal and metal alloy, and can be provided with a thermal break at least along the corner portions of the door panel frame 46 through the tightening connector assemblies, as will be described in more detail below.

When the four door frame members 44*a-d* are configured to define the rectangular door panel frame 46, the rectangular door panel frame 46 has a longitudinal axis 48 and a transversal axis 50. As illustrated, the panel 42 can slide along the transversal axis 50 inside a door panel receiving cavity defined in the patio door frame 122.

Figure 2B:
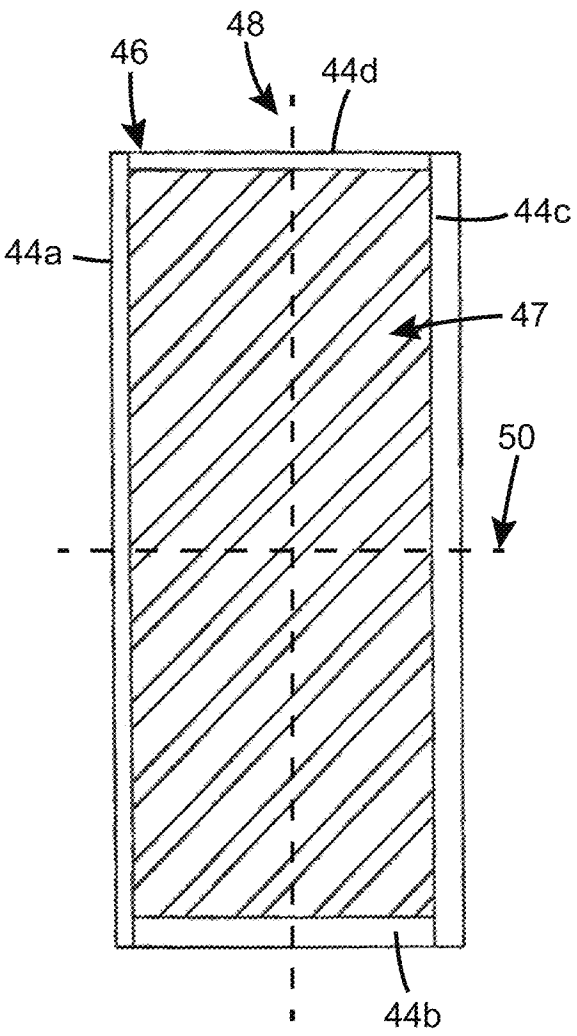
FIGS. 2A-B are front elevation views of a door panel including a door panel frame, according to two possible embodiments, in FIG. 2A, elongated frame members defining the door panel frame have beveled end edges while in FIG. 2B, the elongated frame members have straight end edges.
Figure 2A:
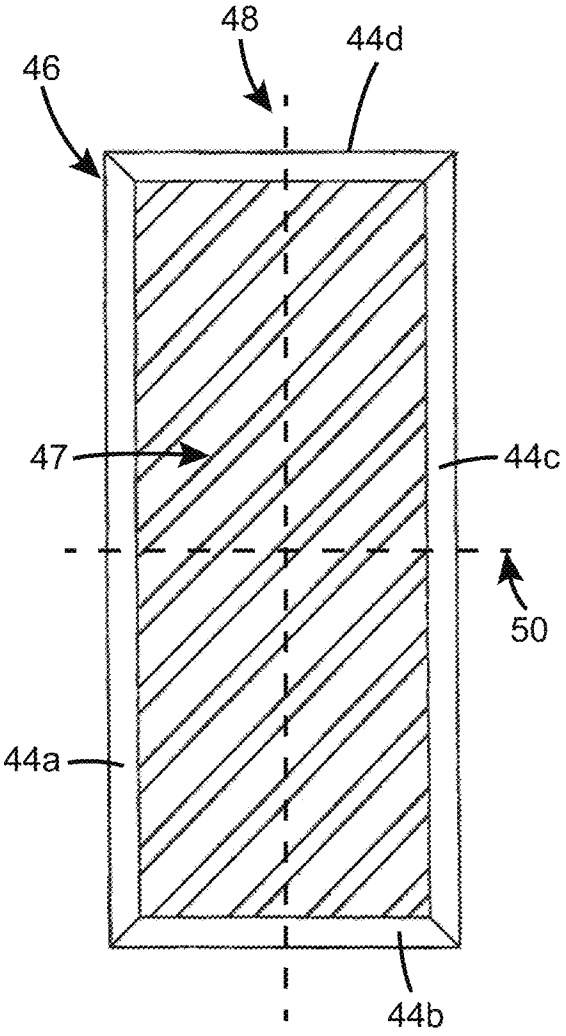

As illustrated in FIGS. 2A-B, the rectangular door panel frame 46 usually includes a glass panel 47 introduced in the area defined by the four elongated frame members 44*a-d*. It will readily be understood that the glass panel could be replaced by a panel made of any other material, and that the area defined by the four elongated frame members 44*a-d* may be divided into sections.

FIGS. 2A-B show two embodiments of rectangular door panel frame 46 which are embodied by different end edges of the elongated frame members 44*a-d* defining the door panel frame 46. In the embodiment shown in FIG. 2A, the elongated frame members 44*a-d* have beveled end edges meeting at about 45 degrees. In the embodiment shown in FIG. 2B, the elongated frame members 44*a-d* have straight end edges wherein the end edges of one of the elongated frame members 44*a-d* abuts against an internal edge of the adjacent one of the elongated frame members 44*a-d*. In the embodiment shown, the transversally-extending elongated frame members 44*b,d* abuts against the internal edge of longitudinally-extending (vertically-extending) elongated frame members 44*a,c*. However, it is appreciated that, in an alternative embodiment (not shown), the longitudinally-extending elongated frame members can have an end edge abutting against the internal edge of the transversally-extending elongated frame members 44*b,d*. The tightening connector assemblies described in further detail below are particularly suitable for the door panel frame 46 having straight end edges as shown in FIG. 2B. However, a person skilled in the art will appreciate that they can also be used in combination with elongated frame members having beveled end edges.

When assembled, the rectangular door panel frame 46 can be received into a door panel receiving cavity, i.e. a hole provided in a wall for allowing to insert a patio door or door panels). In an embodiment, the i.e. a hole provided in a wall for allowing to insert a patio door or door panels) is defined by a patio door frame 122 (illustrated in FIG. 1). In some implementations, rails can be provided on the studs defining the upper and the lower transversal edges of the patio door frame 122, for example upper and/or lower studs, so as to allow the door panel frame 46 to slide along the transversal axis 50.

Figure 3:
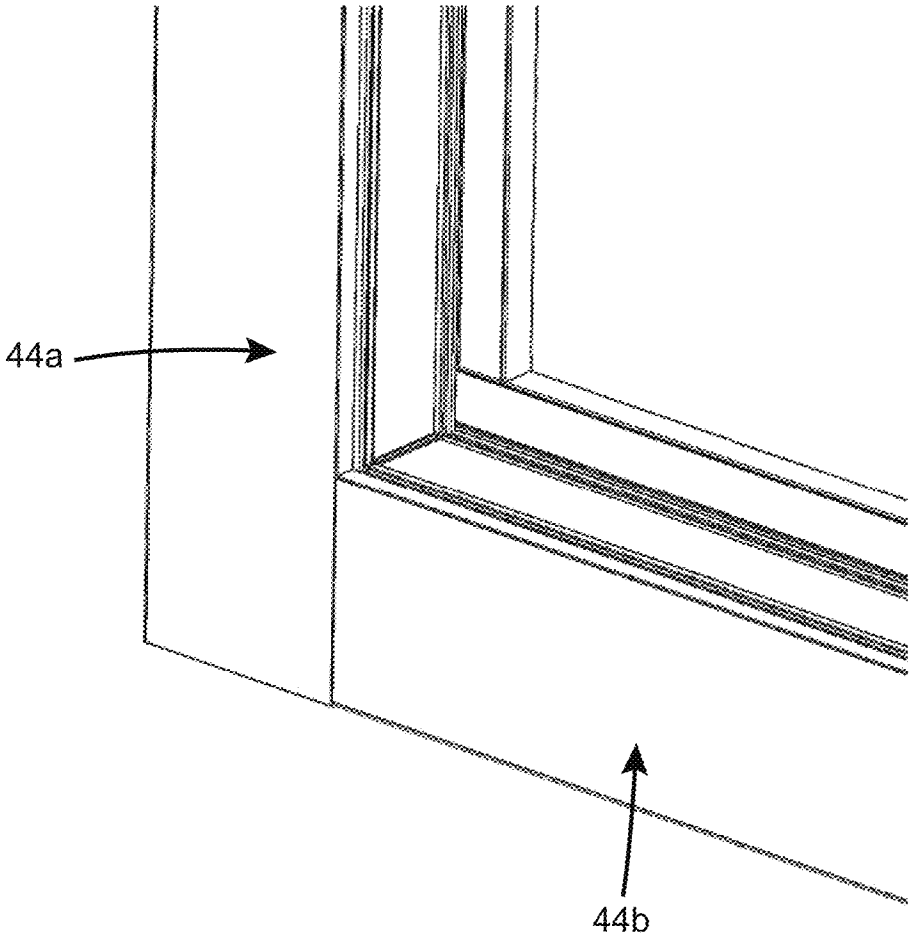
FIG. 3 is a perspective view of one corner of a door panel, according to an embodiment.

As it has been previously introduced, each one of the four elongated frame members 44*a-d* can be connected to two other ones of the four elongated frame members 44*a-d* (e.g. the elongated frame member 44*a* can be connected to the frame members 44*b* and 44*d*). More particularly, when the rectangular door panel frame 46 is assembled, the rectangular door panel frame 46 includes four corners, i.e. two upper corners and two lower corners. The term "corner" is herein understood as a region in which two of the four elongated frame members 44*a-d* meet and can be engaged with and secured to each other. In the illustrated embodiment, each one of the four corners define a right angle (i.e. an angle approximately equal to 90 degrees). An example of a corner defined by the meeting of a first elongated frame member 44*a* with a second elongated frame member 44*b* is illustrated in FIG. 3.

In the embodiment shown, each one of the elongated frame members 44*a-d* has a substantially rectangular cross-section and with two opposite ends ending with a straight angle (straight end edge). Therefore, when juxtaposed, the end edge of one of the elongated frame members 44*a-d* is juxtaposed to an internal edge of the adjacent one of the elongated frame members 44*a-d*. In the embodiment shown, the end edges of the transversally-extending frame members 44*a*, 44*c* abut against a respective one of the internal edge of the longitudinally extending frame members 44*b*, 44*d*.

Figure 7A:
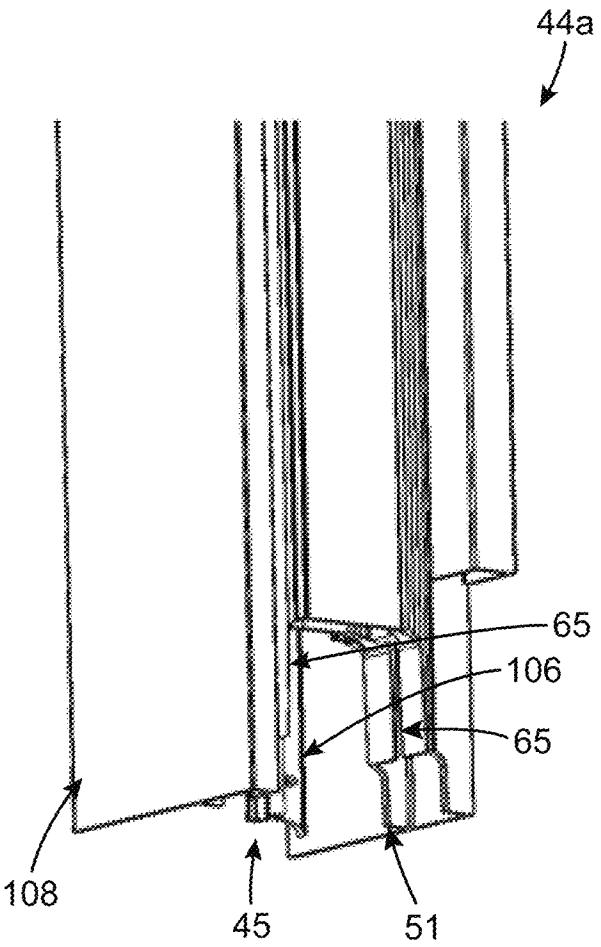
FIGS. 7A-B are respectively external and internal perspective views of a lower end of a first one of the four elongated frame members engageable to define a rectangular door panel frame, according to an embodiment.
Figure 7B:
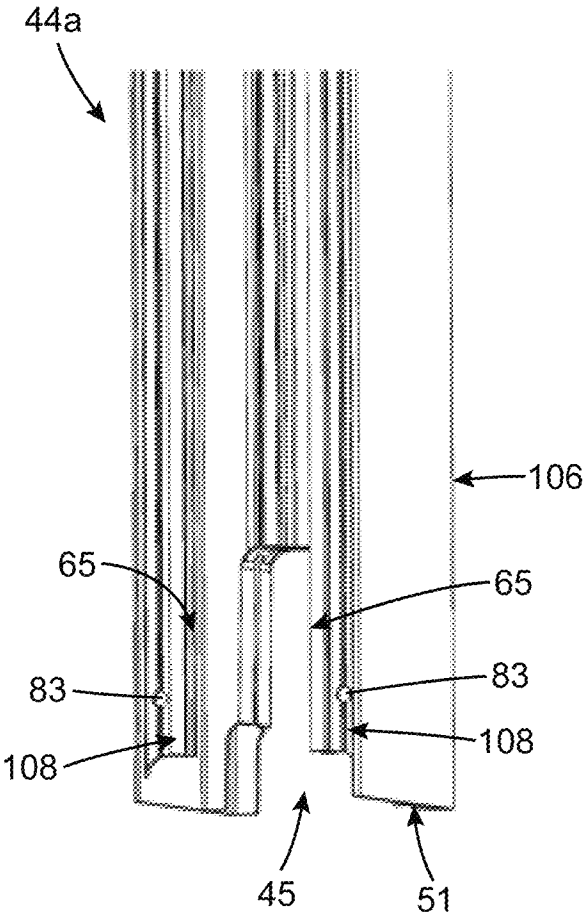

As exemplified in FIGS. 7A-B, the four elongated frame members 44*a-d* are profiles having a connector receiving cavity 45 (i.e. a "cavity") near their end edge (i.e. near an end portion). More particularly, the longitudinally extending frame members (e.g. the elongated frame members 44*a* and 44*c*) can include an connector receiving cavity 45 near their lower and/or upper end(s). The connector receiving cavity 45 includes openings defined in the internal edge 106 and the end edge 51 of the longitudinally extending frame members 44*a,c* (e.g. the elongated frame member 44*a*), which allows the insertion of a section of the tightening connector, as it will be described in greater detail. Similarly, the transversally extending frame members (e.g. the frame members 44*b* and 44*d*) can also include an connector receiving cavity 45 (a "cavity") near their end, and include an opening defined in the end edge 51 of the transversally extending frame members 44*b,d*, so as to admit the insertion of another portion of the tightening connector, as it will be described in greater detail below.

Figure 4:
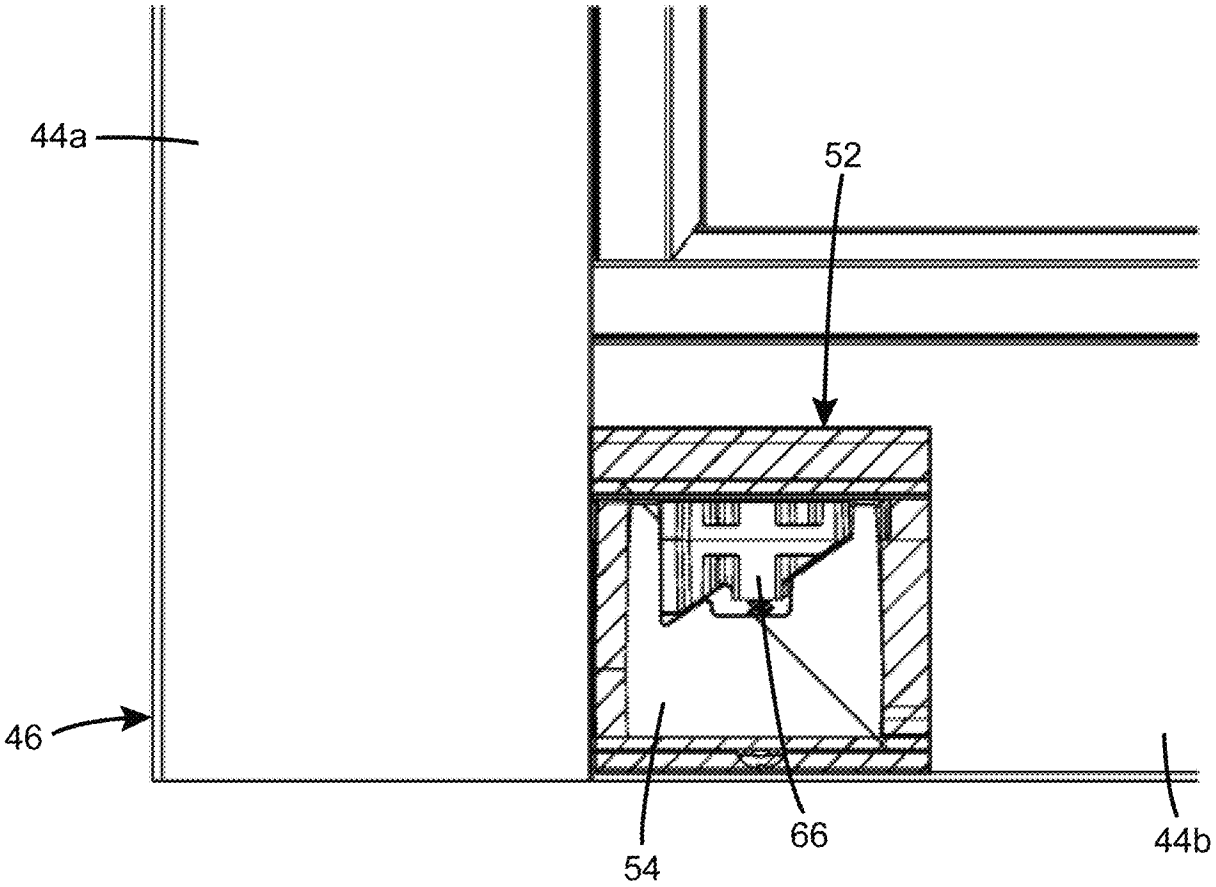
FIG. 4 is a cross-sectional view of a portion of the corner of the door panel illustrated in FIG. 3, illustrating a tightening connector assembly include a connector body, a tightening insert engaged with the connector body and a mechanical fastener, according to an embodiment.

With reference to FIG. 4, the door frame 46 includes at least one tightening connector assembly 52. In some embodiments, the rectangular door panel frame 46 includes four tightening connector assemblies 52, each one the four tightening connector assemblies 52 being provided in a respective corner of the rectangular door panel frame 46 (e.g. the "zones 1, 2, 6 and/or 8" for the active door panel 42 and "zones 3, 4, 5 and/or 7" for the passive door panel 43 as the illustrated in FIG. 1). Both or either the active panel 42 and/or the fixed panel 43 can include four tightening connector assemblies 52.

Now turning to FIGS. 5A-D, an embodiment of the tightening connector assembly 52 will be described. The tightening connector assembly 52 includes a connector body 54. As illustrated, this embodiment of the tightening connector assembly 52 can be mounted in the "zone 2" identified in FIG. 1, which corresponds to a lower left corner of the active door panel 42, i.e. the lower tightening connector of the outer longitudinal edge 104 of the active door panel 42 (see for example FIG. 1).

The connector body 54 includes a first frame segment 56 and a second frame segment 58. The second frame segment 58 extends along a tightening axis 60, which is substantially parallel to the transversal axis 50 of the door panel frame 46 when the four elongated frame members 44*a-d* are assembled. As their name entails, the first frame segment 56 is configured to be inserted into a first one of the four elongated door frame members 44*a-d* and the second frame segment 58 is configured to be inserted into a second one of the four elongated door frame members 44*a-d*, when the door panel frame 46 is assembled. In the embodiment shown, the first frame segment 56 is configured to be inserted into a longitudinally-extending one of the elongated door frame members (e.g. the elongated member 44*a*), while the second frame segment 58 is configured to inserted into a transversally-extending one of the elongated door frame members (e.g. the elongated frame member 44*b*).

The connector body 54 defines an insert receiving cavity 62. The insert receiving cavity 62 is at least partially defined by an insert contact surface 64 of the connector body 54. More particularly, the insert receiving cavity 62 is defined in the second frame segment 58 of the connector body 54. The insert receiving cavity 62 is configured to receive a tightening insert 66, which will abut the insert contact surface 64, as it will be described in more detail.

Figure 5A:
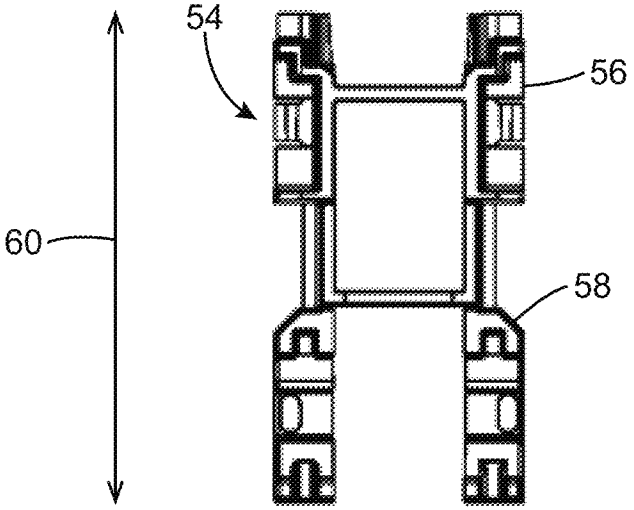
FIGS. 5A-D are respectively a top plan view, a front elevation view, a top perspective view and a side elevation view of a connector body having a first frame segment and a second frame segment, according to an embodiment and suitable for "zone 2" of the sliding panel.
Figure 5B:
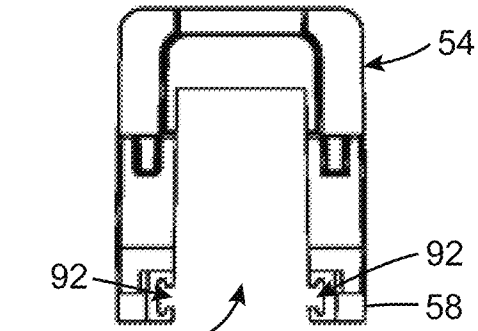
Figure 5C:
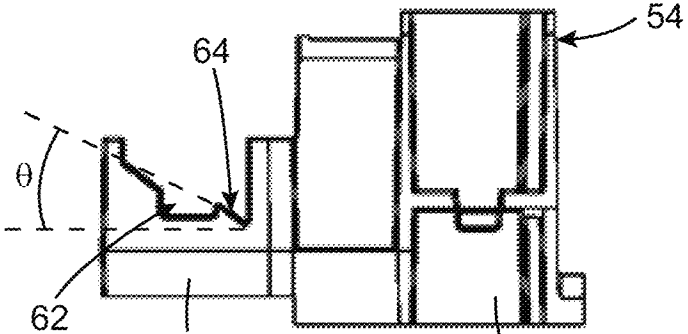
Figure 5D:
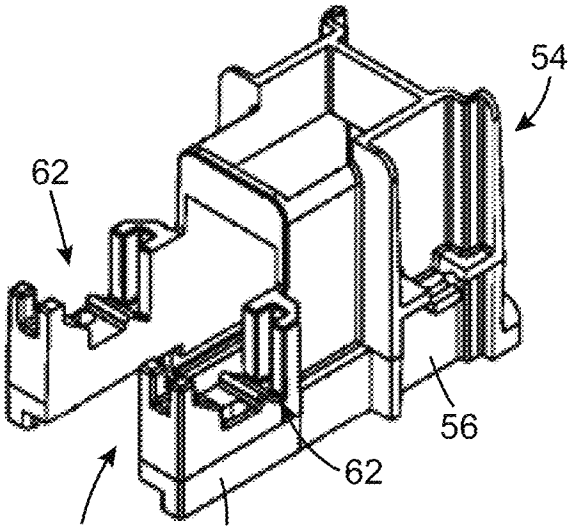

The insert contact surface 64 extends inwardly of the connector body 54. While its general form or shape can differ, the insert contact surface 64 illustrated in FIGS. 5A-D define an oblique angle θ with respect to the tightening axis 60. In the context of the present description, the angle θ is said to be "oblique" because the insert contact surface 64 is neither parallel nor normal to the tightening axis 60. However, it would readily be understood that one or more segment(s) of the insert contact surface 64 could be parallel or normal to the tightening axis 60. For example, and as better seen in FIG. 5C, the profile of the insert contact surface 64, i.e. the general shape of the insert contact surface when viewed from one side or another, can be "irregular". In the illustrated embodiment, some segments of the insert contact surface 64 are parallel to the tightening axis 60, some segments are normal (i.e. perpendicular) to the tightening axis 60, and some segments define an angle (e.g. angles β and β') with the tightening axis 60. As such, the general shape of the profile (i.e. the side view) of the insert contact surface 64 define an irregular slope having an average slope that defines the oblique angle θ with respect to the tightening axis 60. While the embodiment illustrated in FIG. 5C depicts an insert contact surface 64 having a particular succession of perpendicular, oblique and/or parallel segments with respect to the tightening axis 60, it would be readily understood that such a succession can be different, depending on the general shape of the tightening insert 66 to be inserted in the insert receiving cavity 62.

Figure 6A:
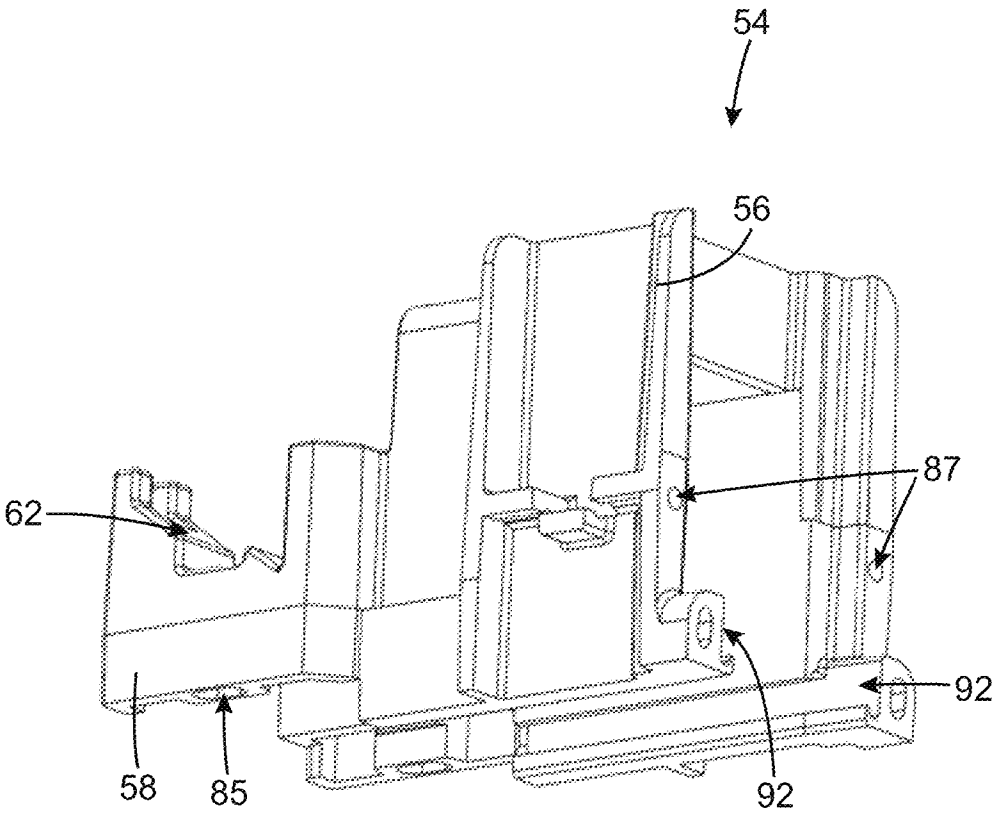
Figure 6B:
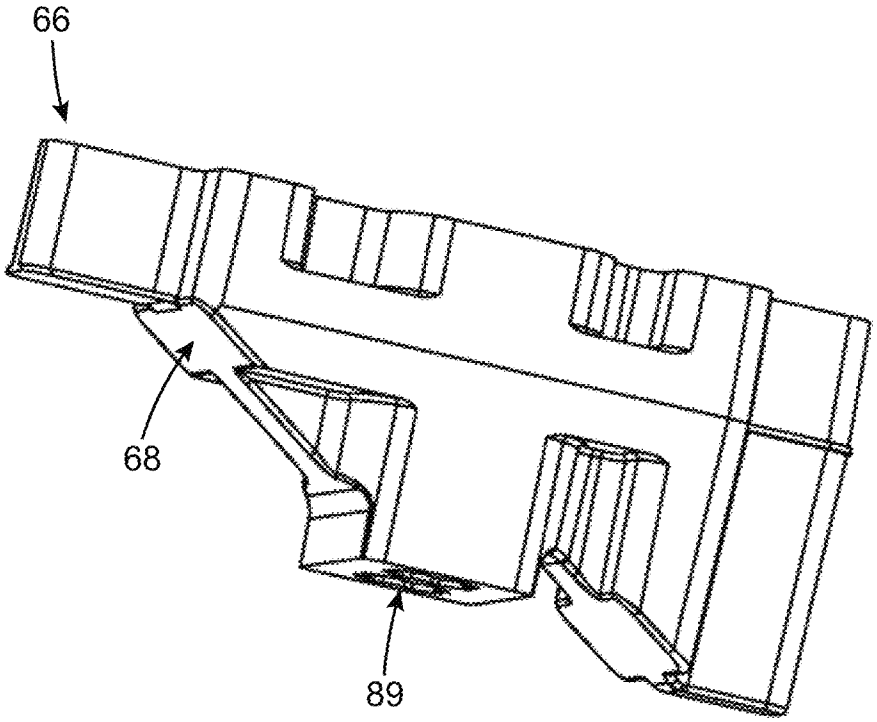
Figure 6C:
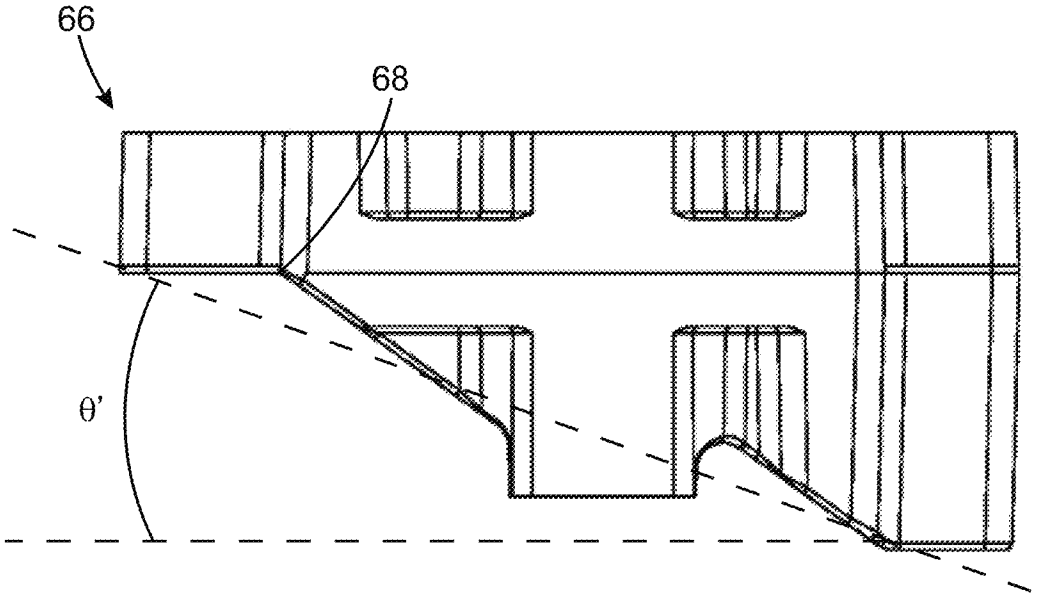

Now turning to FIGS. 6A-C, the connector body 54 also includes a first section 85 of a mechanical fastener channel 87, which extends through out the connector body 54, in the second frame segment 58, and is opened in the insert receiving cavity 62.

The connector body 54 is engageable with two of the elongated door frame members 44*a-d* that are abutted against one another to define at least a portion of the door frame 46. For example, sections of the connector body 54 can be engaged with the elongated frame members 44*a* and 44*b*. In such circumstances, the elongated frame members 44*a* and 44*b* abut each other close to adjacent end edges 51. More particularly, the elongated frame members 44*a* and 44*b* are engaged in an orthogonal configuration (i.e. substantially normal or perpendicular). In this configuration, the first frame segment 56 is engaged with a first one of the two elongated frame members 44*a,b* (e.g. the elongated frame member 44*a*) and the second frame segment 58 is engaged with a second one of the two elongated frame members 44*a,b* (e.g. the elongated frame member 44*a*). In this orthogonal configuration, the first one 44*a* of the two elongated frame members 44*a,b* extends substantially perpendicular (i.e. normal to) the second one 44*b* of the two elongated frame members 44*a,b*.

Figure 10:
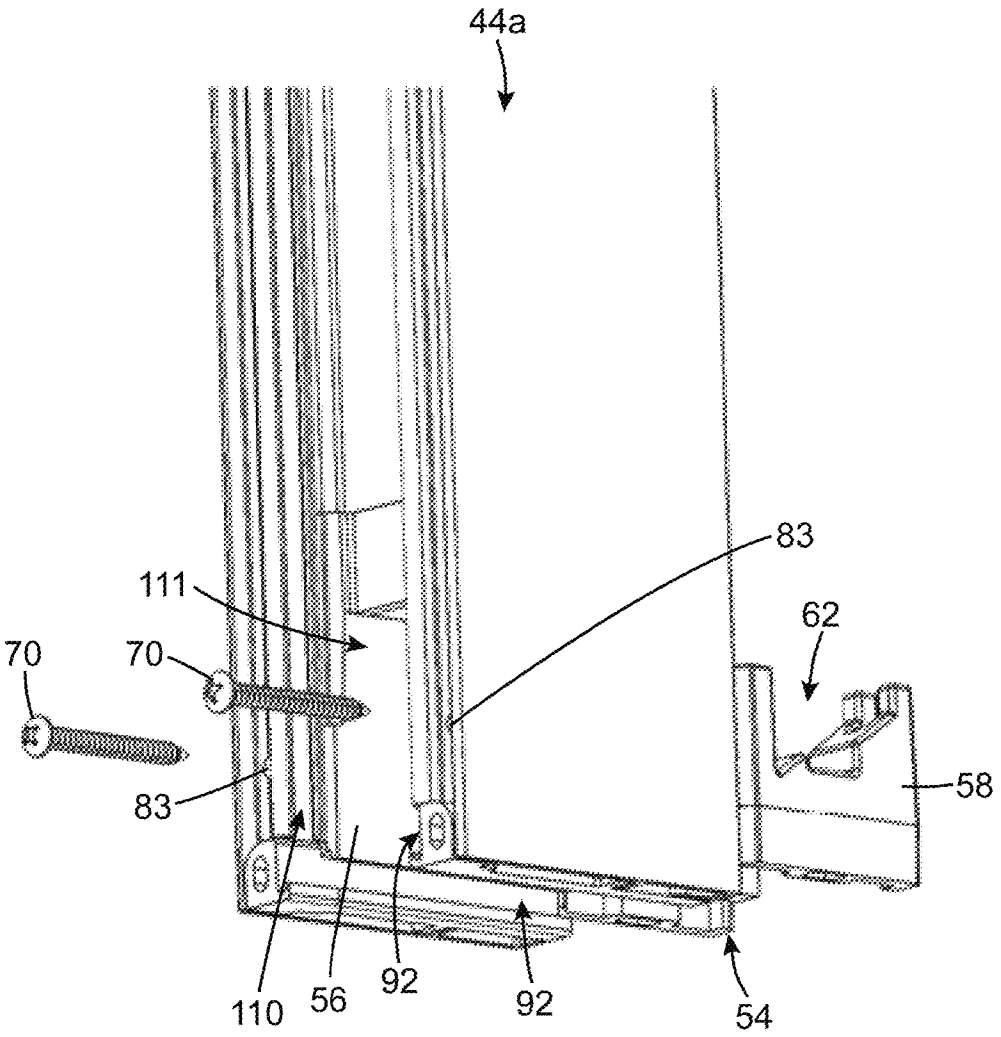
FIG. 10 is an external perspective view of mechanical fasteners insertable into the first one of the elongated door frame members of FIGS. 7A-B, according to an embodiment.
Figure 11:
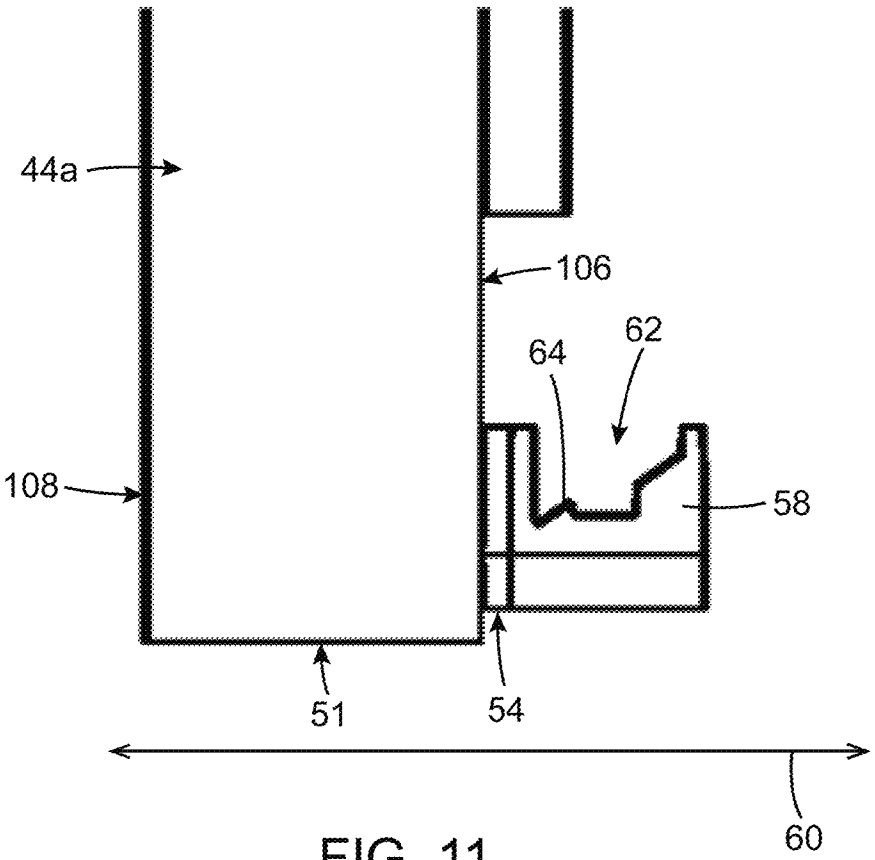
FIG. 11 is a side elevation view of the connector body engaged with the first one of the elongated door frame members in the embodiment illustrated in FIGS. 9A-B and 10.

In some embodiments, the first frame segment 56 can be slidably engageable with (or insertable in) the first elongated frame member 44*a*. For example, the first frame segment 56 can be inserted in the connector receiving cavity 45 of the first elongated frame member 44*a* (through the opening defined in the end edge of the longitudinally-extending frame member), so as the first frame segment 56 is at least partially embedded in the sidewalls forming the first elongated frame member 44*a* and the second frame segment 58 protrudes outwardly thereof from the opening defined in the internal edge of the frame member 44*a*. In such embodiments, the first frame segment 56 can comprise rails or elongated guides so as to be engaged with corresponding and complementary rails or elongated guides 65 of the first elongated frame members 44*a* (extending along the longitudinal axis) in a predetermined position. In some embodiments, the first frame segment 56 can be engaged or fixed to the first elongated frame members 44 with mechanicals fasteners 70 as shown in FIG. 10, for example and without being limitative: nails, screws, clips, snaps, glue, combinations thereof, or the like.

As illustrated, the first frame segment 56 of the connector body 54 includes elongated rails. The elongated rails extend longitudinally along outer wall surfaces of the sidewalls of the first frame segment 56 of the connector body 54. The first one 44*a* of the two elongated door frame members 44*a,b* is engageable with the first frame segment 76 and comprises at elongated guide(s) 65. The elongated guide(s) 65 are complementary to the elongated rail(s) and slidably engageable therewith. The elongated guides 65 are defined in inner wall surfaces of the sidewalls of the elongated door frame member 44*a* and extends longitudinally therein. They are accessible through a central channel 111 extending longitudinally inside the profile of the elongated door frame members 44*a*, in the section corresponding to the connector receiving cavity 45.

The connector body 54 can be made of different materials, such as, and without being limitative, polymers (such as and without being limitative vinyl, fiberglass, rigid polyvinyl chloride (PVC)), metals including metal alloys (such as and without being limitative aluminum and aluminium alloys), combinations thereof, or similar materials. In some embodiments, the connector body 54 is made in extruded rigid plastic material, such as and without being limitative polyvinyl chloride (PVC).

When made of a relative low thermal conductivity material, such as polymers, the connector bodies are thermal insulators provided inside the door panel frame 46, defining a thermal barrier or a thermal break inside the elongated frame members.

Referring to FIGS. 6A-C, the tightening connector assembly 52 also includes a tightening insert 66. As mentioned above, the tightening insert 66 is engageable in the insert receiving cavity 62 of the connector body 54. In some embodiments, the insert receiving cavity 62 is positioned in the second frame segment 58, and so is the tightening insert 66 when engaged with the insert receiving cavity 62. In some implementations, the second frame segment 58 is the frame segment having its end edge abutting the internal edge of the adjacent frame segment. In some implementations, the second frame segment 58 is the transversally-extending frame segment.

As illustrated, the tightening insert 66 has a connector contact surface 68, which is configured to contact the insert contact surface 64, when engaged in the insert receiving cavity 62.

The tightening insert 66, and more particularly the connector contact surface 68, has a shape that is substantially complementary to the shape of the insert receiving cavity 62, i.e. when the tightening insert 66 is inserted into the insert receiving cavity 62, the tightening insert 66 substantially or completely fill the space defined by the insert receiving cavity 62.

More particularly, and as better illustrated in FIGS. 6B-C, the connector contact surface 68 is oblique with respect to the tightening axis 60 when engaged (i.e. inserted) into the insert receiving cavity 62. That is, the connector contact surface 68 is usually not parallel and not normal (i.e. perpendicular) to the tightening axis 60, i.e. the connector surface 68 defines an oblique angle θ' with respect to the tightening axis 60. In the illustrated embodiment, the connector contact surface 68 has an irregular profile, similar but substantially complementary to the irregular profile of the insert contact surface 64 of the connector body 54.

As the insert contact surface 64, one or more segment(s) of the connector contact surface can be parallel or normal to the tightening axis 60. For example, and as better seen in FIG. 6C, the profile of the connector contact surface 68, i.e. the general shape of the connector contact surface 68 when viewed from one side or another, can be "irregular". In the illustrated embodiment, some segments of the connector contact surface 68 are parallel to the tightening axis 60, some segments are normal (i.e. perpendicular) to the tightening axis 60, and some segments define an angle (e.g. angles α and α') with the tightening axis 60. As such, the general shape of the profile (i.e. the side view) of the connector contact surface 68 defines an irregular slope having an average slope that is oblique with respect to the tightening axis 60. While the embodiment illustrated in FIG. 6C depicts an connector contact surface 68 having a particular succession of perpendicular, oblique and/or parallel segments with respect to the tightening axis 60, it would be readily understood that such a succession can be different, depending on global shape of the insert receiving cavity 62.

Now referring to FIGS. 5-6, when the tightening insert 66 is engaged in the insert receiving cavity 62 of the connector body 54, the insert contact surface 64 conforms to (i.e. substantially follows) the connector contact surface 68. In this scenario, some of the corresponding segments of each one of the insert contact surface 64 and the connector contact surface 68 are complementary. For example, while the segments parallel or normal to the tightening axis abut to each other, the segments of the connector contact surface 68 defining an angle with the tightening axis 60 (e.g. the segments defining the angles $\alpha$ and $\alpha'$) are complementary with the segments of the insert contact surface 64 defining an angle with the tightening axis 60 (e.g. the segments defining the angles $\beta$ and $\beta'$). The angles $\alpha$, $\alpha'$, $\beta$ and $\beta'$ can range from 0 to 180 degrees, and so can be acute or obtuse, but are generally chosen such that the pairs of angles $\alpha$ and $\beta$ and $\alpha'$ and $\beta'$ are respectively complementary, and so as the general profile of the insert contact surface 64 and the general profile of the connector contact surface 68 define an oblique angle with respect to the tightening axis 60.

The tightening insert 66 also includes a second section 89 of the mechanical fastener channel 67. The second section 89 of the mechanical fastener channel 87 is aligned with the first section 85 extending through the connector body 54 when the tightening insert 66 is inserted into the insert receiving cavity 62 of the connector body 54. In this context, the first and second sections 85, 89 of the mechanical fastener channel 87 are aligned so as mechanical fasteners 70 can be inserted into the first section 85 of the mechanical fastener channel 87 and extend through the first and second sections 85, 89 (see for example FIG. 15). As such, the first and second sections 85,89 are extending normal to the tightening axis 60.

The shape, geometrical configuration and dimensions of the first and second sections 85, 89 of the mechanical fastener channel 87 are selected according to the mechanical fasteners 70 to be used to secure a first one elongated frame member to a second one elongated frame member (e.g. the longitudinally-extending elongated frame member 44*a* with the transversally-extending elongated frame member 44*b*).

In some embodiments, the tightening insert 66 is a monolithic piece that can be made of for example, and without being limitative, polymers (such as and without being limitative vinyl, fiberglass, rigid polyvinyl chloride (PVC)), metals including metal alloys (such as and without being limitative aluminum and aluminium alloys), combinations thereof, or similar materials. In one embodiment, the tightening insert 66 is made in extruded rigid plastic material, such as and without being limitative rigid polyvinyl chloride (PVC). In other embodiments, the tightening insert 66 is made from a metal allow such as, and without being limitative zinc alloy (e.g. a base metal of zinc with alloying elmenets of aluminium and magnesium, such as "Zamak"). In alternative embodiments, the tightening insert 66 could also be divided into sections, which could be assembled to form the tightening insert 66.

Figure 15:
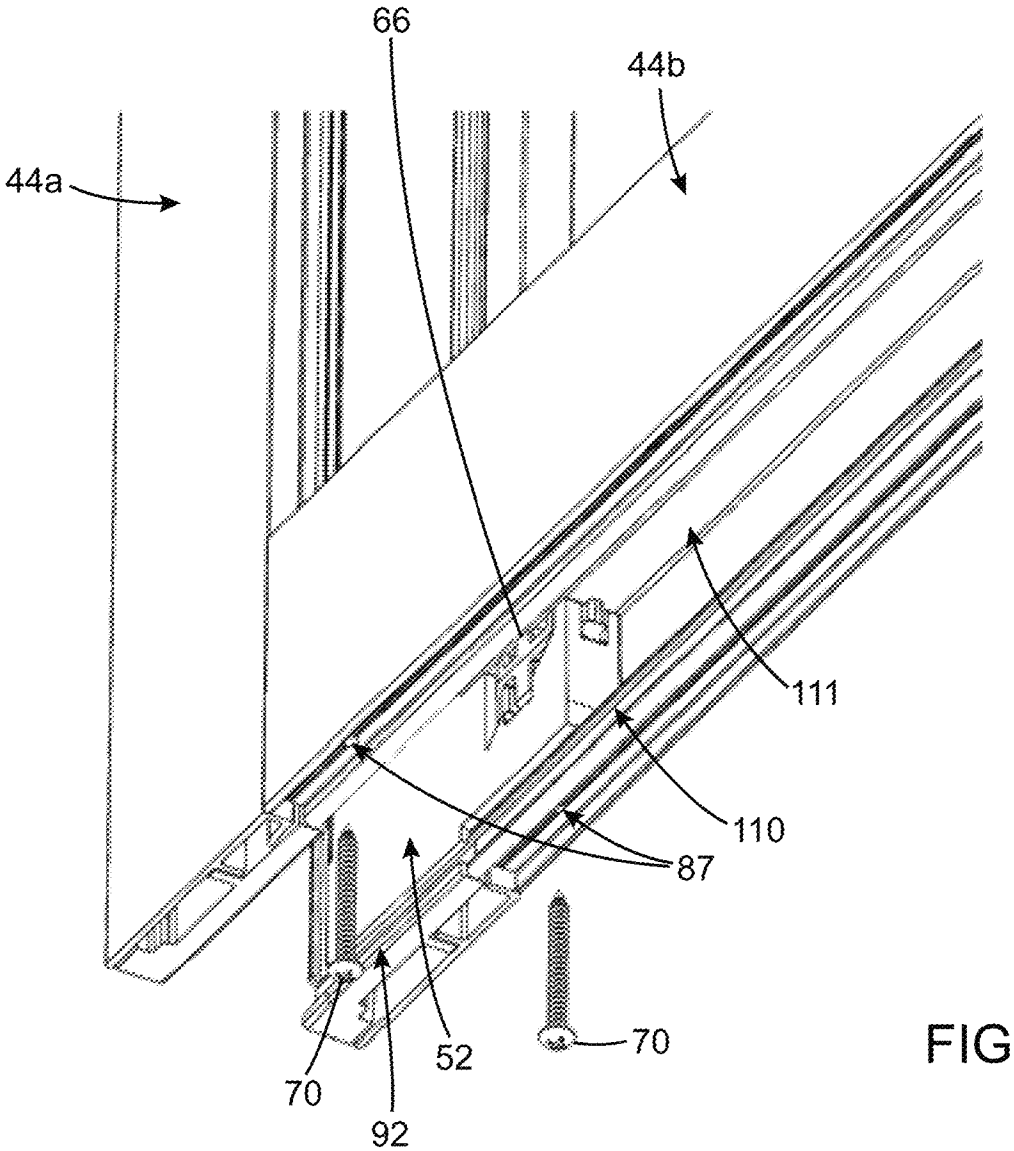
FIG. 15 is a bottom perspective view of mechanical fasteners insertable into the second one of the two elongated door frame members, according to an embodiment.

When the tightening insert 66 is engaged into the insert receiving cavity 62, the second frame segment 58 can be engaged with the second one of the two elongated door frame members 44*b,d* (e.g. the frame member 44*b*). For example, the second frame segment 58 can be slidably engaged with frame member 44*b*. The second frame segment 58 can be inserted in the connector receiving cavity 45 of the second elongated frame member 44*b* (through the opening defined in the end edge 51 of the transversally-extending frame member), so as the second frame segment 58 is at least partially embedded in the sidewalls forming the second elongated frame member 44*b*. In some implementations, the second frame segment 58 can be engaged or fixed to the second one of the two elongated frame members 44*b,d* (e.g. the frame member 44*b*) with mechanicals fasteners 70, as shown in FIG. 15, for example and without being limitative: nails, screws, clips, snaps, glue, combinations thereof, or the like.

In an embodiment, the tightening connector assembly 52 also includes at least one mechanical fastener 70. The mechanical fastener(s) 70 is(are) insertable into the second one of the two elongated door frame members 44*a-d* (e.g. the elongated door frame member 44*b*), the connector body 54 and the tightening insert 66 to pull the second one of the two elongated door frame members 44*a-d* (e.g. the elongated door frame member 44*b*) against the first one of the two elongated door frame members 44*a-b* (e.g. the elongated door frame member 44*a*) and along the tightening axis 60 when being secured together, as will be described in more detail below.

Now turning to FIGS. 7 to 16, a process for assembling a door panel for a door patio will be described. The process for assembling the door panel frame 46 will be described with reference to one corner of the rectangular door panel frame 46, and so this process could be repeated one or multiple times (according to the number or corners, e.g. four times).

In a first step, illustrated in FIGS. 7A-B, the first elongated frame member 44*a* is provided. As illustrated, the first elongated frame member 44*a* has a connector receiving cavity 45, which has already been described.

In a subsequent step, illustrated in FIGS. 8A-B and FIGS. 9A-B, the connector body 54 of the tightening connector assembly 52 is engaged with the first elongated member 44*a*, and in some embodiments. As illustrated, the first frame segment 56 of the connector body 54 is inserted into the connector receiving cavity 45 of the first elongated frame member 44*a*, and in some embodiments, inserted into the opening defined in the end edge 51 of the longitudinally extending frame member 44*a* and has a segment, i.e. the second frame segment 58 protruding outwardly through the opening defined in the internal edge 106 of the longitudinally extending frame member 44*a*.

In another step, illustrated in FIG. 10, mechanical fasteners 70 are inserted into the first elongated frame member 44*a* and the first frame segment 56 of the connector body 54 of the tightening connector assembly 52, so as to secure a portion of the tightening connector assembly 52 to the first elongated frame member 44*a*. In the illustrated embodiment of FIGS. 10-11, the mechanical fasteners 70 are two screws inserted into two corresponding mechanical fastener channels 83 provided or drilled into an external edge 108 of the first elongated frame member 44*a* and through the first frame segment 56 of the connector body 54. For example, the mechanical fastener channels 83 may be accessible from an external edge 108 of the first elongated frame member 44*a*. The mechanical fasteners 70 are, in this embodiment, extending along the tightening axis 60, i.e. in a direction substantially parallel to the transversal axis 50 of the rectangular door frame 46 (see for example FIG. 2). It will be readily understood that the mechanical fasteners 70 could be nails, clips, snap, or any other fasteners already known by one skilled in the art that allow securing the first elongated frame member 44*a* with the first frame segment 56 of the connector body 54 of the tightening connector assembly 52.

When the first frame segment 56 is inserted into the first elongated frame member 44*a*, the second frame segment 58 protrudes outwardly from the opening defined in the internal edge 106 of the first elongated frame member 44*a*. It is to be noted that, in the illustrated embodiment, the second frame segment 58 is provided with two insert receiving cavities 62, one defined in each sidewall.

Figure 12:
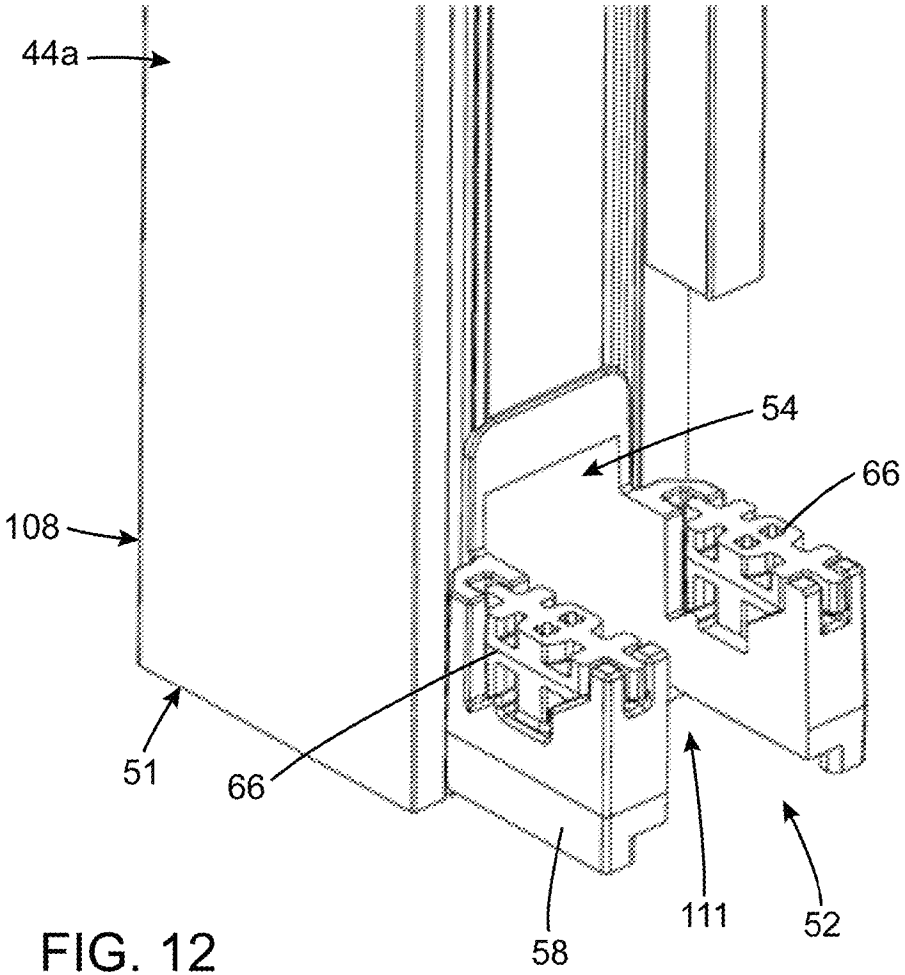
FIG. 12 is an internal perspective view of tightening inserts engaged with corresponding insert receiving cavities of the connector body shown in FIG. 6A, according to an embodiment.
Figure 13B:
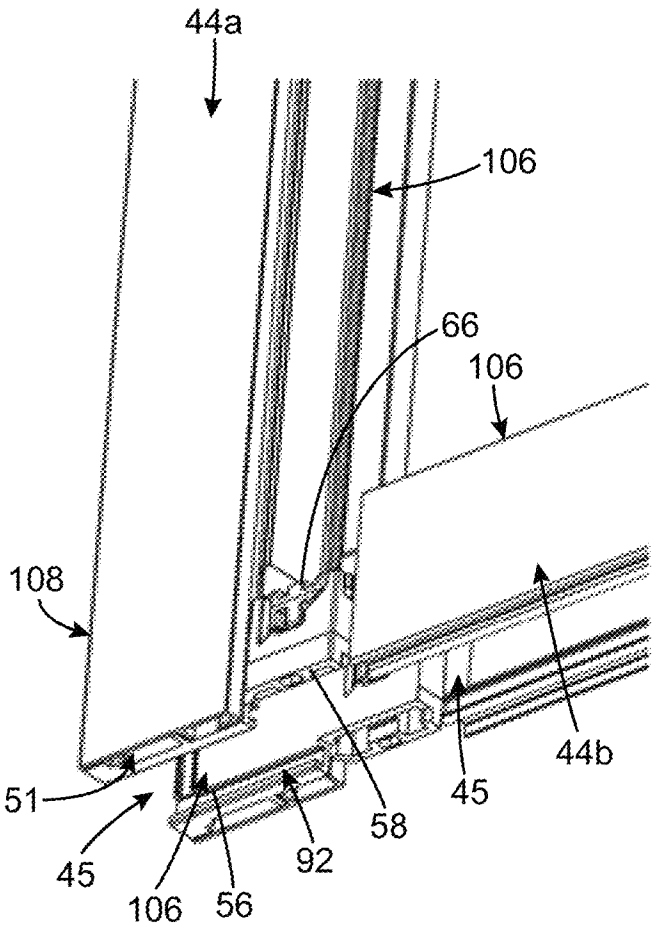
FIGS. 13A-B are respectively a top internal perspective view and a bottom external perspective view, respectively, of a second one of the two elongated door frame members being engaged with a second frame segment of the connector body of FIG. 6A, according to an embodiment.
Figure 13A:
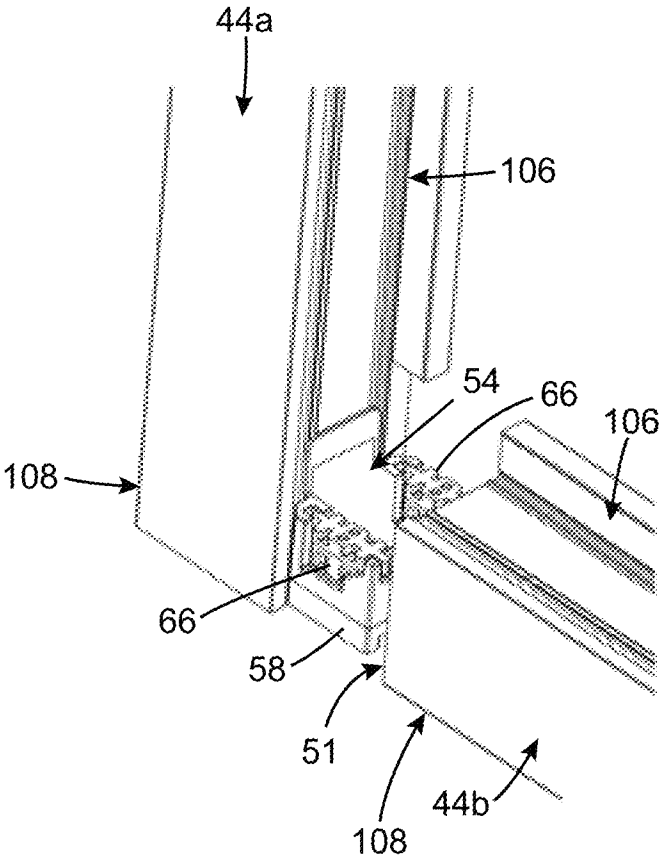
Figure 14B:
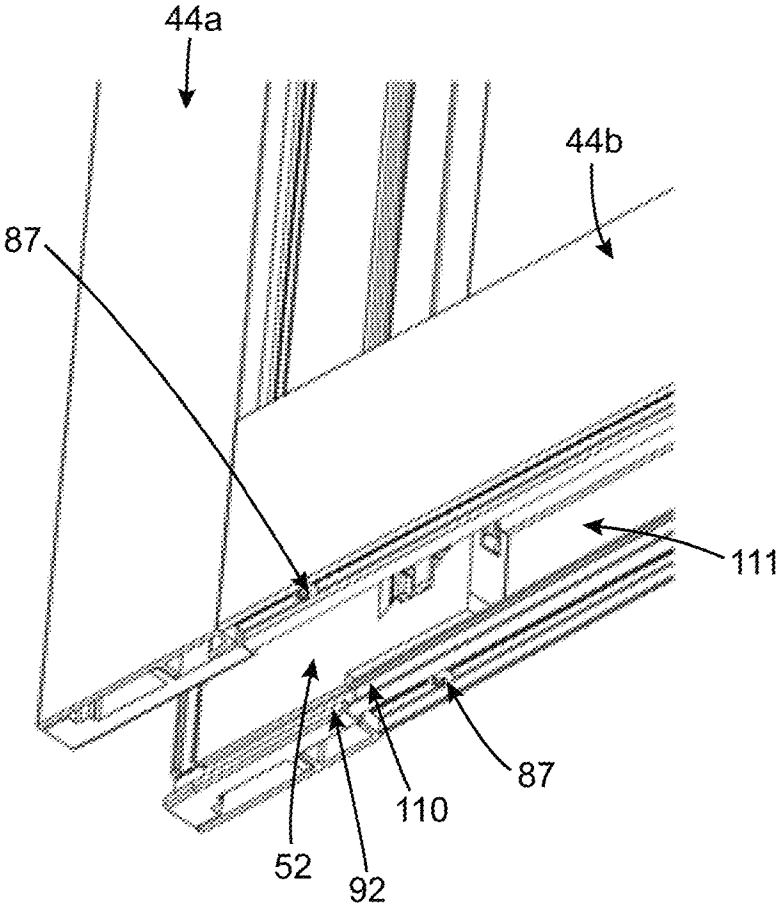
FIGS. 14A-B are respectively a top internal perspective view and a bottom internal perspective view of the first and second elongated frame members engaged together through the connector body of FIG. 6A, when the second one of the two elongated door frame members is engaged with the second frame segment of the connector body as shown in FIGS. 13A-B.
Figure 14A:
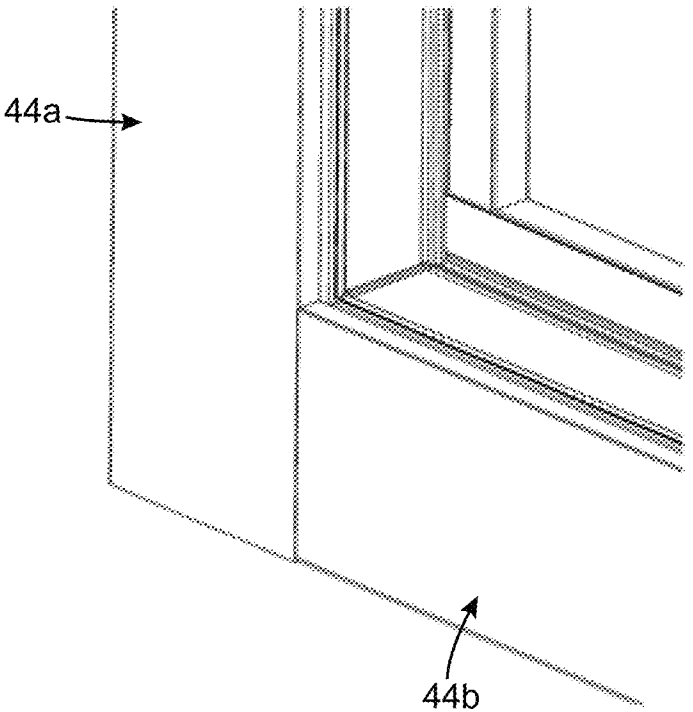

In another step, illustrated in FIG. 12, two tightening inserts 66 are inserted into respective one of the two insert receiving cavities 62 defined in two spaced-apart sidewalls of the second frame segment 58, which is followed by a step of engaging the second frame segment 58 of the connector body 54 of the tightening connector assembly 52 with the second elongated frame member 44*b*, as illustrated in FIGS. 13-14. In the illustrated embodiment, the "engaging step" is carried out by inserting the second frame segment 58 into the connector receiving cavity 45 defined near the edge of the second elongated frame member 44*b* (through the opening defined in the end edge 51). After this step, the first elongated frame member 44*a* abuts the second elongated frame member 44*b*, so as to achieve the orthogonal configuration which has been previously described. Each one of the two insert receiving cavities 62 and the two tightening inserts 66 are put in contact with a respective one of two opposite sidewalls forming the second elongated frame member 44*b* when inserted therethrough.

Figure 16:
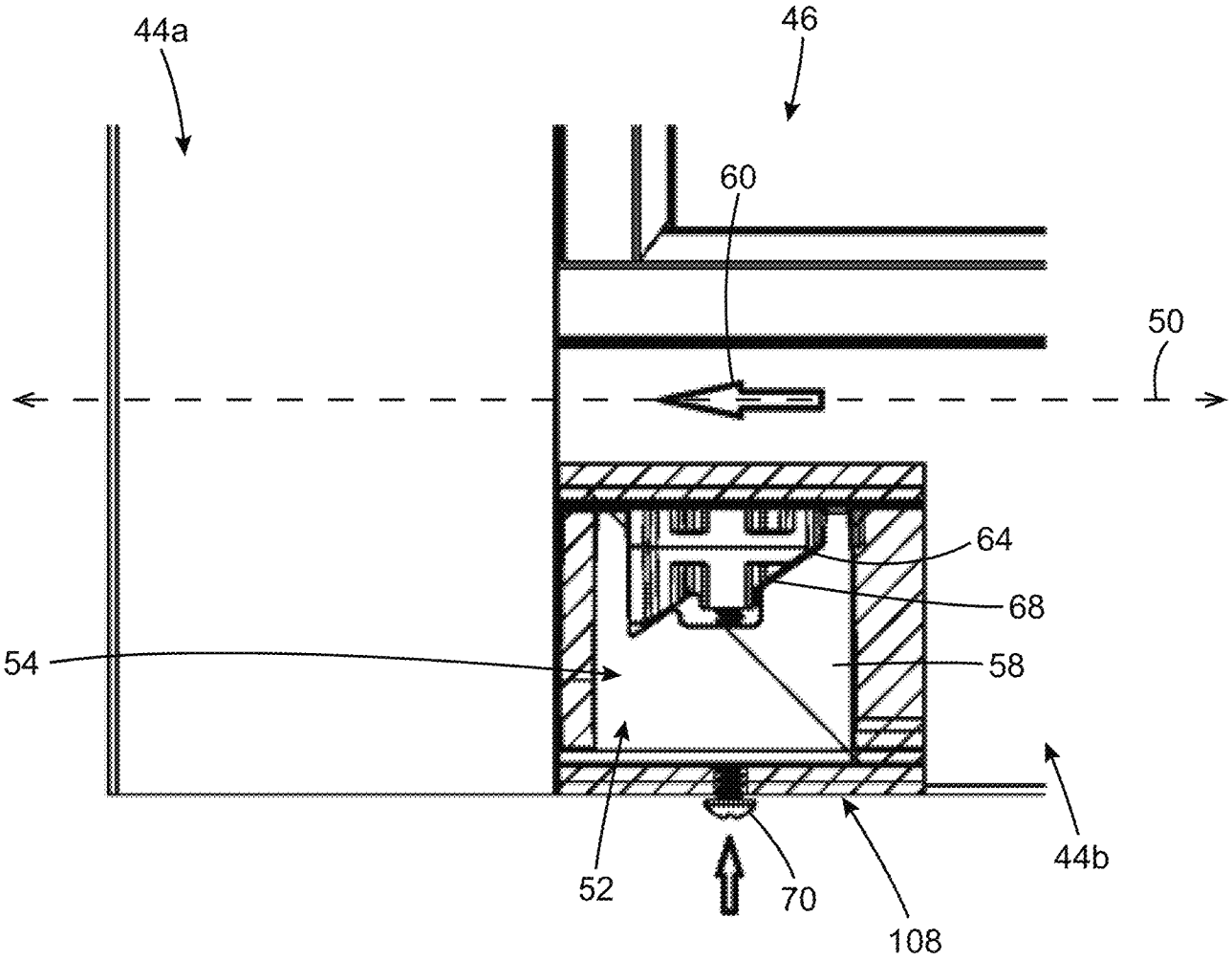
FIG. 16 is a cross-sectional view of the first and second elongated frame members engaged together through the connector body of FIG. 6A as shown in FIGS. 14A-B and 15, when the mechanical fasteners are inserted into the second one of the two elongated door frame members.
Figure 17A:
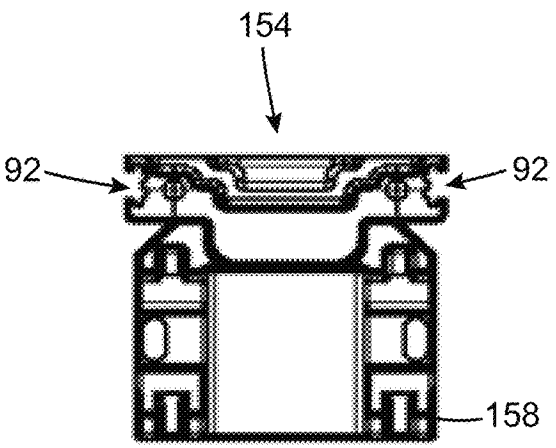
FIGS. 17A-D are respectively a top plan view, a top perspective view, a front elevation view and a side elevation view of a tightening connector, according to another embodiment and suitable for "zone 1" of the sliding panel.
Figure 17B:
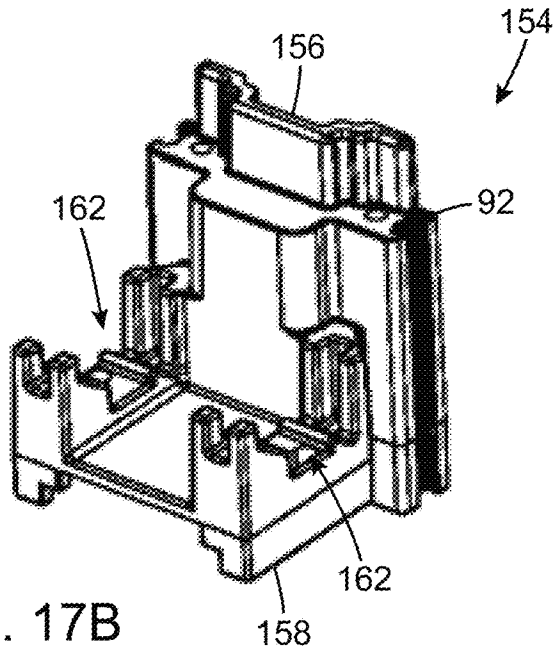
Figure 17C:
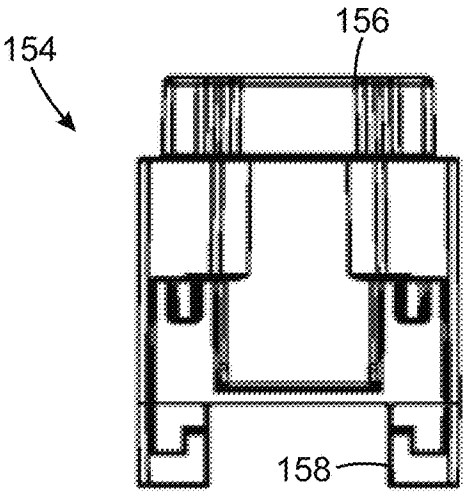
Figure 17D:
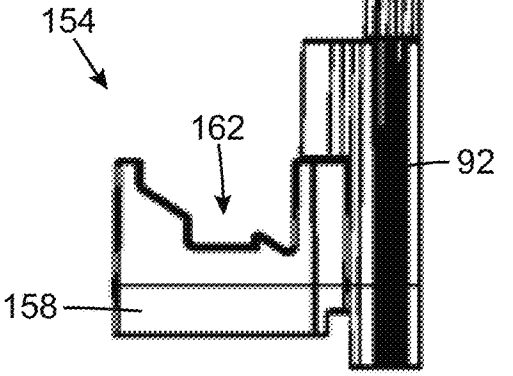
Figure 18B:
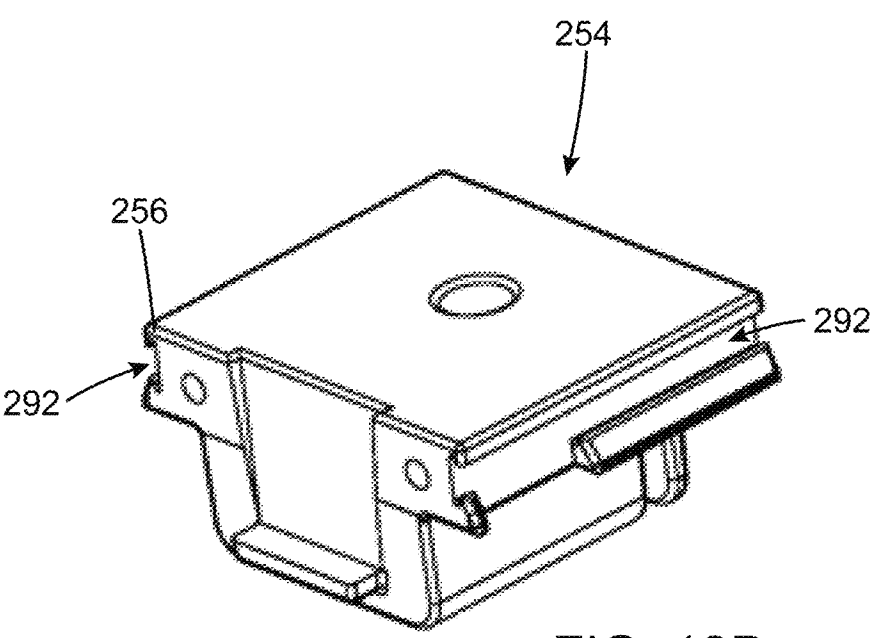
FIGS. 18A-D are respectively a top plan view, a top perspective view, a front elevation view and a side elevation view of a tightening connector, according to still another embodiment and suitable for "zone 8" of the sliding panel.
Figure 18A:
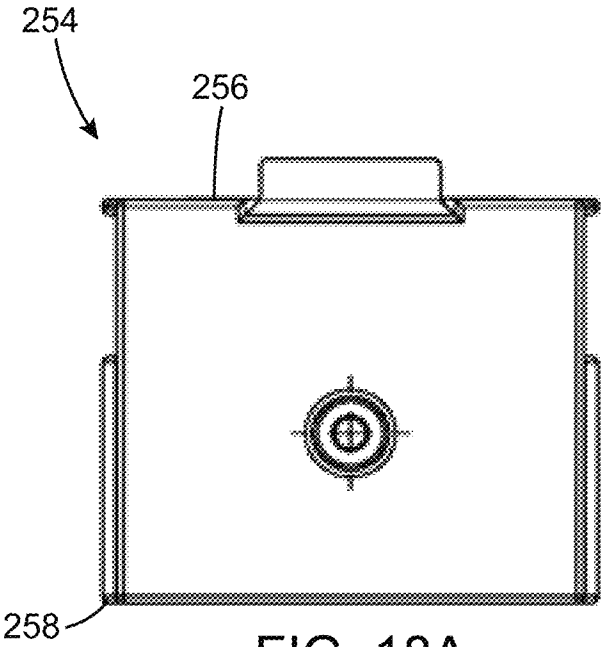
Figure 18D:
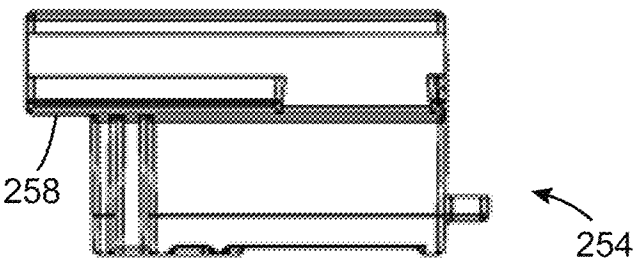
Figure 18C:
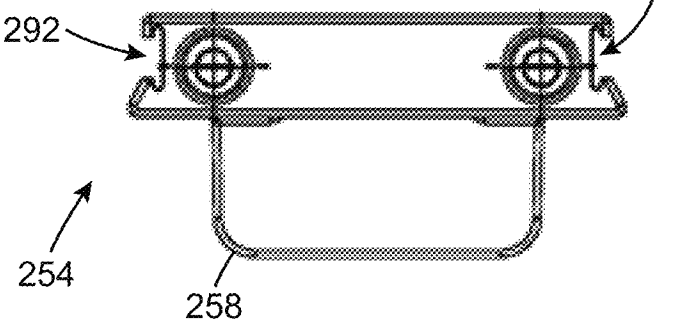
Figure 19B:
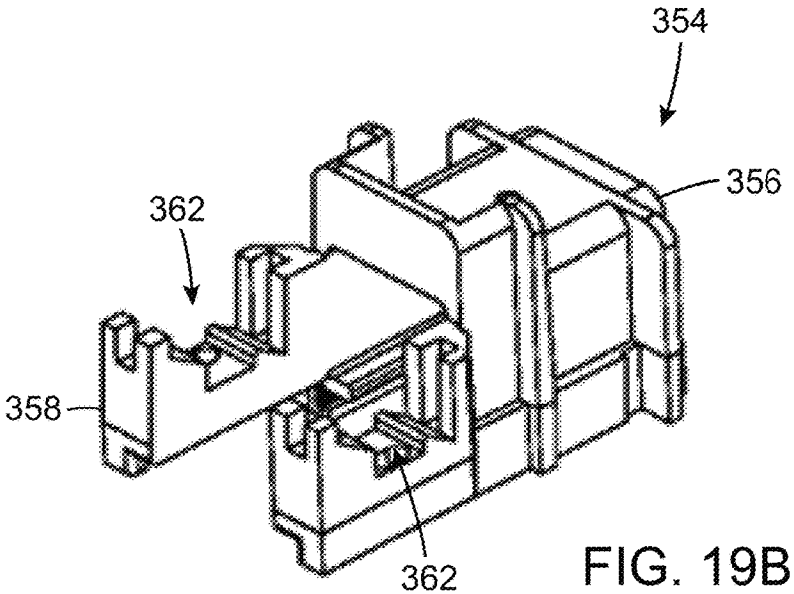
FIGS. 19A-D are respectively a top plan view, a top perspective view, a front elevation view and a side elevation view of a tightening connector, according to another embodiment and suitable for "zone 6" of the sliding panel.
Figure 19D:
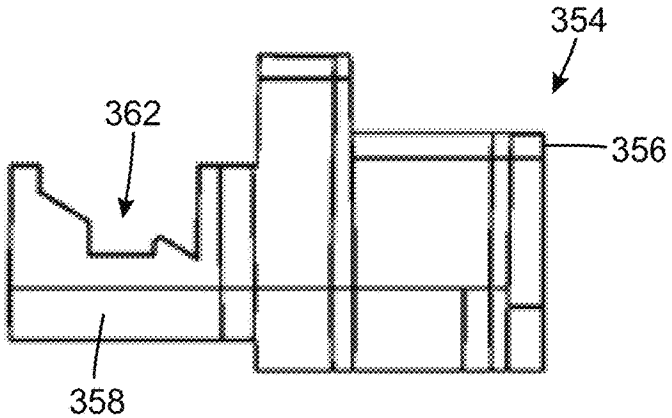
Figure 19A:
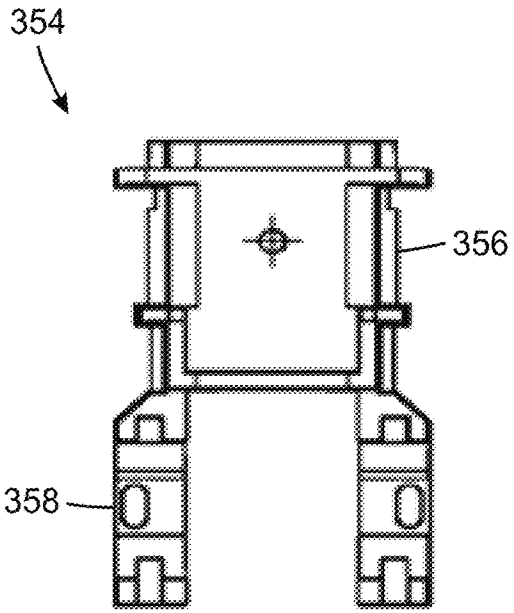
Figure 19C:
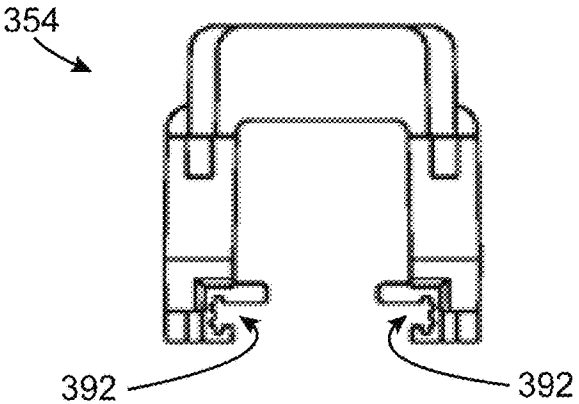
Figure 20B:
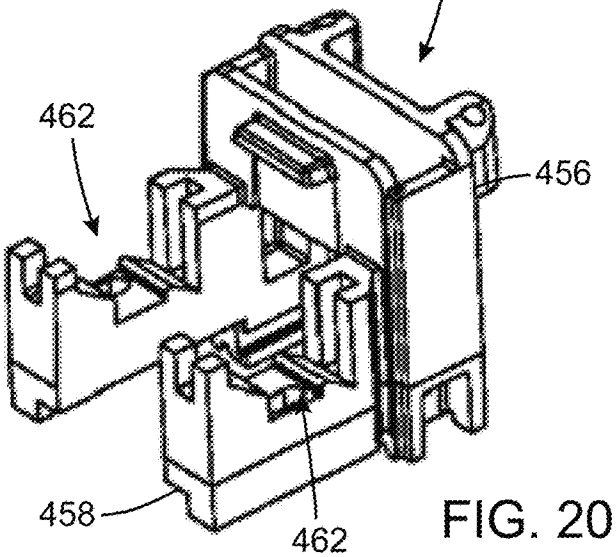
FIGS. 20 A-D are respectively a top plan view, a top perspective view, a front elevation view and a side elevation view of a tightening connector, according to another embodiment and suitable for "zone 3" of the fixed panel.
Figure 20D:
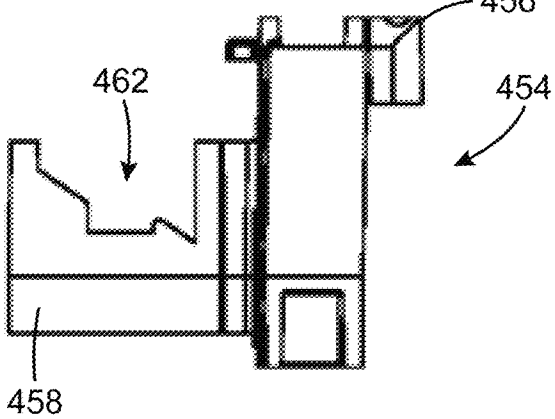
Figure 20A:
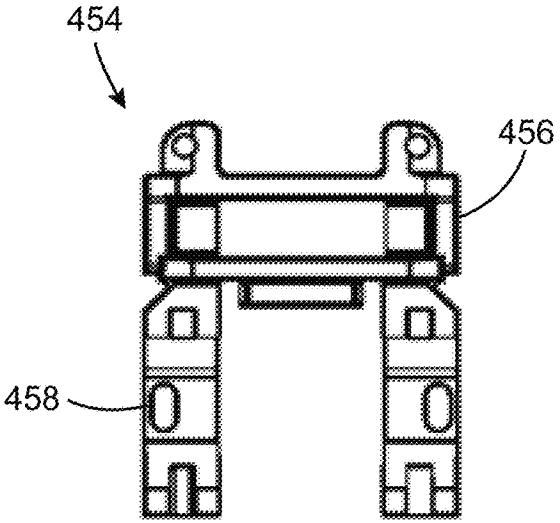
Figure 20C:
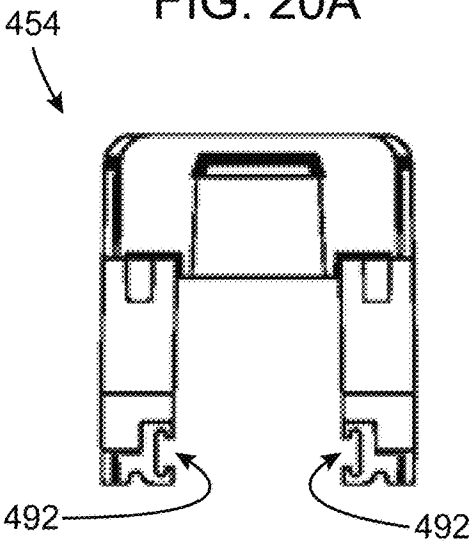
Figure 21A:
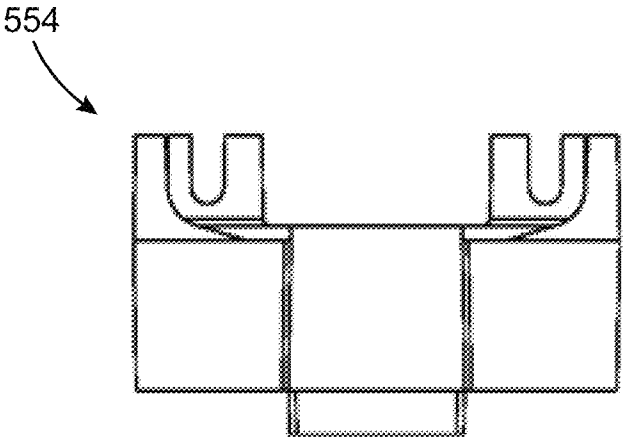
FIGS. 21A-D are respectively a top plan view, a top perspective view, a front elevation view and a side elevation view of a tightening connector, according to another embodiment and suitable for "zone 4" of the fixed panel.
Figure 21B:
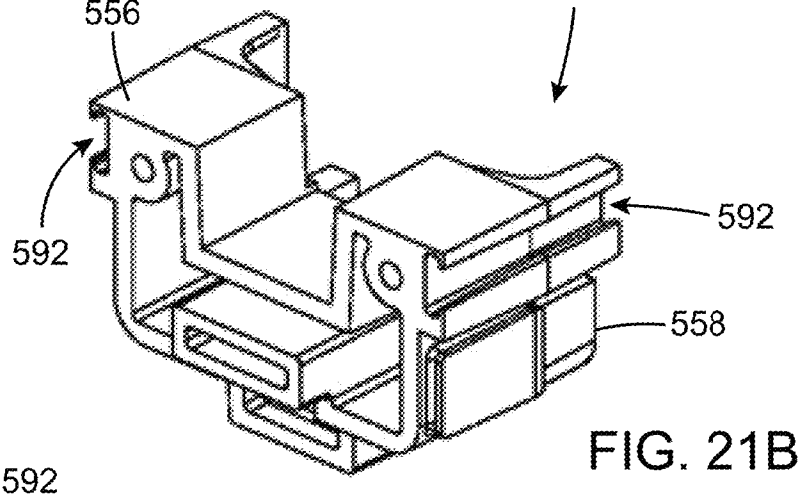
Figure 21C:
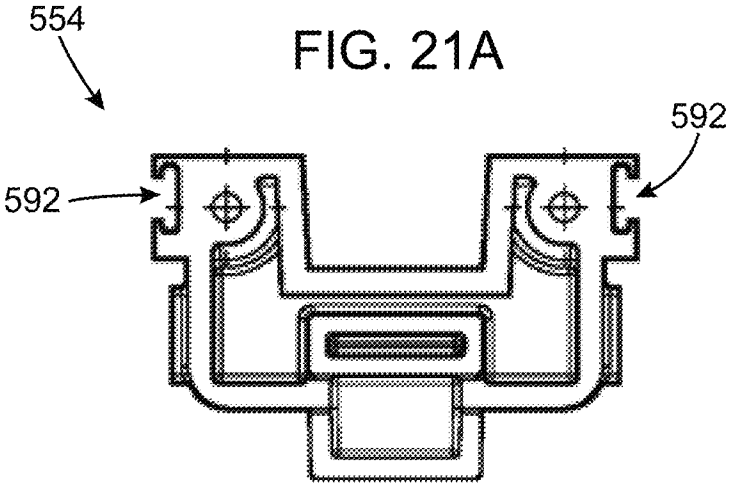
Figure 21D:
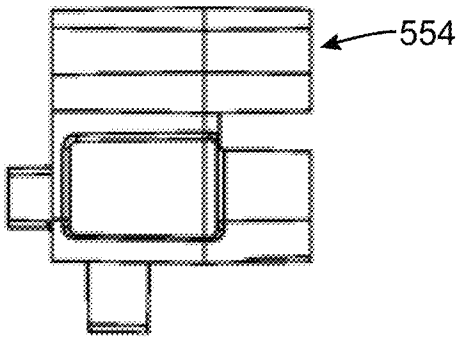

Now referring to FIGS. 15 and 16, mechanical fasteners 70 are inserted into the second elongated frame member 44*b* and the second frame segment 58 of the connector body 54 of the tightening connector assembly 52, so as to secure a portion of the tightening connector assembly 52 to the second elongated frame member 44*b*. In the illustrated embodiment, the mechanical fasteners 70 are two screws inserted into two corresponding mechanical fastener channels 87 provided or drilled into the second elongated frame member 44*b*, the second frame segment 58, and the tightening inserts 66. In some embodiments, the mechanical fastener channels 87 are accessible via the external edges 108 of the second elongated frame member 44*b*. The mechanical fasteners 70 are in this embodiment extending perpendicular to the tightening axis 60, i.e. in a direction substantially parallel to the longitudinal axis 48 of the rectangular door frame 46. In other embodiments, the mechanical fasteners 70 could be nails, clips, snap, or any other fasteners already known by one skilled in the art that allow securing the second elongated frame member 44*b* with the second frame segment 58 of the connector body 54 of the tightening connector assembly 52 and with the tightening insert 66.

As the mechanical fasteners 70 engage into the first and second frame members 44*a,b*, the connector body 54 and the tightening insert 66, through the mechanical fastener channel 87 having first and second sections 85, 89 extending through the connector body 54 and the tightening insert 66, the mechanical fasteners 70 exert a force that pulls the second elongated door frame member 44*b* against the first elongated door frame member 44*b*. After these steps, the first and second elongated frame members 44*a*, 44*b* are rigidly connected (i.e. tighten) to each other so as to achieve and maintain the orthogonal configuration.

The position of the first and second sections 85, 89, and more particularly the orientation/alignment of the first and second sections 85, 59 with respect to the mechanical fasteners inserted into the mechanical fastener channels 87 accessible via the external edges 108 of the second elongated frame member 44*b* is predetermined and selected such that when the mechanical fasteners 70 (e.g. a screw) are inserted into the mechanical faster channel 87 (i.e. into the first and second sections 85, 89) accessible via the external edges 108 of the second elongated frame member 44*b*, the first elongated frame member 44*a* is positioned perpendicularly and tightly juxtaposed against the second elongated frame member 44*b*.

Tightening Connector with a Weatherstrip Receiving Channel

Referring back to FIGS. 5A-D in combination with FIGS. 17A-D, another feature of the tightening connector body 54, which is also present on the tightening connector body 154, will be described. The tightening connector body 154 shown in FIGS. 17A-D is similar to the tightening connector body 54 which has been previously described. The features of the tightening connector body 154 are numbered with reference numerals in the 100 series which correspond to the reference numerals of the previous embodiment.

While the tightening connector body 54 is configured to be mounted to a lower portion of the sliding panel 42 and engage together the elongated door frame members 44*a,b* meeting in "zone 2", the tightening connector body 154 is configured to be mounted to an upper portion of the sliding panel 42 and engage together the elongated door frame members 44*a,d* meeting in "zone 1". "Zone 1" identified in FIG. 1 corresponds to an upper left corner of the active door panel 42, i.e. the upper tightening connector of the outer longitudinal edge 104 of the active door panel 42.

The connector body 154 is engageable with two of the elongated door frame members 44*a,d*, similarly to what has been previously described, i.e. that two of the elongated frame members 44*a,d* perpendicularly abut each other when assembled, and so are configured in an orthogonal configuration (i.e. that the two elongated door frame members 44*a,d* define a substantially straight angle). As such, the first frame segment 156 is engaged with a first one of the two elongated door frame members and the second frame segment 158 is engaged with a second one of the two elongated door frame members in the "zone 1" illustrated in FIG. 1.

Furthermore, both tightening connector bodies 54, 154 also include a weatherstrip receiving channel 92, the purpose of which will be described in further detail below.

Figure 8B:
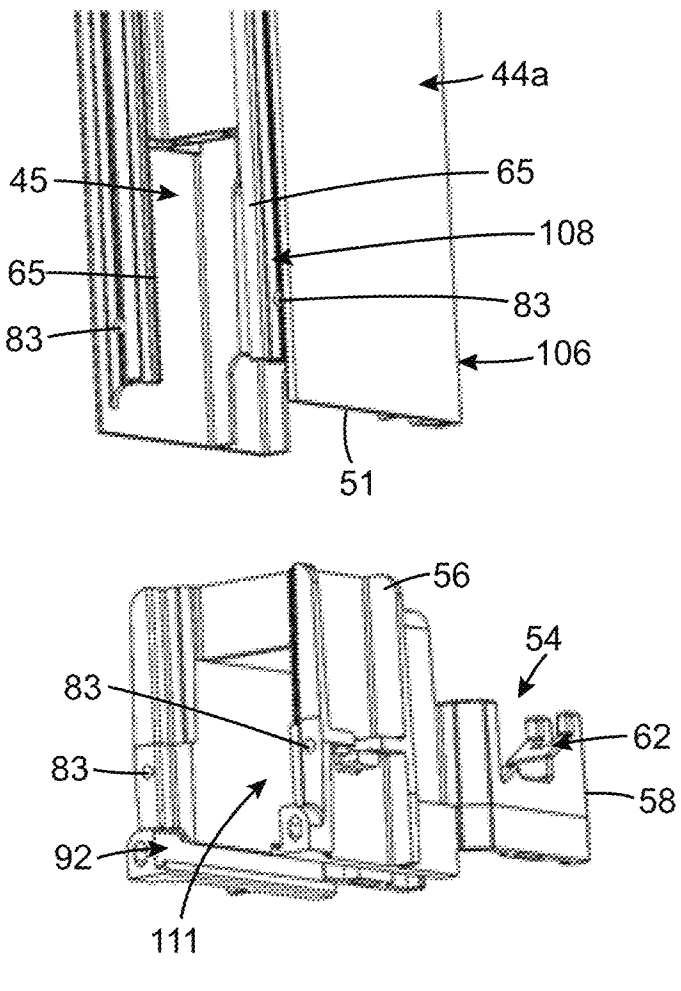
FIGS. 8A-B are respectively internal and external perspective views of the connector body of FIG. 6A and the lower end of the first one of the elongated frame members show in FIGS. 7A-B engageable together.
Figure 8A:
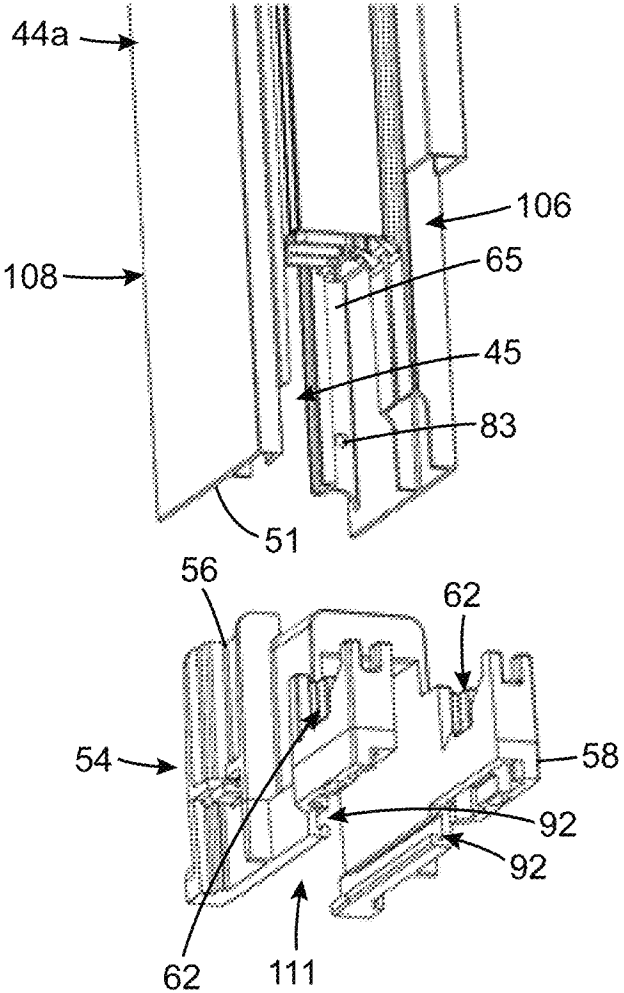
Figure 9B:
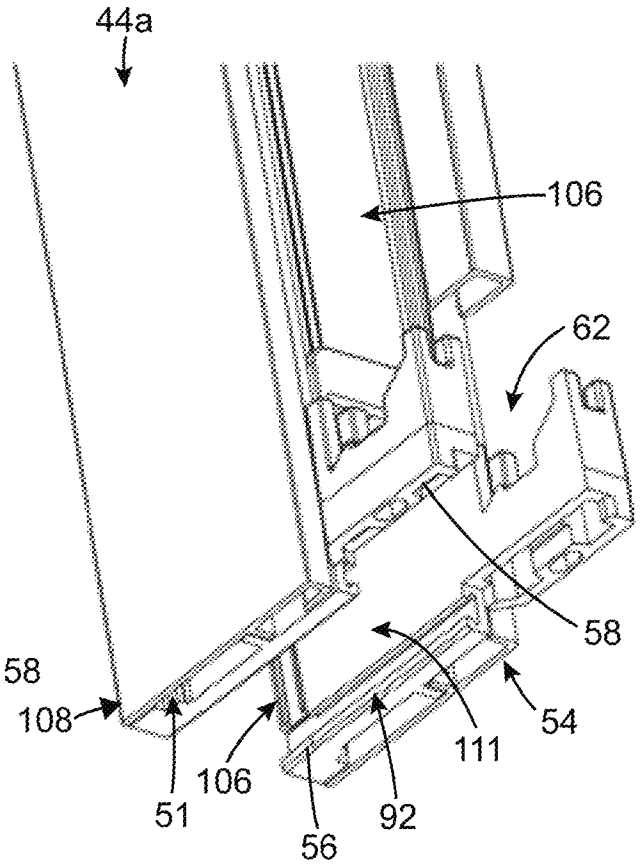
FIGS. 9A-B are respectively external and internal perspective views of the connector body of FIG. 6A engaged with the first one of the elongated door frame members of FIGS. 7A-B.
Figure 9A:
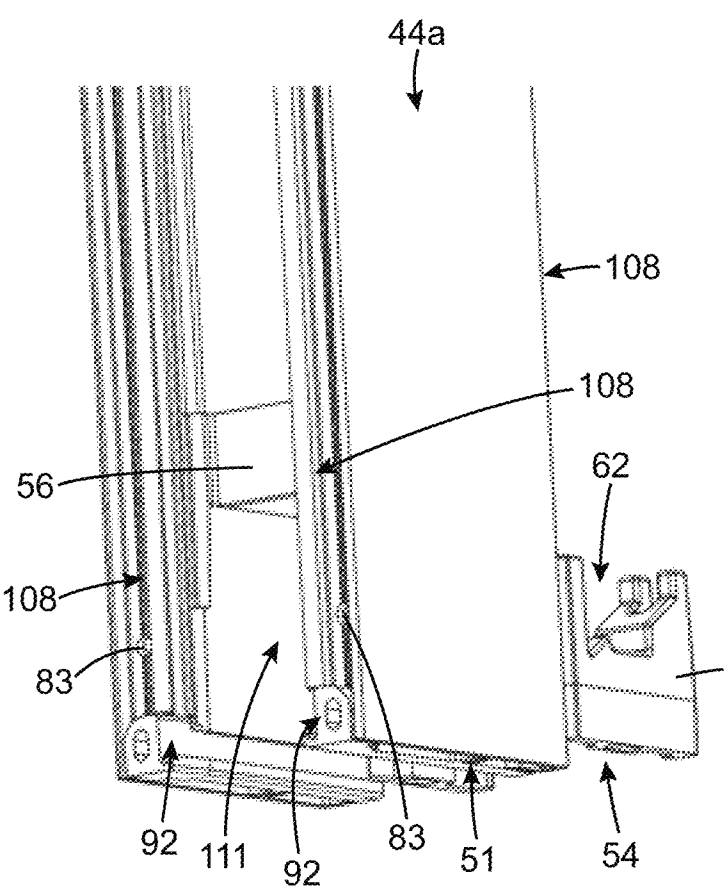

In an embodiment, at least one of the elongated door frame members has a weatherstrip receiving channel. For example, as illustrated in FIG. 8A-B and FIG. 14B, the elongated door frame member 44*a* has a weatherstrip receiving channel 110. The weatherstrip receiving channel 110 extends longitudinally along the elongated door frame members 44*a*, i.e. along a direction corresponding to the length of the elongated door frame member (in this case perpendicular to the tightening axis 60), and follows the external edges of the first elongated frame member. The elongated door frame members 44*b,d* also have a weatherstrip receiving channel 110 extending therealong, i.e. in a direction corresponding to the transversal axis of the door panel 42.

In an embodiment, the four elongated door frame members 44*a-d* include a weatherstrip receiving channel 110 extending therealong, following the external edge thereof and being opened to insert a weatherstrip (not shown) therein in a manner such that the weatherstrip is in contact with the door frame 122.

In the embodiment shown, each one of the four elongated door frame members 44*a-d* includes two weatherstrip receiving channels 110, one being positioned on an inner side of the door panel and the other one being positioned on an outer side of the door panel. The two weatherstrip receiving channels 110 are spaced-apart from one another with a central channel 111 extending longitudinally inside the profile of the elongated door frame members 44*a-d*. It is appreciated that, in an alternative embodiment, at least one of the elongated door frame members 44*a-d* can include one weatherstrip receiving channel 110 or more than two weatherstrip receiving channels 110.

In the embodiment shown in FIG. 15, the weatherstrip receiving channels 110 are opened inwardly into the central channel 111, i.e. they are accessible through the central channel 111 and they face and are opened in an internal portion of the elongated door frame members 44*a-d*.

As such, each one of the weatherstrip receiving channels 110 is configured to receive a weatherstrip (not shown) therein. Thus, when inserted and engaged inside a respective one of the weatherstrip receiving channel, the weatherstrip extends along the respective one of the elongated door frame member 44*b*.

As mentioned above, in one embodiment, each one of the four elongated door frame members can include one or more weatherstrip receiving channel in which a corresponding weatherstrip can be inserted, and the door panel frame 46 can hence be provided with a substantially continuous weatherstrip along its entire perimeter, with discontinuities being provided solely in corners thereof. Alternatively, the weatherstrip could be provided at some specific portions of the perimeter of the door panel frame 46, depending on the required sealing properties.

In an embodiment described in further detail below, the tightening connector bodies 54, 154 are provided with at least one weatherstrip receiving channel 92 to provide a continuous weatherstrip along an entire perimeter of the door panel frame 46.

Now referring back to FIGS. 5A-D, the connector body 54 used in "zone 2" has two weatherstrip receiving channels 92 defined therein configured to receive a weatherstrip (not shown). The two weatherstrip receiving channels 92 extend continuously in the first and second frame segments 56, 58 and along the transversal axis 50. When the tightening connector 54 connects together the two elongated door frame members 44*a,b* meeting in "zone 2", the weatherstrip receiving channels 92 are aligned and extend continuously with a respective one of the weatherstrip receiving channels 110 of the elongated door frame member 44*a,b* extending along the transversal axis 50 in a manner such that a single weatherstrip can extend continuously into the aligned weatherstrip receiving channels 92, 110.

Turning to FIGS. 17A-D, the connector body 154 has also two weatherstrip receiving channels 92 defined therein configured to receive a weatherstrip (not shown) As illustrated, the weatherstrip receiving channels 92 extend solely along the first segment 156 of the connector body 154, along the external edges thereof. When the tightening connector 154 connects together the two elongated door frame members 44*a,d* meeting in "zone 1", the weatherstrip receiving channels 92 are aligned and extend continuously with a respective one of the weatherstrip receiving channels 110 of the elongated door frame member 44*a,d* extending along the transversal axis 50 or longitudinal axis 48 of the door panel frame 46. In some embodiments, such as the one illustrated in FIG. 2B, the weatherstrip receiving channel (not illustrated) extends along the transversal axis 50 of the door panel frame 46, so as to provide a weatherstrip to the door panel frame 46 along its entire bottom portion, i.e. the length of the elongated door frame member 44*b*, but also the width of the elongated door frame members 44*a* and 44*c*. In the illustrated embodiment, the door panel frame 46 also includes a weatherstrip extenging along its entire top portion, i.e. the length of the elongated door frame member 44*d*, but also the width of the elongated door frame members 44*a* and 44*c*. Alternatively, the weatherstrip receiving channel (not illustrated) extends along the longitudinal axis 48 of the door panel frame 46, so as to provide a weatherstrip to the door panel frame 46 along its entire left portion, i.e. the length of the elongated door frame member 44*a*, but also the width of the elongated door frame members 44*b* and 44*d*. In such an alternative, the door panel frame 46 also includes a weatherstrip extenging along its entire right portion, i.e. the length of the elongated door frame member 44*c*, but also the width of the elongated door frame members 44*b* and 44*d*.

The weatherstrip receiving channels 92 are embodied by slots provided along the connector body 54, 154, either along the first segment or the first and second segments. Alternatively, the weatherstrip receiving channels can be provided elsewhere onto or into the connector body 54, 154. In such an alternative embodiment, the weatherstrip receiving channels 110 of the corresponding elongated door frame members can be positioned accordingly, so as the weatherstrip receiving channel 92 of the connector body 94 and the weatherstrip receiving channel 110 of the corresponding elongated door frame members 44*a-d* are aligned when the connector body 54, 154 (and its corresponding first and second segments) is engaged with the elongated door frame members 44*a-d*.

In some embodiments, shown for example in FIGS. 17A-D, the tightening connector body 154 comprises a profile having an inside sidewall and an outside sidewall. In such embodiments, the weatherstrip receiving channel 192 of the at least one tightening connector body 154 comprises two elongated slots extending along a respective one of the inside and outside sidewalls. Similarly, at least one of the four elongated frame members 44*a-d* can comprise a profile with an inside sidewall and an outside sidewall, wherein each one of the inside and outside sidewalls comprises one of the weatherstrip receiving channel 110 extending therealong. The two elongated slots of the connector body 154 can be aligned with the respective one of the weatherstrip receiving channels 192 provided in the inside and the outside sidewalls of the at least one four elongated frame members 44*a-d*. In some implementations, the weatherstrip receiving channel 110 can be two elongated slots on inner wall surfaces of the inside and outside sidewalls and facing each other. In the embodiment shown in FIGS. 5A-D, the connector body 54 used in "zone 2", which is located in the lower portion of the rectangular door panel 46, has weatherstrip receiving channels 92 provided on the inside and the outside sidewalls, on the inner wall surfaces thereof. On the contrary, in the embodiment shown in FIGS. 17A-D, the connector body 154 used in "zone 1", which is located in the upper portion of the rectangular door panel 46, has weatherstrip receiving channels 192 provided on the inside and the outside sidewalls, on the outer wall surfaces thereof.

In some embodiments, the four elongated door frame members 44*a-d* comprise a corresponding one of the weatherstrip receiving channel 110 extending therealong. In this embodiment, the rectangular door panel 46 further comprises four tightening connector assemblies, each one including at least one of the weatherstrip receiving channel 92, 192, and each one of the tightening connector assemblies being mounted in a respective corner of the rectangular door panel 46 to connect two abutting ones of the elongated door frame members 44*a-d* (e.g. 44*a* and 44*b*). The weatherstrip receiving channels 110, 92, 192 of the elongated door frame members and the tightening connectors define a weatherstrip path extending substantially continuously along a perimeter of the rectangular door panel 46.

When the elongated frame members 44*a-d* are engaged together to define the door frame 46, the weatherstrip receiving channels 92, 110, 192 define a channel or slot extending substantially continuously along the periphery of the door frame 46. It is appreciated that small discontinuities can be provided when a longitudinally-extending segment of the weatherstrip receiving channels 92, 110, 192 meets a transversally-extending segment of the weatherstrip receiving channels 92, 110, 192.

Now turning to FIGS. 18 to 21, other different embodiments of the tightening connectors are illustrated. Each one of tightening connector bodies is substantially similar to the tightening connector bodies 54, 154 described above but its design has been adapted for different corners of the sliding panel 42 and the fixed panel 43.

For simplicity, the features of the embodiments described below are numbered with reference numerals in the 200, 300, and 400 series respectively which correspond to the reference numerals of the previous embodiments.

In FIG. 18, the tightening connector body 254 is intended to be mounted in an upper inner corner of the sliding panel 42, in "zone 8". More particularly, the tightening connector body 254 according to this embodiment can be mounted in the "zone 8" identified in FIG. 1, which corresponds to the upper right corner of the active door panel 42, i.e. the upper tightening connector assembly of the inner longitudinal edge 102 of the active door panel 42. Similarly to the tightening connector body 54, 154, the tightening connector body 254 has a first and a second frame segments 256, 258, which is engageable with two of the elongated door frame members 44*c,d*. The connector body 254 has a substantially cubic shape, but its geometrical configuration, shape, dimensions, and the like, could vary according to the targeted application or positioning.

The tightening connector body 254 includes essentially the same features as the tightening connector bodies 54, 154 with respect to the insert receiving cavity 262 defined therein and having the insert contact surface 264 defining an oblique angle with respect to the tightening axis 60.

Furthermore, as the tightening connector bodies 54, 154, the connector body 254 has two spaced-apart weatherstrip receiving channels 292, each one extending on one side of connector body 254. When the tightening connector body 254 connects together the two elongated door frame members 44*c,d* meeting in "zone 8", the weatherstrip receiving channels 292 are aligned and extend continuously with a respective one of the weatherstrip receiving channels 110 of the elongated door frame member 44*c,d* extending along the transversal axis 50 of the door panel frame 46.

As the tightening connector body 154, which is also mounted in the upper portion of the rectangular door panel 46, the two spaced-apart weatherstrip receiving channels 292 of the tightening connector body 254 are open and accessible outwardly. They are open on opposed outer sides of the connector body 254. More particularly, the tightening connector body 254 has weatherstrip receiving channels 292 provided on the inside and the outside sidewalls, on the outer wall surfaces thereof.

Now referring to FIGS. 19 and 20, two embodiments of the tightening connector bodies 354, 454 are shown. Those two embodiments are rather similar to the tightening connectors which have been previously described. It is of note that the geometrical configuration, shape, dimensions, and the like of the tightening connectors could vary according to their positioning.

For example, the embodiment depicted in FIGS. 19A-D can be mounted in the "zone 6" identified in FIG. 1, which corresponds to a lower right portion of the active door panel 42, i.e. the lower tightening connector of the inner longitudinal edge 102 of the active door panel 42. The embodiment illustrated in FIGS. 20A-D can be mounted in the "zone 3" identified in FIG. 1, which corresponds to a lower right corner of the fixed panel 43, i.e. the lower tightening connector of the outer longitudinal edge 104 of the fixed door panel 43. While these embodiments are similar, they can differ, for example and without being limitative, having regard to their shape and/or dimensions, and/or the positioning of the weatherstrip receiving channels 392, 492.

As the tightening connector body 54, which is also mounted in the lower portion of the rectangular door panel 46, the two spaced-apart weatherstrip receiving channels 392, 492 of the tightening connector bodies 354, 454 are open and accessible outwardly. They are open on opposed outer sides of the connector bodies 354, 454. More particularly, each one of the tightening connector bodies 354, 454 has weatherstrip receiving channels 392, 492 provided on the inside and the outside sidewalls, on the inner wall surfaces thereof.

With reference to FIGS. 21A-D, an embodiment of the tightening connector is shown wherein the features are numbered with reference numerals in the 500 series respectively which correspond to the reference numerals of the previously described embodiments. This embodiment is similar to the ones which have been described so far, but notably differs by its shape. As illustrated in FIG. 21A-D, the tightening connector body 554 according to this embodiment has a substantially U-shape cross-section. Such a configuration can be useful, for example, for connecting two elongated door frame members in the "zone 4" identified in FIG. 1, which corresponds to an upper right corner of the fixed door panel 43, i.e. the upper tightening connector of the outer longitudinal edge 104 of the fixed door panel 43. As shown, this embodiment of the tightening connector body 554 also comprises two spaced-apart weatherstrip receiving channels 592 extending along a transversal axis of the fixed door panel 43.

As the tightening connector body 254 which is also mounted in the upper portion of the rectangular door panel 46, the two spaced-apart weatherstrip receiving channels 592 of the tightening connector body 554 are open and accessible outwardly. They are open on opposed outer sides of the connector body 554. More particularly, each one of the tightening connector bodies 554 has weatherstrip receiving channels 592 provided on the inside and the outside sidewalls, on the outer wall surfaces thereof.

Referring now to FIGS. 24A-D, still another embodiment of the tightening connector is shown wherein the features are numbered with reference numerals in the 600 series respectively which correspond to the reference numerals of the previously described embodiments. This embodiment is similar to the ones which have been described so far, but notably differs by its shape. Such a configuration can be useful, for example, for connecting two elongated door frame members in the "zone 5" identified in FIG. 1, which corresponds to a lower left corner of the fixed door panel 43, i.e. the lower tightening connector of the inner longitudinal edge 102 of the fixed door panel 43.

Now referring to FIGS. 30A-D, a further embodiment of the tightening connector is shown wherein the features are numbered with reference numerals in the 700 series respectively which correspond to the reference numerals of the previously described embodiments, when applicable. The configuration illustrated in FIGS. 30A-D can be useful, for example, for connecting two elongated door frame members in the "zone 7" identified in FIG. 1, which corresponds to an upper left corner of the fixed door panel 43, i.e. the upper tightening connector of the inner longitudinal edge 102 of the fixed door panel 43.

It is appreciated that none or at least some of the connector bodies can include one or more insert receiving cavity configured to receive a tightening insert therein. In an embodiment (not shown), all the connector bodies can be free of insert receiving cavity.

Furthermore, in another embodiment wherein at least some of the connector bodies includes one or more insert receiving cavity, it is appreciated that the shape and the configuration of the insert receiving cavity(ies) and the complementary tightening insert(s) can vary from the embodiments shown in the accompanying figures.

It will be understood that in the context of the current description, the term "weatherstrip" refers to a band of material which can be introduced into and extend continuously in respective ones of the weatherstrip receiving channels 92, 192, 292, 393, 492, 592 and the weatherstrip receiving channels 110 so as to provide the rectangular door panel frame 46 (or one of its component/section) with a thermal barrier or a thermal break, and so to prevent the water from flowing towards the interior of the building. More particularly, the weatherstrip can at least partially seal, fill or isolate the gap between some components of the patio door 40 and/or the frame of the patio door 40.

Figure 22B:
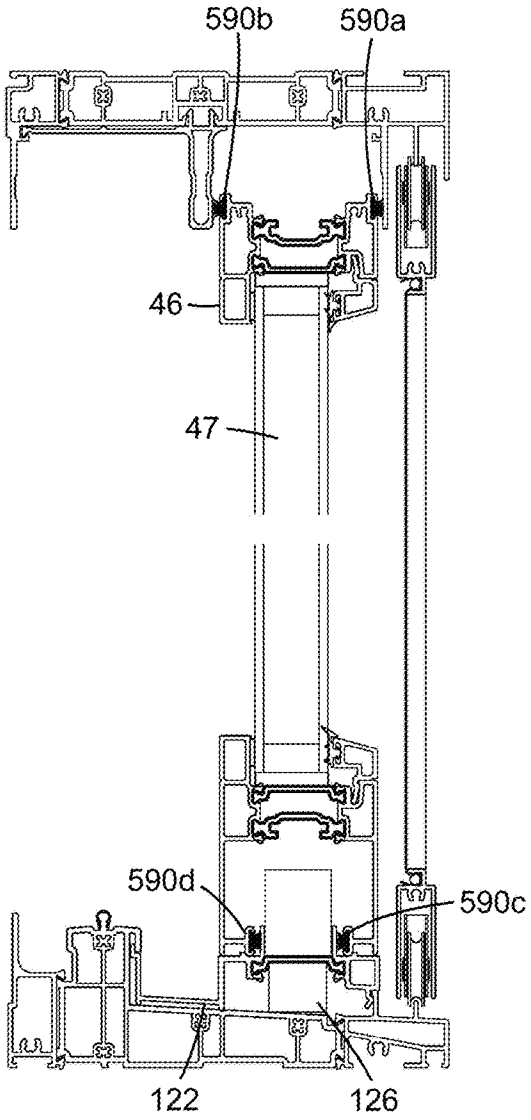
Figure 22A:
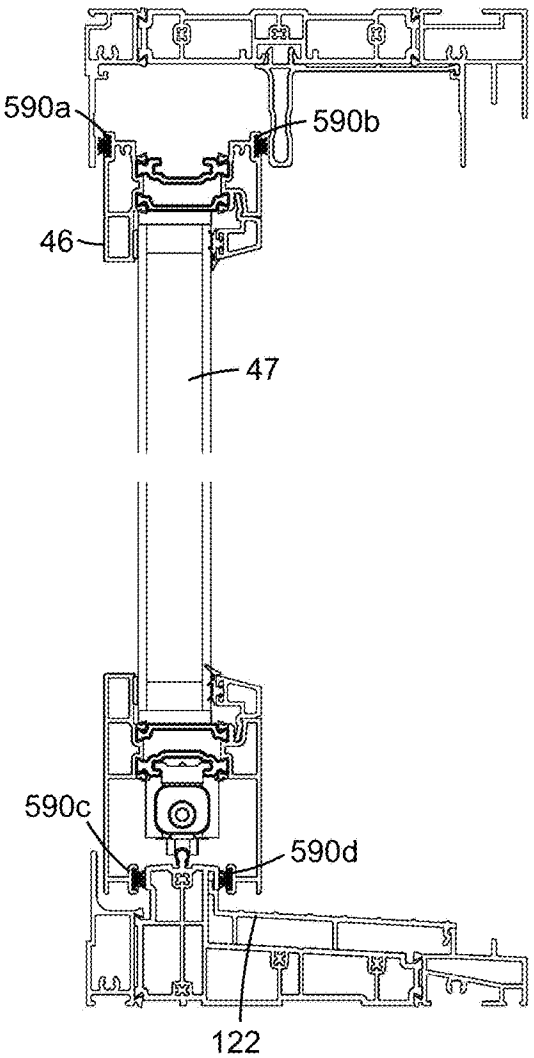
Figure 23:
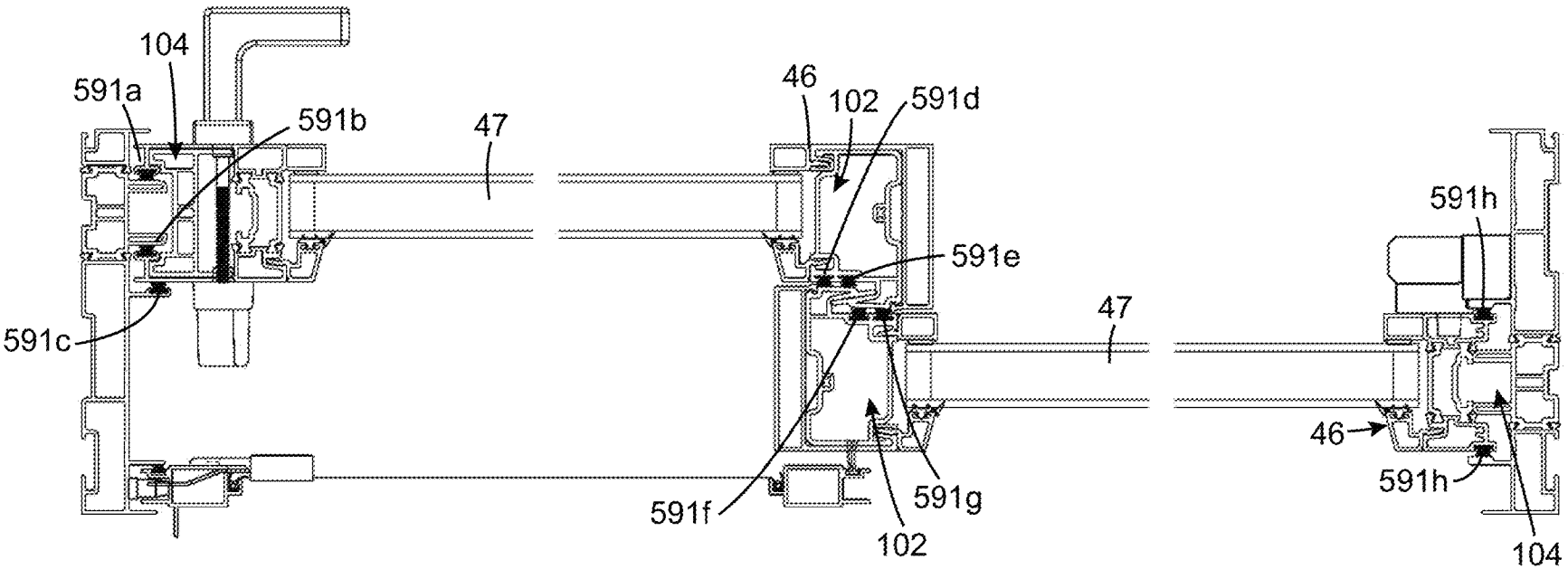
FIG. 23 shows a transversal cross-sectional view of a patio door taken along a transversal axis thereof, according to an embodiment.
Figure 24A:
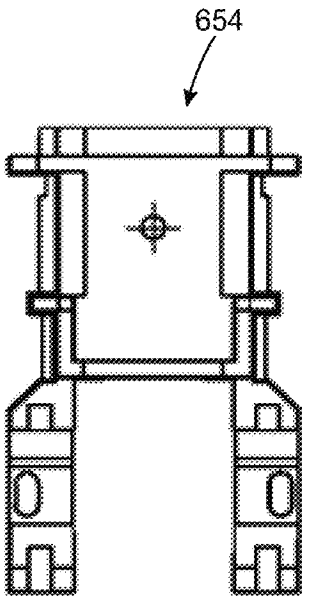
FIGS. 24A-D are respectively a top plan view, a top perspective view, a front elevation view and a side elevation view of a connector body, according to another embodiment and suitable for "zone 5" of the fixed panel.
Figure 24B:
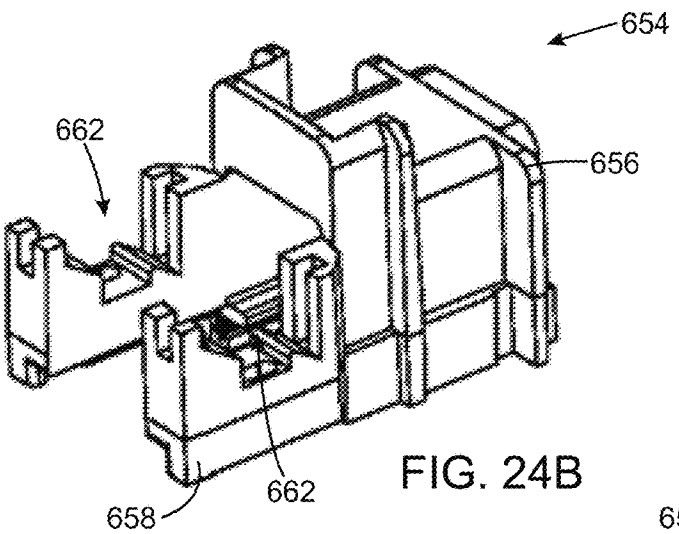
Figure 24C:
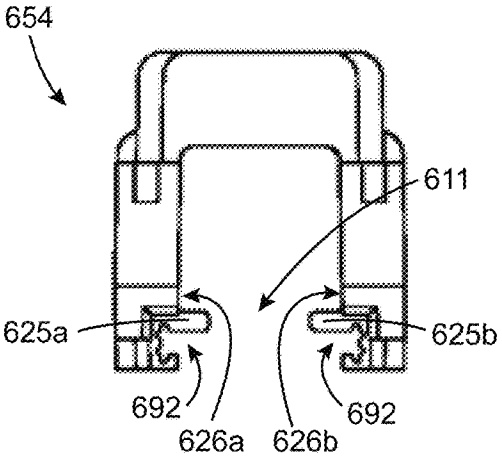
Figure 24D:
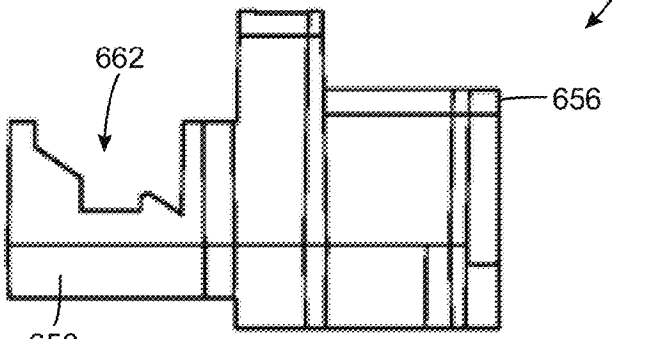
Figure 25B:
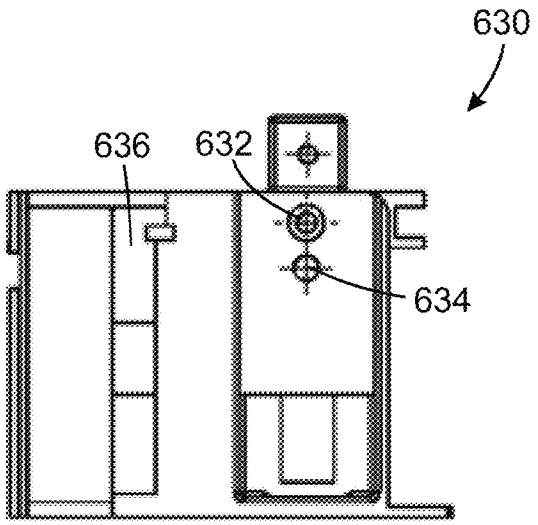
FIGS. 25A-D illustrate a top perspective view, a top plan view, a side elevation view and a front elevation view of a patio door frame connector securable to a patio door frame and engageable with the connector body shown in FIGS. 24A-D, according to an embodiment
Figure 25D:
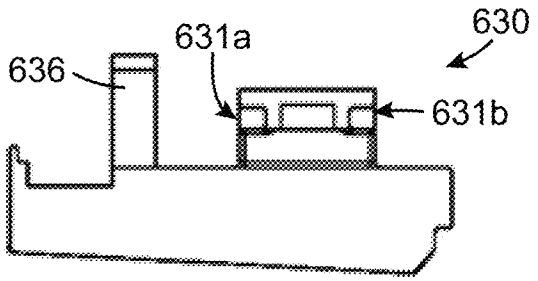
Figure 25A:
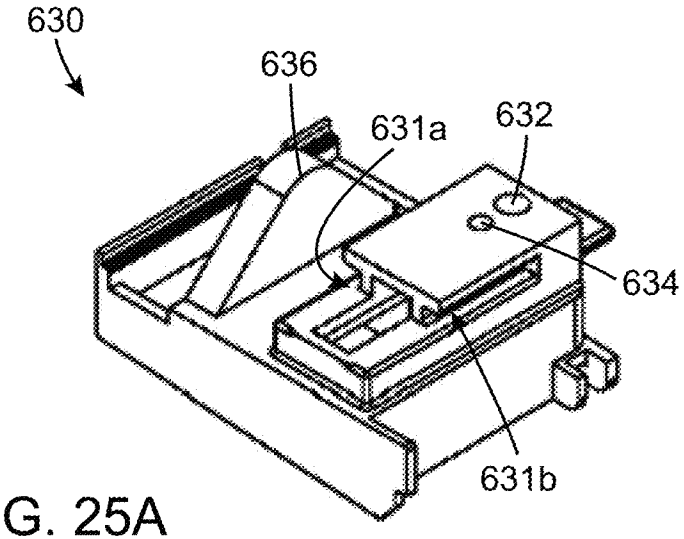
Figure 25C:
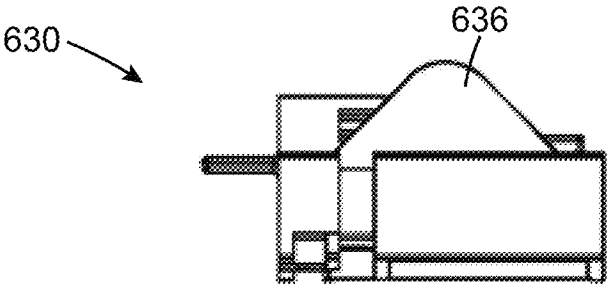

Now referring to FIGS. 22A-B and FIG. 23, a cross-section view and a transverse section view of a patio door frame is shown. As illustrated, the patio door frame is insulated with two continuous weatherstrips 590*a,b,c,d* and 591*a-h* along the perimeter of the door frame 46 including each corner of the door frame 46 connected through the tightening connectors, and along each one of the elongated frame members. The section lines for FIGS. 22A-B and FIG. 23 are located to cut across the tightening connectors. The weatherstrips 590*a,b,c,d* and 591*a-h* are inserted into respective weatherstrip receiving channels. It will be readily understood that the positioning, as well as the number of portions of weatherstrip can vary according to the targeted application and in accordance with the number and position of the weatherstrip receiving channels.

In the embodiments shown, when the connector body is mounted in the upper portion of the rectangular door panel 46, the two spaced-apart weatherstrip receiving channels are provided on the outer wall surfaces of the inside and the outside sidewalls. On the opposite, when the connector body is mounted in the lower portion of the rectangular door panel 46, the two spaced-apart weatherstrip receiving channels are provided on the inner wall surfaces of the inside and the outside sidewalls.

In some embodiments, the weatherstrip is made, from example and without being limitative of polyvinyl chloride (PVC), foam, rubber, vinyl, combinations thereof or the like, and the material can be selected so as to meet particular requirement(s) and/or standard(s). The weatherstrip can also be sticky or be provided with an adhesive, so as to maintain its positioning when installed into the weatherstrip receiving channel 92. The weatherstrip could also be deformable, resilient, or rigid, according to the targeted application.

Dimensions (e.g. its width and/or length) can vary according to one's need, and are usually predetermined so as to be compatible (i.e. complementary) with the dimensions of the weatherstrip receiving channels 92, 192, 292, 392, 492, 592. In some implementations, the patio door 40 is provided with only one continuous section of weatherstrip extending along an entire external perimeter of the four elongated door frame members defining a door panel. In other implementations, the weatherstrip can be provided in more than one section.

While the different characteristics and features of the weatherstrip can vary from one embodiment to another, it will be readily understood that the weatherstrip is embodied by a component which can prevent or reduce, under certain circumstances, drafts and energy loss with a patio door or a patio door panel.

Door Panel Connection Assembly

With reference to FIGS. 24 to 29, two embodiments of a door panel connection assembly 620, 720 configured and positioned for engaging a fixed door panel 43 with a patio door frame 112 will be described. More particularly, in the embodiment shown, the fixed door panel 43 is engaged with and secured to the patio door frame 112 in "zones 5 and 7", which corresponds to the inner longitudinal edges 102, at lower and upper ends thereof respectively. Thus, the fixed door panel 43 is engaged with and secured to the patio door frame 112 at the interlock between the two door panels 42, 43.

Referring now to FIGS. 24A-D and 25A-D, a first embodiment of the door panel connection assembly 620 configured for "zone 5" will be described. The door panel connection assembly 620 can serve as an anchoring device with the patio door frame 112.

The door panel connection assembly 620 includes the tightening connector body 654, illustrated in FIGS. 24A-D, which has been described above. As for the above described tightening connectors, the connector body 654 includes essentially the same features with respect to the insert receiving cavity 662 defined therein and having the insert contact surface 664 defining an oblique angle with respect to the tightening axis 60 and the two spaced-apart weatherstrip receiving channels 692, each one extending on one side of connector body 654. When the tightening connector body 654 connects together the two elongated door frame members 44*a,b* meeting in "zone 5", the weatherstrip receiving channels 292 can be aligned and extend continuously with a respective one of the weatherstrip receiving channels 110 of the elongated door frame members 44*a,b* extending along the transversal axis 50 of the door panel frame 46.

It is appreciated that the shape and the configuration of the connector body 654 can vary from the embodiment shown in FIGS. 24A-D. For instance, it can be embodied, for example, by any one of the connector bodies which have been described in the previous sections. As illustrated, the connector body 654 is engageable with and securable to two of the plurality elongated door frame members abutting each other, similarly to what has been previously described and so as to achieve an orthogonal configuration. It is appreciated that, in an alternative embodiment (not shown), the tightening connector body 654 can be free of insert receiving cavity configured to receive a tightening insert therein and/or weatherstrip receiving channel(s).

In some embodiments, the connector body 654 includes two elongated body connectors 625*a,b* (also referred to as "two elongated male or female members"). The two elongated body connectors members 625*a,b* are positioned on a respective side of the connector body 654, i.e. one on the inside sidewall and one of the outside sidewall. As illustrated, the two elongated body connectors 625*a,b* are elongated male connectors (or, alternatively "members") protruding from two opposite sidewalls of the connector body 654, inwardly inside the central channel 111, i.e. protruding from the inner wall surfaces. The two elongated male connectors 625*a,b* extend along continuously in the first and second frame segments 656, 658 of the connector body 654 and are positioned on a respective inner wall surface 626*a,b* of the connector body 654, above the weatherstrip receiving channels 692. Alternatively, the elongated connectors 625*a,b* could both be elongated female members, such as elongated channels defined in the connector body 654, either on the inner wall surfaces or the outer wall surfaces. In another variant, one of the two elongated members could be an elongated male member, while another one of the two elongated members could be an elongated female member.

In the illustrated embodiment, the two elongated body connectors 625*a,b* (illustrated as elongated male connectors) are similar to a pair of rails, i.e. a pair of bars that can serve as a guide. It will be readily understood that the two elongated body connectors 625*a,b* could be replaced by any structural member allowing to achieve a similar configuration.

When the connector body 654 engages together two elongated door frame members, the two elongated body connectors 625*a,b* are physically accessible through the central channel 111. As such, a complementary part or component could be attached or engage with the two elongated body connectors 625*a, b*.

In addition to the tightening connector body 654, the door panel connection assembly 620 includes patio door frame connector 630 securable to the patio door frame 122 and engageable with the connector body 654.

As its name entails, the patio door frame connector 630 is securable to the patio door frame 122. The patio door frame connector 630 is protruding into the door panel receiving cavity, from an upper edge thereof, when secured to the patio door frame 122. In this context, securing the patio door frame connector 630 to the patio door frame 122 can be achieved with mechanical fasteners, such as screws, nails, snaps or the like.

As illustrated, the patio door frame connector 630 includes two elongated frame connectors 631*a,b* (also referred to as "two elongated male or female members"), wherein the elongated connectors 631*a,b* are open or engageable on opposed sides, i.e. one being open on the inner side and the other being open on the outer side with respect to the door panel 43. The two elongated frame connectors 631*a,b* are configured so as to be engageable with the two elongated body connectors 625*a,b* of the connector body 654. For example, in one embodiment, the two elongated members 625*a,b* are elongated rails, i.e. male members, while the two elongated members 631*a,b* are complementary elongated channels, i.e. elongated female members. In such an embodiment, the two elongated male connectors 625*a,b* of the connector body 654 can be engaged with the corresponding two elongated female connectors 631*a,b* of the patio door frame connector 630 when the fixed door panel 43 is slidingly inserted into the door panel receiving cavity. As such, the two elongated male or female members 625*a,b* of the connector body 654 are complementary to the two elongated male or female members 631*a,b* of the patio door frame connector 630, i.e. they can engage (or, alternatively, be inserted) with each other by a sliding movement.

In the embodiment shown, the patio door frame connector 630 further includes injection holes 632, 634. The injection holes 632, 634 are positioned and configured so as to allow the injection of an insulating barrier, such as and without being limitative, silicone into a hollow portion of the patio door frame connector 630, as well as evacuating air from the hollow portion of the patio door frame connector 630. In the illustrated embodiment, the injection holes 632, 634 have a circular cross-section and are positioned on a top portion of the patio door frame connector 630, respectively. In such embodiment, the injection hole 632 is configured so as to receive silicone therethrough and the injection hole 634 is configure so as to allow evacuating the air from within the hollow portion of the patio door frame 630. When the silicone is injected into the hollow portion of the patio door 630, the silicone can be in contact with the door frame 122, and so provide a sealed interface. It will be readily understood that the geometrical features and the positioning of the injecting holes could vary, depending on where the insulating barrier should be dispensed and/or injected.

In some embodiments, the patio door frame connector 630 further includes a protuberance 636 extending towards the door panel receiving cavity. The protuberance 636 can promote or enhance the sealing of the fixed door panel 43 once assembled by acting as a physical barrier.

Figure 26:
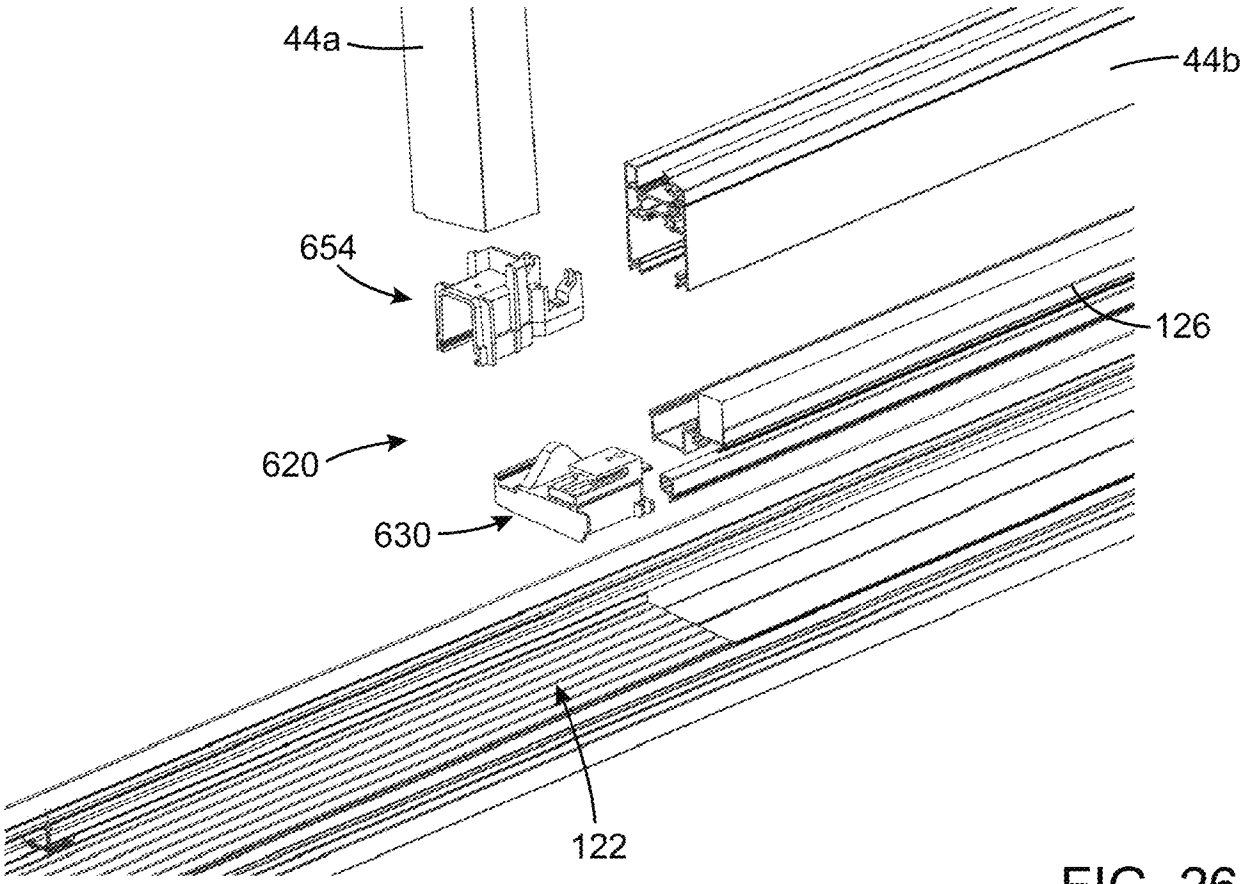
FIG. 26 is an exploded view of a corner of a patio door including a patio door frame defining a door panel receiving cavity, the fixed door panel insertable into the door panel receiving cavity, the door panel including the connector body shown in FIGS. 24A-D, and the door panel connection assembly shown in FIGS. 25A-D and engageable with the connector body shown in FIGS. 24A-D when the fixed door panel is inserted into the door panel receiving cavity, according to an embodiment.
Figure 27:
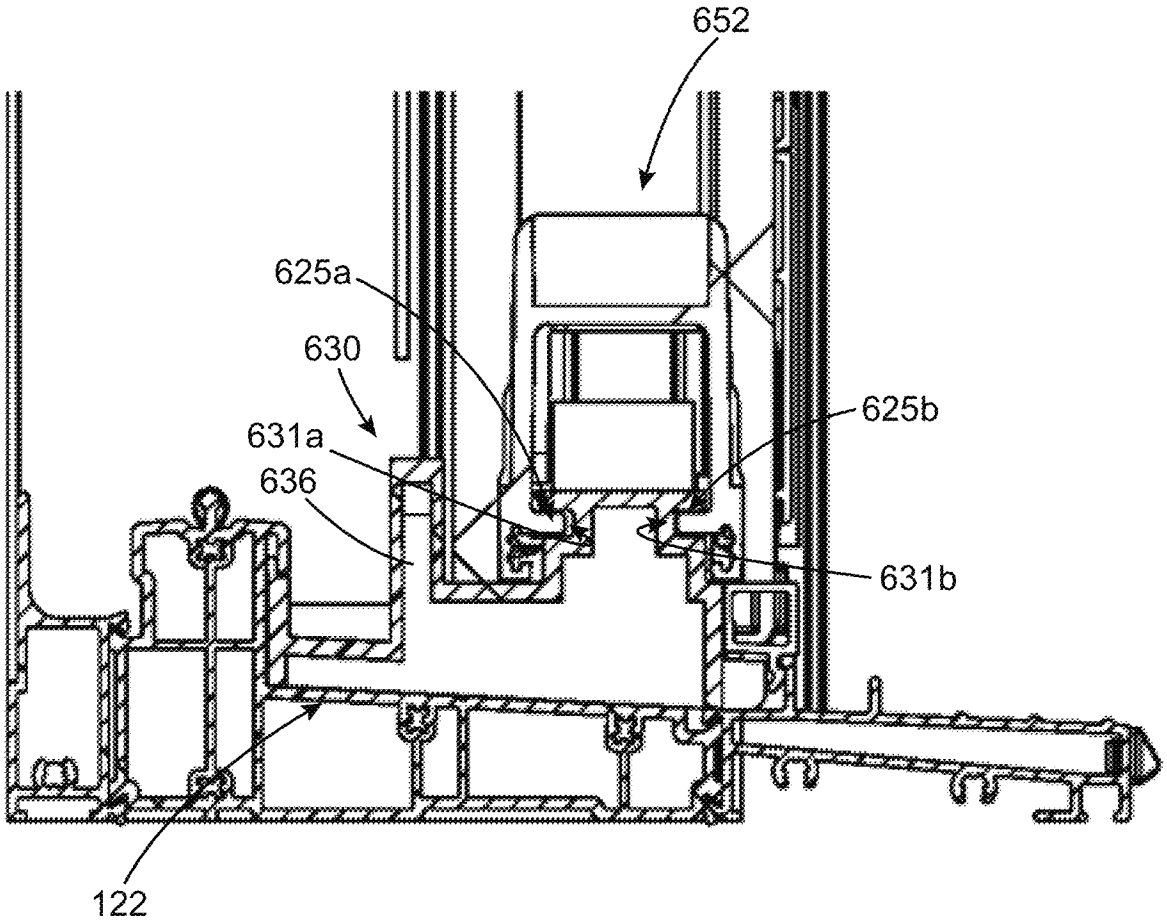
FIG. 27 is a cross-sectional view of the corner of the patio door illustrated in FIG. 26, once assembled, according to an embodiment.
Figure 28:
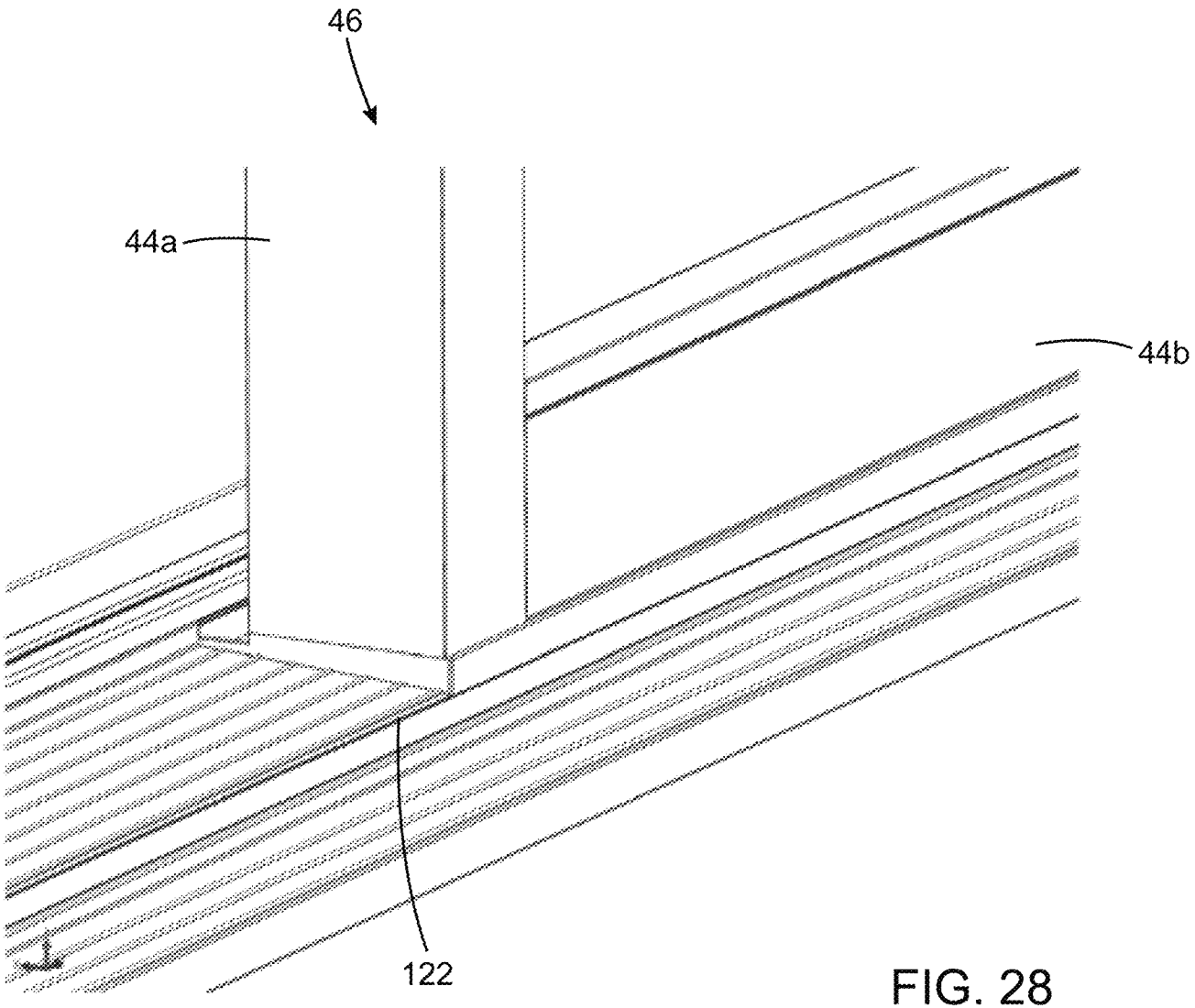
FIG. 28 is a top perspective view of the corner of the patio door shown in FIG. 27.
Figure 29B:
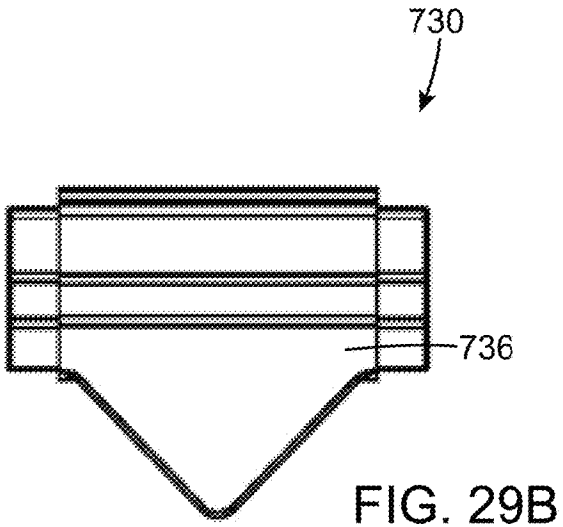
FIGS. 29A-D are respectively a top plan view, a top perspective view, a front elevation view and a side elevation view of a connector body, according to an embodiment and suitable for "zone 7" of the fixed panel.
Figure 29D:
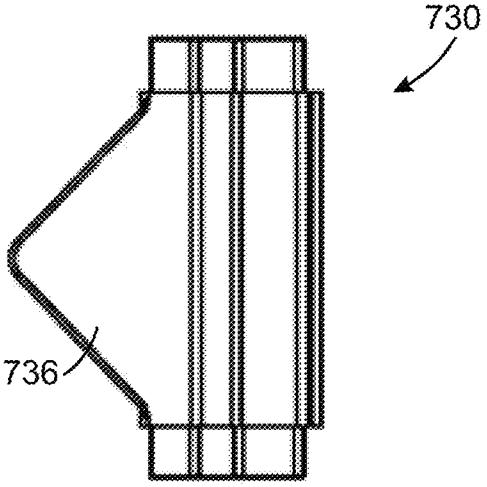
Figure 29A:
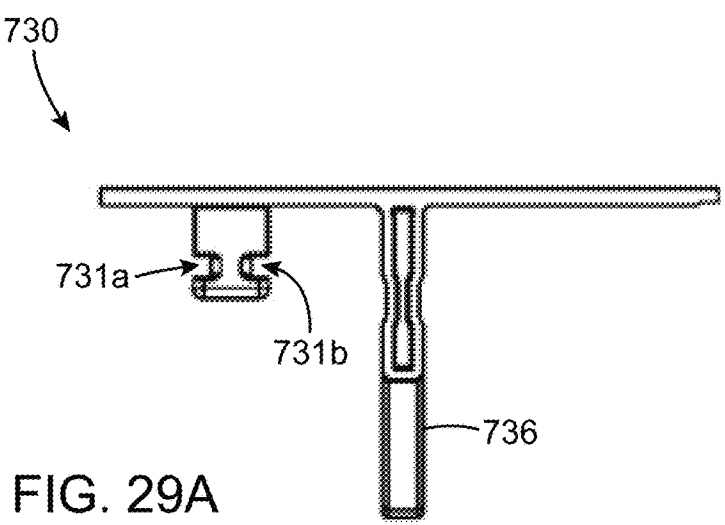
Figure 29C:
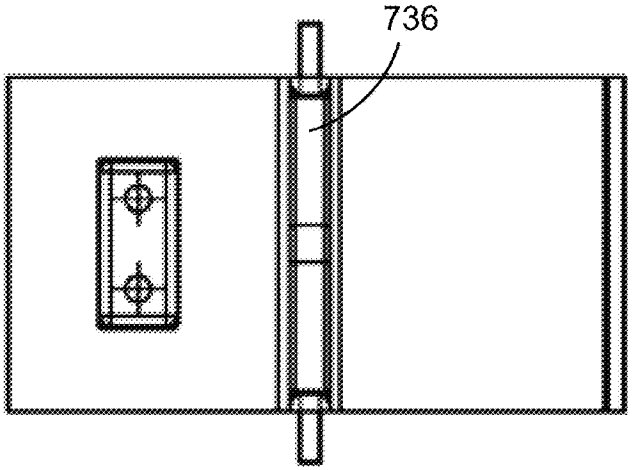
Figure 30B:
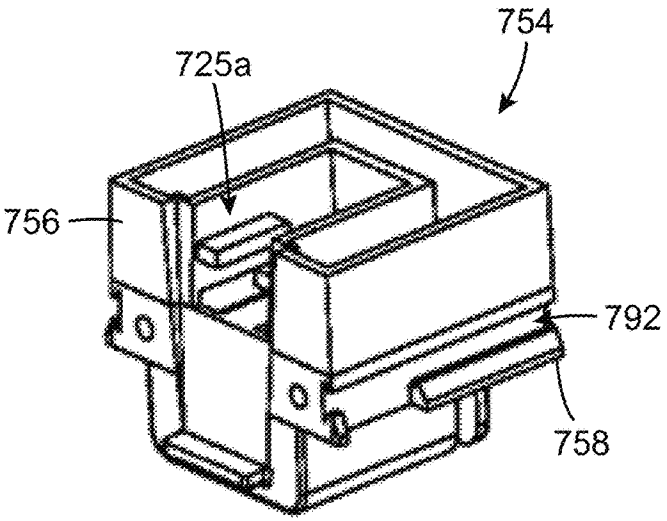
FIGS. 30A-D are respectively a front elevation view, a side elevation view, a bottom plan view and another side elevation view of a patio door frame connector securable to the patio door frame and engageable with the connector body shown in FIGS. 29A-D, according to an embodiment.
Figure 30D:
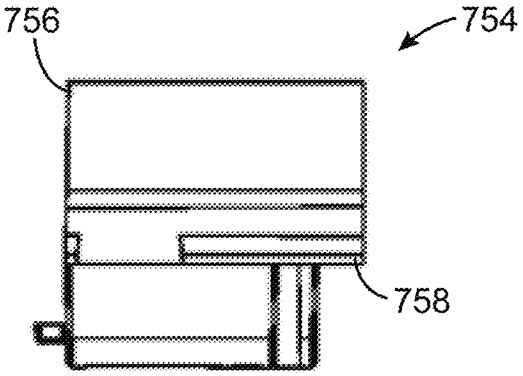
Figure 30A:
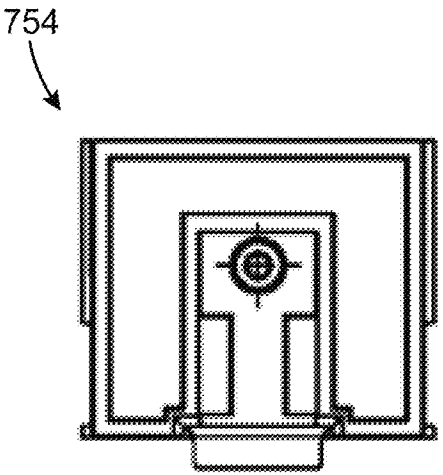
Figure 30C:
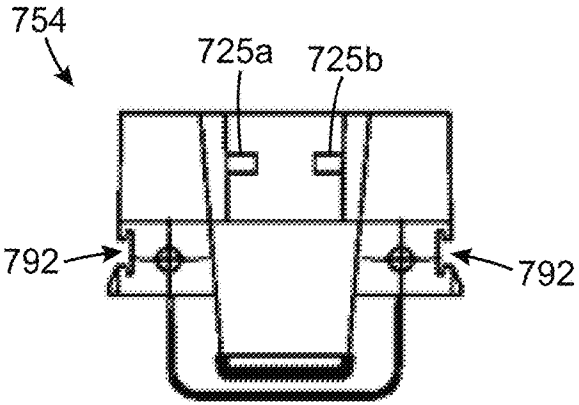

Now turning to FIGS. 26 to 28, the door panel connection assembly 620 for engaging a fixed door panel 43 to the patio door frame 122 is illustrated.

As shown in FIG. 26, a support member 126 is mounted on the patio door frame 122. Such a support member 126 can be, for example and without being limitative, snapped or attached to the patio door frame 122. The support member 126 engages and supports the lower transversally-extending elongated door frame members 44*b*. The support member 126 may be used, for example and without being limitative, for adjusting a vertical position (i.e. the "height") of the elongated door frame member supported thereon. In some embodiments, the support member 126 may also act as a supplementary barrier for sealing the fixed door panel 43.

As better seen in FIG. 27, the patio door frame connector 630 can be mounted or attached (e.g. with screws) to the patio door frame 122. The fixed door panel 43, and more particularly the exposed elongated male or female members 625*a,b* of the connector body 124 can then engage with the corresponding exposed elongated male or female members 631*a,b* of the patio door frame connector 630. In this embodiment, the engagement of the connector body 654 with the patio door frame connector 630 is carried out by inserting the exposed elongated male or female members 625*a,b* within the exposed elongated male or female members 631*a,b* of the patio door frame connector 630. In an embodiment, the engagement between the patio door frame connector 630 and the connector body 654 following the assembly of the door frame 46 through the engagement of the tightening connectors with respective ones of the elongated frame members 44*a-d*.

A portion of the assembled fixed door panel 43, engaged with the patio door frame 122 inside the door panel receiving cavity, is illustrated in FIG. 27. This portion of the assembled fixed door panel 43 corresponds to the "zone 5" shown in FIG. 1.

With reference to FIGS. 29 to 33, another embodiment of a door panel connection assembly 720 will be described, which is similar to the connection assembly 620 and wherein similar features are numbered in the 700 series which correspond to the reference numerals of the previous embodiment.

The connection assembly 720 includes a patio door frame connector 730, similar to the patio door frame connector 630. The patio door frame connector 730 can be mounted near the "zone 7" identified in FIG. 1. While its shape, geometrical features, dimensions and the like are different than the patio door frame connector 630, the patio door frame connector 730 is also securable to the patio door frame 122 and protruding in the door panel receiving cavity when secured to the patio door frame 122. The patio door frame connector 730 also has two elongated male or female members 731*a,b* (i.e. elongated frame connectors), and a protuberance 736 extending towards the door panel receiving cavity.

In the illustrated embodiment, the patio door frame connector 730 has a T-shaped cross-section.

Figure 31:
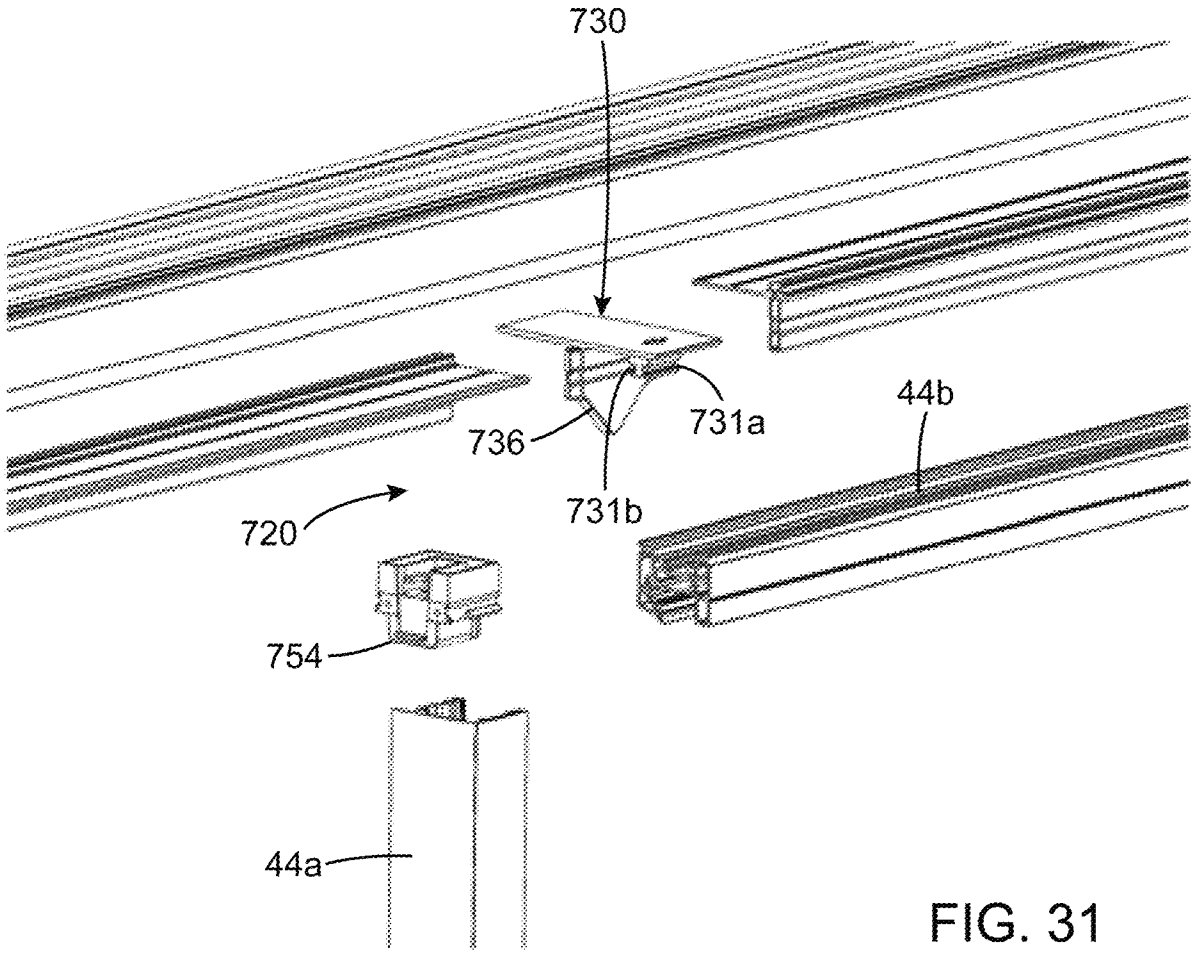
FIG. 31 is an exploded view of another corner of the patio door, the door panel including the connector body shown in FIGS. 29A-D, and the door panel connection assembly shown in FIGS. 29A-D and engageable with the connector body shown in FIGS. 29A-D when the fixed door panel is inserted into the door panel receiving cavity, according to an embodiment.
Figure 32:
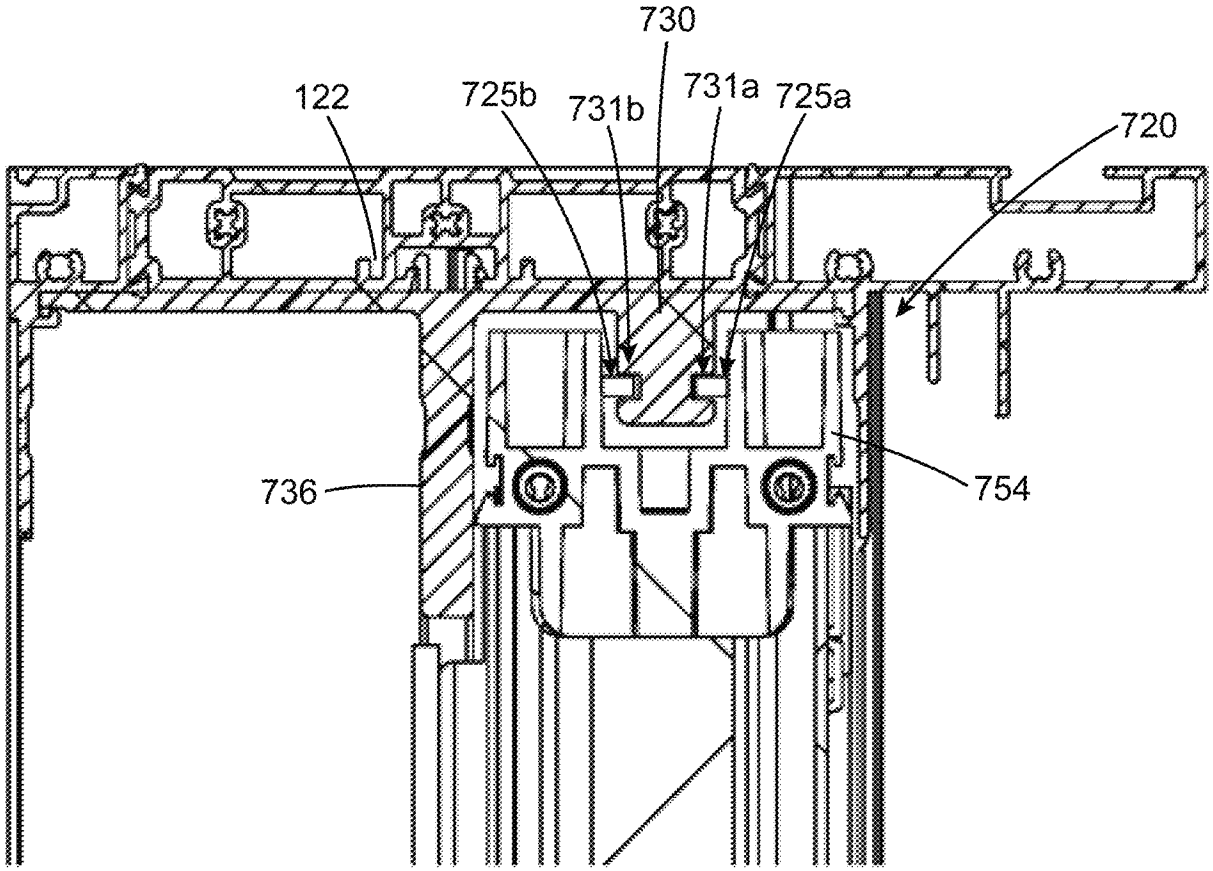
FIG. 32 is a cross-sectional view of the corner of the patio door illustrated in FIG. 31, once assembled, according to an embodiment.
Figure 33:
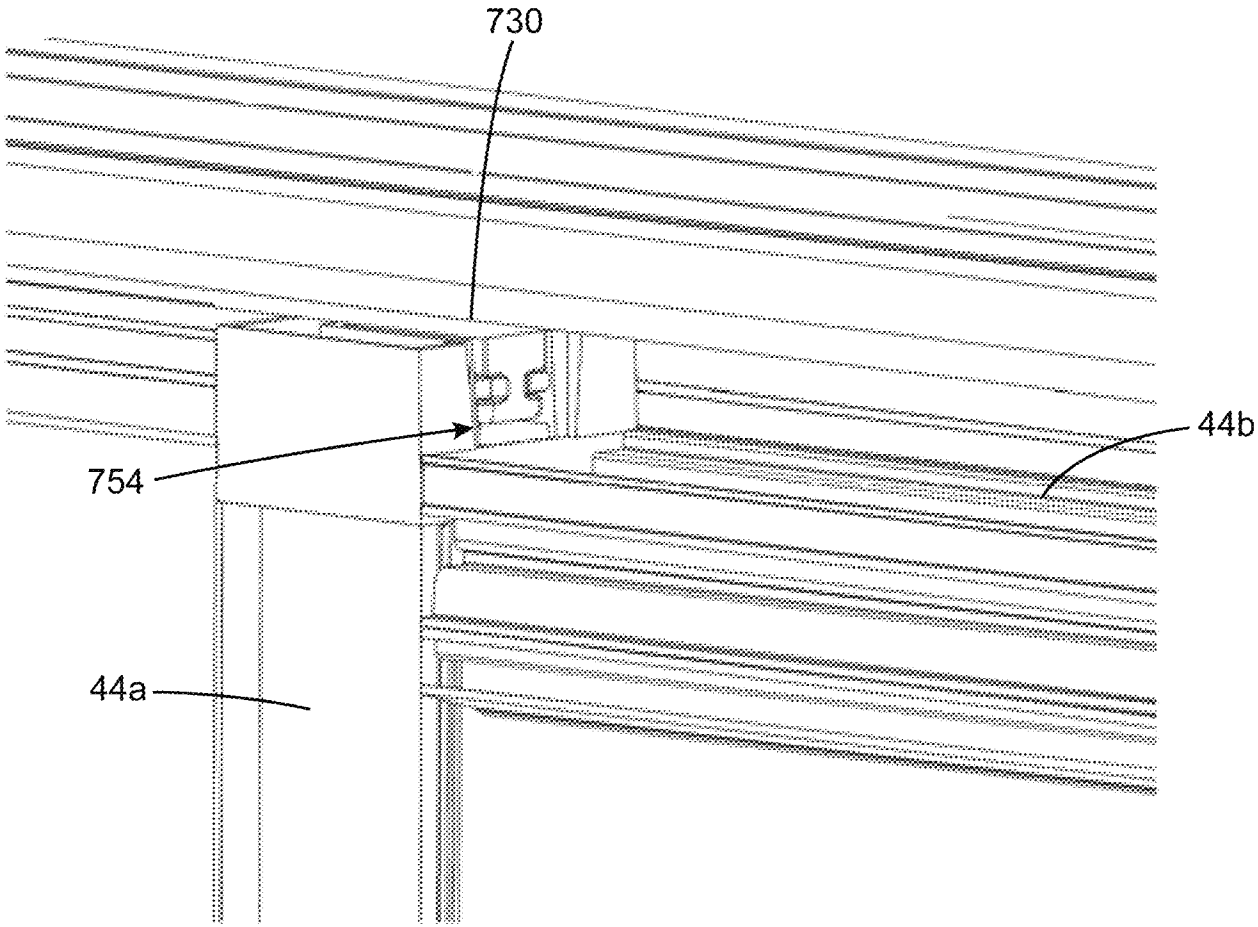
FIG. 33 is a perspective view of the corner of the patio door shown in FIG. 30.

The connection assembly 720 also includes a connector body 754. The connector body 754 is similar to the ones which have been previously described, and so is engageable with two of elongated door frame members (not shown). In the illustrated embodiment of FIG. 30A-D, the connector body 754 includes two elongated body connectors members 725*a,b* (also referred to as "two elongated male or female members") positioned on a respective side of the connector body 754, i.e. one on the inside sidewall and one of the outside sidewall. As illustrated, the two elongated body connectors 725*a,b* are elongated male connectors (or, alternatively "members") protruding from two opposite sidewalls of the connector body 754, inwardly inside the central channel 111, i.e. protruding from the inner wall surfaces. As illustrated in FIGS. 31 to 33, the two elongated frame connectors 731*a,b* of the patio door frame connector 730 can be engaged (i.e. slidably inserted) with the two elongated body connectors members 725*a,b* of the connector body 754.

Similarly to what has been previously presented, one would readily understood that the configuration of the male/female members of the patio door frame connector 730 and/or the connector body 754 could be interchanged. Furthermore, each one of these components (i.e. the patio door frame connector 730 and the connector body 754) could be provided with injecting hole(s) configured to receive an insulating barrier, such as, and without being limitative, silicone.

It is appreciated that, in an alternative embodiment (not shown), the tightening connector body 754 can include an insert receiving cavity configured to receive a tightening insert therein and/or can be free of weatherstrip receiving channel(s).

Once the fixed door panel 43 is assembled in the "zone 5" and the "zone 7", the result is a fixed door panel 43 insertable into the door panel receiving cavity. Such a fixed door panel 43 usually includes four elongated door frame members and four connector bodies connecting altogether pairs of elongated door frame members. Once assembled, each of the elongated door frame member are abutting two other elongated door frame members. The two elongated body connectors members 725*a,b* of the connector body 754 are engaged (i.e. inserted) to the corresponding two elongated frame connectors 731*a,b* of the patio door frame connector 730. Once engaged in a predetermined position wherein the outer longitudinal edge 104 of the fixed door panel 43 abuts against the patio door frame 122, the fixed door panel 43 can be secured to the patio door frame 122 using suitable mechanical fasteners, such as screws or nails, as it is known in the art.

It will be readily understood patio door or door panel for patio door may be conceived and installed according to at least one of the embodiments described above. More particularly, it is appreciated that features of one of the above described embodiments can be combined with the other embodiments, variants, or alternatives thereof.

Several alternative embodiments and examples have been described and illustrated herein. The embodiments of the door panel and door panel connection assembly for a patio door described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the door panel and door panel connection assembly for a patio door may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A door panel for a patio door, the door panel comprising:

a door panel frame including at least four elongated door frame members and having a longitudinal axis and a transversal axis; and at least one tightening connector assembly comprising:

a connector body having a first frame segment and a second frame segment extending along a tightening axis, having an insert receiving cavity defined therein with an insert contact surface defining an oblique angle with respect to the tightening axis, the connector body being engageable with two of the elongated door frame members abutting each other and configured in an orthogonal configuration with the first frame segment being engaged with a first one of the two elongated door frame members and the second frame segment being engaged with a second one of the two elongated door frame members;

a tightening insert engageable in the insert receiving cavity of the connector body and having a connector contact surface contacting the insert contact surface when engaged in the insert receiving cavity; and at least one mechanical fastener insertable into the second one of the two elongated door frame members, the connector body, and the tightening insert, the connector body and the tightening insert pulling the second one of the two elongated door frame members towards and against the first one of the two elongated door frame members and along the tightening axis when being secured together.

2. The door panel of claim 1, wherein each one of the first and second elongated frame members comprises two opposite ends, an internal edge, and an external edge, and end edges connecting the internal and external edges, wherein adjacent ones of the end edges of the first and second elongated frame members are straight end edges and the straight end edge of one of the first and second elongated frame members abuts against the internal edge of the other one of the first and second elongated frame members, and wherein the connector receiving cavity of one of the first and second elongated frame members is accessible at least through the internal edge and the connector receiving cavity of the other one of the first and second elongated frame members is accessible through the end edge adjacent to the one of the first and second elongated frame members.

3. The door panel of claim 2, wherein each one of the first and second elongated frame members comprises a connector receiving cavity defined into adjacent ones of the two opposite ends with a respective one of the first frame segment and the second frame segment being insertable therein.

4. The door panel of claim 2, wherein the other one of the first and second elongated frame members comprises a profile with two sidewalls defining a central channel including the connector receiving cavity at one of the opposite ends thereof and the central channel is open along the external edge of the other one of the first and second elongated frame members, and wherein the connector receiving cavity of the one of the first and second elongated frame members is accessible through the end edge.

5. The door panel of claim 1, wherein the insert receiving cavity is defined in the second frame segment of the connector body with the insert contact surface extending inwardly of the connector body.

6. The door panel of claim 1, wherein the insert contact surface has a profile defined by a plurality of oblique segments, each one of the oblique segments forming the oblique angle with respect to the tightening axis, the profile having an average slope defining the oblique angle, and wherein the connector contact surface is complementary to the insert contact surface.

7. The door panel of claim 1, wherein the connector body comprises a first section of a mechanical fastener channel extending therethrough and being opened in the insert receiving cavity, and wherein the tightening insert comprises a second section of the mechanical fastener channel extending therethrough, the second section of the mechanical fastener channel being aligned with the first section when the tightening insert is inserted into the insert receiving cavity of the connector body.

8. The door panel of claim 1, wherein the second frame segment comprises two sidewalls and the insert receiving cavity comprises two insert receiving cavities, each one of the two insert receiving cavities being defined in a respective one of the sidewalls and wherein the tightening insert comprises two tightening inserts, each one being engageable with a respective one of the insert receiving cavities defined in the two sidewalls.

9. The door panel of claim 1, wherein the tightening axis extends substantially parallel to the transversal axis of the door panel frame, and wherein the door panel comprises four tightening connector assemblies, each one being provided in a respective corner of the door panel frame.

10. The door panel of claim 1, wherein each one of the first and second elongated door frame members comprises a weatherstrip receiving channel extending longitudinally therein; and the connector body of the at least one tightening connector assembly further comprises at least one weatherstrip receiving channel defined therein, the at least one weatherstrip receiving channel of the connector body being aligned with the weatherstrip receiving channel of a respective one of the elongated door frame members when engaged together.

11. A tightening connector assembly for a patio door frame including at least two elongated door frame members and having a longitudinal axis and a transversal axis, the tightening connector assembly comprising:

a connector body having a first frame segment and a second frame segment extending along a tightening axis, having an insert contact surface defining at least partially an insert receiving cavity and a first section of a mechanical fastener channel extending therethrough and being opened in the insert receiving cavity, the insert contact surface defining an oblique angle with respect to the tightening axis, the connector body being engageable with two of the at least two elongated door frame members abutting each other and configured in an orthogonal configuration with the first frame segment being engageable with a first one of the at least two elongated door frame members and the second frame segment being engageable with a second one of the at least two elongated door frame members; and a tightening insert insertable in the insert receiving cavity of the connector body and having a connector contact surface contacting the insert contact surface when engaged in the insert receiving cavity and a second section of the mechanical fastener channel extending therethrough, the second section of the mechanical fastener channel being aligned with the first section when the tightening insert is inserted into the insert receiving cavity of the connector body.

12. The tightening connector assembly of claim 11, wherein each one of the first and second elongated frame members comprises two opposite ends, an internal edge, and an external edge, and end edges connecting the internal and external edges, wherein adjacent ones of the end edges are straight edges and the straight end edge of one of the first and second elongated frame members abuts against the internal edge of the other one of the first and second elongated frame members.

13. The tightening connector assembly of claim 12, wherein each one of the first and second elongated frame members comprises a connector receiving cavity positioned near adjacent ones of the two opposite ends and configured for receiving a respective one of the first frame segment and the second frame segment therein, and wherein the connector receiving cavity of one of the first and second elongated frame members is accessible at least through the internal edge and the connector receiving cavity of the other one of the first and second elongated frame members is accessible through the end edge adjacent to the one of the first and second elongated frame members.

14. The tightening connector assembly of claim 13, wherein the other one of the first and second elongated frame members comprises a profile with two sidewalls defining a central channel including the connector receiving cavity at one of the opposite ends thereof and the central channel is open along the external edge of the other one of the first and second elongated frame members, and wherein the connector receiving cavity of the one of the first and second elongated frame members is accessible through the end edge.

15. The tightening connector assembly of claim 11, wherein the insert receiving cavity is defined in the second frame segment of the connector body with the insert contact surface extending inwardly of the connector body.

16. The tightening connector assembly of claim 11, wherein the insert contact surface has a profile defined by a plurality of oblique segments, each one of the oblique segments forming the oblique angle with respect to the tightening axis, the profile having an average slope defining the oblique angle, and wherein the connector contact surface is complementary to the insert contact surface.

17. A door panel frame for a patio door and having a longitudinal axis and a transversal axis, the door panel frame comprising:

elongated door frame members wherein at least one of the elongated door frame members has a profile with an inside sidewall, an outside sidewall, and a central channel extending between the inside sidewall and the outside sidewall, each one of the inside sidewall and the outside sidewall of the at least one door frame member defining a weatherstrip receiving channel extending longitudinally therein; and at least one connector body having a profile with a first frame segment and a second frame segment, the connector body being engageable with two of the elongated door frame members abutting each other and configured in an orthogonal configuration with the first frame segment being engaged with a first one of the two elongated door frame members and the second frame segment being engaged with a second one of the two elongated door frame members, the profile has an inside sidewall, an outside sidewall, and a center channel extending between the inside sidewall and the outside sidewall of the connector body, each one of the inside sidewall and the outside sidewall of the at least one connector body defining a weatherstrip receiving channel aligned with the weatherstrip receiving channels of the inside sidewall and the outside sidewall respectively of a corresponding one of the elongated door frame members when engaged together, wherein the weatherstrip receiving channels are at least one of: opened inwardly into the center channel of the at least one connector body and the central channel of the corresponding one of the elongated door frame members and opened on outer wall surface of the inside sidewall and outside sidewall of the at least one connector body and the corresponding one of the elongated door frame members.

18. The door panel frame of claim 17, wherein each one of the inside sidewalls and outside sidewalls comprises an inner wall surface delimiting the central channel and an outer wall surface opposed to the inner wall surface, and wherein the two weatherstrip receiving channels are defined on the inner wall surfaces of the inside and outside sidewalls and face each other if the connector body is mounted to a lower edge of the door panel frame and the two weatherstrip receiving channels are defined on the outer wall surfaces of the inside and outside sidewalls if the connector body is mounted to an upper edge of the door panel frame.

19. The door panel frame of claim 17, wherein each one of the elongated door frame members comprises a corresponding one of the weatherstrip receiving channel extending therealong and the door panel frame further comprises four of the connector body, each one including at least one of the weatherstrip receiving channel, each one of the connector bodies being mounted in a respective corner of the door panel frame to connect two abutting ones of the elongated door frame members, the weatherstrip receiving channels of the elongated door frame members and the connector bodies defining a weatherstrip path extending substantially continuously along a perimeter of the door panel frame.

20. The door panel frame of claim 17, wherein each one of the first and second elongated frame members comprises two opposite ends, an internal edge, and an external edge, and end edges connecting the internal and external edges, wherein adjacent ones of the end edges are straight edges and the straight end edge of one of the first and second elongated frame members abuts against the internal edge of the other one of the first and second elongated frame members.

21. A patio door comprising:

a patio door frame defining a door panel receiving cavity;

a fixed door panel insertable into the door panel receiving cavity and having a door panel frame including at least four elongated door frame members and at least one connector body connecting together two of the elongated door frame members abutting each other and configured in an orthogonal configuration, the at least one connector body comprising at least two elongated body connectors, at least one on each side thereof, the at least two elongated body connectors being accessible when the at least one connector body is engaged with the two elongated door frame members; and at least one door panel connection assembly comprising a patio door frame connector secured to the patio door frame, protruding in the door panel receiving cavity and having at least two elongated frame connectors, at least one on each side thereof and being slidably engageable with the at least two elongated body connectors of the connector body to be engageable therewith when the fixed door panel is inserted into the door panel receiving cavity.

22. The patio door of claim 21, wherein the door panel frame has a longitudinal axis and a transversal axis and the at least two elongated body connectors comprise rails protruding along the transversal axis and the at least two elongated frame connectors comprise complementary elongated grooves, wherein the rails are slidably engageable into a respective one of the elongated grooves, and wherein the at least one connector body comprises a profile having an inside sidewall and an outside sidewall and the at least two elongated body connectors extending along a respective one of the inside and outside sidewalls on inner wall surfaces thereof.

* * * * *